US011466929B2

(12) United States Patent
Choi

(10) Patent No.: US 11,466,929 B2
(45) Date of Patent: Oct. 11, 2022

(54) REFRIGERATOR HAVING DRAWER

(71) Applicant: LG ELECTRONICS INC., Seoul (KR)

(72) Inventor: Kwang Hyun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 411 days.

(21) Appl. No.: 16/582,605

(22) Filed: Sep. 25, 2019

(65) Prior Publication Data

US 2021/0010749 A1 Jan. 14, 2021

(30) Foreign Application Priority Data

Jul. 12, 2019 (KR) ..... 10-2019-0084447

(51) Int. Cl.
*F25D 25/02* (2006.01)
*F25D 17/04* (2006.01)

(52) U.S. Cl.
CPC ..... *F25D 25/025* (2013.01); *F25D 17/042* (2013.01); *F25D 2317/0415* (2013.01); *F25D 2400/36* (2013.01); *F25D 2700/02* (2013.01)

(58) Field of Classification Search
CPC ..... F25D 25/025; F25D 17/042; F25D 2317/0415; F25D 23/02; F25D 2317/041; A47B 88/941; A47B 2210/175
See application file for complete search history.

(56) References Cited

U.S. PATENT DOCUMENTS

| | | | |
|---|---|---|---|
| 658,999 | A | 10/1900 | Scannel |
| 1,067,404 | A | 7/1913 | Callaghan |
| 2,072,244 | A | 3/1937 | Coursen |
| 2,679,658 | A | 6/1954 | McCormick |
| 2,731,318 | A | 1/1956 | Hoff |
| 4,545,628 | A | 10/1985 | Richey |
| 5,253,488 | A | 10/1993 | Kim et al. |
| 6,044,606 | A | 4/2000 | Hamar |
| 6,109,774 | A | 8/2000 | Holmes et al. |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

Chinese Office Action dated Aug. 20, 2021 issued in CN Application No. 201910857469.X.

(Continued)

*Primary Examiner* — Lionel Nouketcha
(74) *Attorney, Agent, or Firm* — KED & Associates LLP

(57) ABSTRACT

A refrigerator may include a cabinet, and a drawer provided with a front panel and a storage bin provided at a rear of the front panel, the front panel being provided so that the open front portion of the storage chamber is opened and closed, and the storage bin being received in a storage chamber. The refrigerator may also include a deodorizing case including an upper end part provided on an inner surface of the storage bin, and a lower end part provided on an outer surface of the storage bin. Additionally, a deodorizing member provided in an inner part of the deodorizing case to remove an odor of the storage chamber.

20 Claims, 44 Drawing Sheets

(56) References Cited

U.S. PATENT DOCUMENTS

| | | | |
|---|---|---|---|
| 6,371,584 | B1 | 4/2002 | Alreck |
| 6,722,749 | B1 | 4/2004 | Pagac |
| 7,600,829 | B2 | 10/2009 | Oh et al. |
| 7,600,830 | B2 | 10/2009 | Oh et al. |
| 7,600,833 | B2 | 10/2009 | Oh et al. |
| 7,690,586 | B2 * | 4/2010 | Kang ..... F25D 17/042 239/43 |
| 8,282,177 | B1 | 10/2012 | Rotter |
| 8,360,539 | B2 | 1/2013 | Brown et al. |
| 8,376,481 | B2 | 2/2013 | Lee |
| 8,497,644 | B2 | 7/2013 | Eom et al. |
| 8,668,289 | B2 | 3/2014 | Lee et al. |
| 8,794,722 | B2 | 8/2014 | Nuss et al. |
| 8,844,110 | B2 | 9/2014 | Rotter |
| 8,864,249 | B2 | 10/2014 | Nam et al. |
| 9,107,494 | B2 | 8/2015 | Scheuring et al. |
| 9,377,238 | B2 | 6/2016 | Hall et al. |
| 9,523,533 | B2 | 12/2016 | Nam et al. |
| 9,982,937 | B2 | 5/2018 | Tierney et al. |
| 10,234,195 | B2 | 3/2019 | Yasaka et al. |
| 10,465,970 | B1 | 11/2019 | Kang et al. |
| 10,598,428 | B2 | 3/2020 | Kim |
| 10,690,401 | B2 | 6/2020 | Yang et al. |
| 10,712,083 | B1 | 7/2020 | Choi |
| 10,767,920 | B1 | 9/2020 | Choi |
| 10,786,080 | B1 | 9/2020 | Stravitz et al. |
| 10,876,788 | B2 | 12/2020 | Choi |
| 10,932,568 | B2 | 3/2021 | Subrahmanya et al. |
| 10,939,758 | B2 | 3/2021 | Kim |
| 11,033,104 | B2 | 6/2021 | Kim |
| 11,047,619 | B2 | 6/2021 | Choi |
| 11,131,500 | B2 | 9/2021 | Kim |
| 2003/0201700 | A1 | 10/2003 | Cho |
| 2004/0031705 | A1 | 2/2004 | Detemple, II et al. |
| 2004/0046488 | A1 | 3/2004 | Hogan |
| 2004/0056573 | A1 | 3/2004 | Chae |
| 2006/0042306 | A1 | 3/2006 | Choi et al. |
| 2006/0087207 | A1 | 4/2006 | Oh et al. |
| 2006/0087208 | A1 | 4/2006 | Oh et al. |
| 2006/0207283 | A1 | 9/2006 | Kim et al. |
| 2006/0248916 | A1 | 11/2006 | Kim et al. |
| 2006/0250062 | A1 | 11/2006 | Janda et al. |
| 2007/0262686 | A1 | 11/2007 | Ji |
| 2008/0018215 | A1 | 1/2008 | Carden et al. |
| 2009/0045713 | A1 | 2/2009 | Kunkle et al. |
| 2009/0160298 | A1 | 6/2009 | Chen et al. |
| 2009/0167131 | A1 | 7/2009 | Oh et al. |
| 2009/0277210 | A1 | 11/2009 | Eveland et al. |
| 2010/0192621 | A1 | 8/2010 | Kim |
| 2010/0236279 | A1 | 9/2010 | Eom et al. |
| 2010/0239795 | A1 | 9/2010 | Gat |
| 2010/0283365 | A1 | 11/2010 | Chen |
| 2011/0005264 | A1 | 1/2011 | Lee et al. |
| 2011/0006656 | A1 | 1/2011 | Nam et al. |
| 2011/0050065 | A1 | 3/2011 | Lee et al. |
| 2011/0050066 | A1 | 3/2011 | Lee et al. |
| 2011/0146333 | A1 | 6/2011 | Koo et al. |
| 2011/0162402 | A1 | 7/2011 | Park |
| 2011/0181163 | A1 | 7/2011 | Han et al. |
| 2011/0210655 | A1 | 9/2011 | Brown et al. |
| 2012/0091872 | A1 | 4/2012 | Matthes et al. |
| 2012/0125035 | A1 | 5/2012 | Chellappan et al. |
| 2012/0306338 | A1 | 12/2012 | Nagahata et al. |
| 2013/0055543 | A1 | 3/2013 | Rotter |
| 2013/0129267 | A1 | 5/2013 | Chen |
| 2013/0145972 | A1 | 6/2013 | Knox et al. |
| 2013/0264928 | A1 | 10/2013 | Hong et al. |
| 2013/0270986 | A1 | 10/2013 | Min et al. |
| 2013/0270987 | A1 | 10/2013 | Kelly |
| 2013/0270989 | A1 | 10/2013 | Park et al. |
| 2014/0191646 | A1 | 7/2014 | Nuss et al. |
| 2014/0265783 | A1 | 9/2014 | Hauer et al. |
| 2014/0265797 | A1 | 9/2014 | Scheuring et al. |
| 2014/0265806 | A1 | 9/2014 | Hall et al. |
| 2014/0319990 | A1 | 10/2014 | Gephart et al. |
| 2015/0059398 | A1 | 3/2015 | Yoo et al. |
| 2015/0059399 | A1 | 3/2015 | Hwang et al. |
| 2015/0069899 | A1 | 3/2015 | Han et al. |
| 2015/0184918 | A1 | 7/2015 | Klingshirn et al. |
| 2016/0146533 | A1 | 5/2016 | Jung |
| 2016/0153704 | A1 | 6/2016 | Burke et al. |
| 2016/0178274 | A1 | 6/2016 | Shin |
| 2016/0265816 | A1 | 9/2016 | Gillette et al. |
| 2016/0305705 | A1 | 10/2016 | Dubina et al. |
| 2016/0320118 | A1 | 11/2016 | Millett |
| 2016/0370063 | A1 | 12/2016 | Yang |
| 2017/0024946 | A1 | 1/2017 | Hashemi et al. |
| 2017/0051967 | A1 | 2/2017 | Tierney et al. |
| 2017/0122651 | A1 | 5/2017 | Cizik et al. |
| 2017/0227279 | A1 | 8/2017 | Yang et al. |
| 2017/0336129 | A1 | 11/2017 | Cunningham |
| 2017/0362864 | A1 | 12/2017 | Fazi et al. |
| 2018/0128540 | A1 | 5/2018 | Yasaka et al. |
| 2018/0283771 | A1 | 10/2018 | Shin et al. |
| 2018/0291669 | A1 | 10/2018 | Kim et al. |
| 2018/0356148 | A1 | 12/2018 | Fei et al. |
| 2019/0219324 | A1 | 7/2019 | Kang |
| 2019/0242640 | A1 | 8/2019 | Minoru et al. |
| 2019/0292831 | A1 | 9/2019 | Choi |
| 2019/0293341 | A1 | 9/2019 | Yeom |
| 2019/0323763 | A1 | 10/2019 | Kang |
| 2019/0346199 | A1 | 11/2019 | Choi |
| 2019/0390895 | A1 | 12/2019 | Choi |
| 2020/0011593 | A1 | 1/2020 | Ji |
| 2020/0069056 | A1 | 3/2020 | Kim |
| 2020/0072533 | A1 | 3/2020 | Cho |
| 2020/0072540 | A1 | 3/2020 | Kim |
| 2020/0072542 | A1 | 3/2020 | Kim |
| 2021/0003337 | A1 | 1/2021 | Voltarelli et al. |
| 2021/0259416 | A1 | 8/2021 | Kim |

FOREIGN PATENT DOCUMENTS

| | | |
|---|---|---|
| CN | 102226626 | 10/2011 |
| CN | 202254607 | 5/2012 |
| CN | 202970226 | 6/2013 |
| CN | 204902419 | 12/2015 |
| CN | 107388718 | 11/2017 |
| CN | 108645104 | 10/2018 |
| CN | 109028726 | 12/2018 |
| CN | 208640001 | 3/2019 |
| CN | 109690213 | 4/2019 |
| CN | 208736030 | 4/2019 |
| CN | 109838961 | 6/2019 |
| CN | 109990557 | 7/2019 |
| CN | 110873500 | 3/2020 |
| DE | 29620152 | 4/1997 |
| DE | 10-2005-016418 | 11/2005 |
| EP | 1 724 540 | 11/2006 |
| EP | 2 299 215 | 3/2011 |
| EP | 2 752 632 | 7/2014 |
| EP | 3 023 721 | 5/2016 |
| EP | 3 505 854 | 7/2019 |
| EP | 3 546 862 | 10/2019 |
| EP | 3 617 630 | 3/2020 |
| GB | 2108564 | 5/1983 |
| JP | H 04-138337 | 12/1992 |
| JP | H 07-275049 | 10/1995 |
| JP | H 08-303944 | 11/1996 |
| JP | 2001-280824 | 10/2001 |
| JP | 2002-264943 | 9/2002 |
| KR | 10-2006-0025806 | 3/2006 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |
| KR | 20090027112 A * | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |
| KR | 10-2010-0012544 | 2/2010 |
| KR | 10-0946784 | 3/2010 |

(56) References Cited

FOREIGN PATENT DOCUMENTS

| | | |
|---|---|---|
| KR | 10-2010-0078916 | 7/2010 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | 10-2018-0138085 | 12/2018 |
| KR | 10-2019-0081331 | 7/2019 |
| WO | 92/14522 | 9/1992 |
| WO | WO 03/016661 | 2/2003 |
| WO | WO 2018/051963 | 3/2018 |
| WO | WO 2019/242234 | 12/2019 |

OTHER PUBLICATIONS

Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
United States Office Action dated Oct. 6, 2021 issued in co-pending related U.S. Appl. No. 16/583,726.
United States Office Action dated Oct. 6, 2021 issued in co-pending related U.S. Appl. No. 16/582,647.
United States Office Action dated Oct. 6, 2021 issued in co-pending related U.S. Appl. No. 16/582,668.
Chinese Office Action dated Sep. 3, 2021 issued in CN Application No. 201910905106.9.
European Search Report dated Mar. 23, 2020 issued in EP Application No. 19199602.4.
European Office Action dated Sep. 30, 2020 issued in EP Application No. 19199556.2.
European Search Report dated Apr. 1, 2020 issued in EP Application No. 19199637.0.
U.S. Appl. No. 16/582,518, filed Sep. 25, 2019.
U.S. Appl. No. 16/582,712, filed Sep. 25, 2019.
U.S. Appl. No. 16/582,810, filed Sep. 25, 2019.
U.S. Appl. No. 16/582,831, filed Sep. 25, 2019.
U.S. Appl. No. 16/585,284, filed Sep. 27, 2019.
European Communication dated Feb. 8, 2021 issued in EP Application No. 19199627.1.
European Search Report dated Aug. 14, 2020 issued in EP Application No. 19199647.9.
United States Office Action dated Mar. 4, 2020 issued in U.S. Appl. No. 16/582,712.
United States Office Action dated Mar. 9, 2020 issued in U.S. Appl. No. 16/582,810.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
United States Office Action dated Oct. 15, 2021 issued in co-pending related U.S. Appl. No. 16/582,755.
European Search Report dated Mar. 12, 2020 issued in Application No. 19199586.9.
European Search Report dated Mar. 17, 2020 issued in Application No. 19199553.9.
European Search Report dated Mar. 20, 2020 issued in Application No. 19199569.5.
European Search Report dated Mar. 30, 2020 issued in Application No. 19199556.2.
European Search Report dated Apr. 3, 2020 issued in Application No. 19199625.5.
European Search Report dated Apr. 6, 2020 issued in Application No. 19199587.7.
European Search Report dated Apr. 6, 2020 issued in Application No. 19199629.7.
European Search Report dated Apr. 7, 2020 issued in Application No. 19199607.3.
European Office Action dated Sep. 1, 2021 issued in EP Application No. 19199607.3.
United States Office Action dated Nov. 19, 2020 issued in co-pending related U.S. Appl. No. 16/582,831.
United States Notice of Allowance dated Feb. 23, 2022 issued in co-pending related U.S. Appl. No. 16/582,518.
United States Notice of Allowance dated Feb. 23, 2022 issued in co-pending related U.S. Appl. No. 16/585,284.
GE (Refrigerator Freezer Door Pops Open, https:/ /products.geapplicances.com/appliance/gea-support-search-content?contendId=16979) (Year: 2015).
United States Office Action dated Apr. 11, 2022 issued in co-pending related U.S. Appl. No. 16/585,301.
United States Office Action dated Jan. 31, 2022 issued in co-pending related U.S. Appl. No. 16/582,756.
U.S. Appl. No. 16/583,726, filed Sep. 26, 2019.
U.S. Appl. No. 16/582,647, filed Sep. 25, 2019.
U.S. Appl. No. 16/582,605, filed Sep. 25, 2019.
U.S. Appl. No. 16/582,756, filed Sep. 25, 2019.
U.S. Appl. No. 16/582,668, filed Sep. 25, 2019.
U.S. Appl. No. 16/582,755, filed Sep. 25, 2019.
U.S. Appl. No. 17/830,750, filed Jun. 2, 2022.
U.S. Appl. No. 16/585,301, filed Sep. 27, 2019.
U.S. Appl. No. 16/585,816, filed Sep. 27, 2019.
Chinese Office Action dated May 16, 2022 issued in CN Application No. 201910905106.9.

* cited by examiner

REFRIGERATOR HAVING DRAWER

CROSS-REFERENCE TO RELATED APPLICATION

The present application claims priority to Korean Patent Application No. 10-2019-0084447, filed Jul. 12, 2019 in Korea, the entire contents of which is incorporated herein by reference.

BACKGROUND

1. Field

The present disclosure relates to a refrigerator having a drawer. More particularly, the present disclosure relates to a refrigerator having a drawer, wherein a deodorizing member is installed in a storage bin of the drawer to remove an odor of the storage bin.

2. BACKGROUND

A refrigerator may be composed of a compressor, a condenser, an expansion valve, and an evaporator, etc., and may discharge cool air generated by a refrigeration cycle to lower temperature of an inner part of the refrigerator so as to freeze or refrigerate food.

The refrigerator may include a freezer compartment in which a food or beverage is frozen to be stored, and a refrigerating compartment in which the food or beverage is stored at low temperature. A kimchi refrigerator is a type of refrigerator in which food or vegetables such as kimchi are stored while maintaining freshness thereof.

The refrigerator may be classified into various types depending on a door opening and closing method of a storage chamber in a cabinet, such as a swinging door-type refrigerator, a drawer-type refrigerator, and a hybrid-type refrigerator having both doors and drawers. The hybrid-type refrigerator has a structure in which a swinging door is provided in an upper portion of the cabinet and a drawer is provided in a lower portion thereof.

The drawer provided in the drawer refrigerator or the hybrid-type refrigerator may open, by a user's operation, from an inside space of the cabinet in a sliding manner. The drawer may close by being pushed, by a user's operation, into the inside space of the cabinet, thereby allowing an open front portion of the cabinet to be closed.

The drawer may include a front panel and a storage bin (or storage bin), the front panel forming a front surface of the refrigerator and being pulled out/pushed in, thereby allowing the inside space of the cabinet to be opened/closed and the storage bin being provided in rear of the front panel and received in the inside space of the cabinet. By pulling the front panel, the storage bin may open from the inside space of the cabinet, thus various foods can be stored in and taken out from the storage bin.

The drawer provided in the drawer refrigerator or the hybrid-type refrigerator is mainly provided in the lower portion of the cabinet. This is because, due to weight of storage items stored in the storage bin of the drawer, the drawer may be removed from the cabinet and fall down when the drawer is opened.

However, when the drawer is provided in the lower portion of the cabinet, the user may bend over at the waist while keeping away from the front panel by an appropriate distance for opening of the drawer.

A deodorizer may be provided in the storage space of the refrigerator. The deodorizer may be attached to a wall surface of a door or the storage bin to remove odor of an inner part of the storage space by adsorbing odor molecules of the inner part of the storage space.

A deodorizer installation structure of a refrigerator is disclosed in Korean Patent Application Publication No. 10-2009-0114265 and Korean Patent Application Publication No. 10-2009-0027111, the subject matters of which are incorporated herein by reference.

The deodorizer installation structure may include a deodorizing unit and a deodorizing case allowing the deodorizer to be installed in the door, storage space, or storage bin of a refrigerator, wherein the deodorizer is mounted in the deodorizing case by being received thereinto.

The deodorizer installation structure may be designed to allow the deodorizing unit and the deodorizing case to be mounted in the door, the storage space, or the storage bin in a complicated assembly structure. Accordingly, as a number of parts to be introduced increases, it may take a relatively long time to separate and join the parts.

The deodorizing unit and the deodorizing case, to which the deodorizer is fixed, may protrude from a wall surface of the door or the storage space. Accordingly, the deodorizing unit and the deodorizing case may occupy the storage bin in which the food or the stored items are housed, and thus space utilization of the storage space decreases.

As the installation position of the deodorizer is restricted to the inner part of one storage chamber, cool air from which odor is not completely removed is circulated to other storage chambers. Accordingly, the odor may be diffused to the other storage chambers.

BRIEF DESCRIPTION OF THE DRAWINGS

Arrangements and embodiments may be described in detail with reference to the following drawings in which like reference numerals refer to like elements, and wherein.

DETAILED DESCRIPTION

An exemplary embodiment of a refrigerator having a drawer of the present disclosure may be described in detail with reference to FIGS. 1 to 34.

Figure 1:
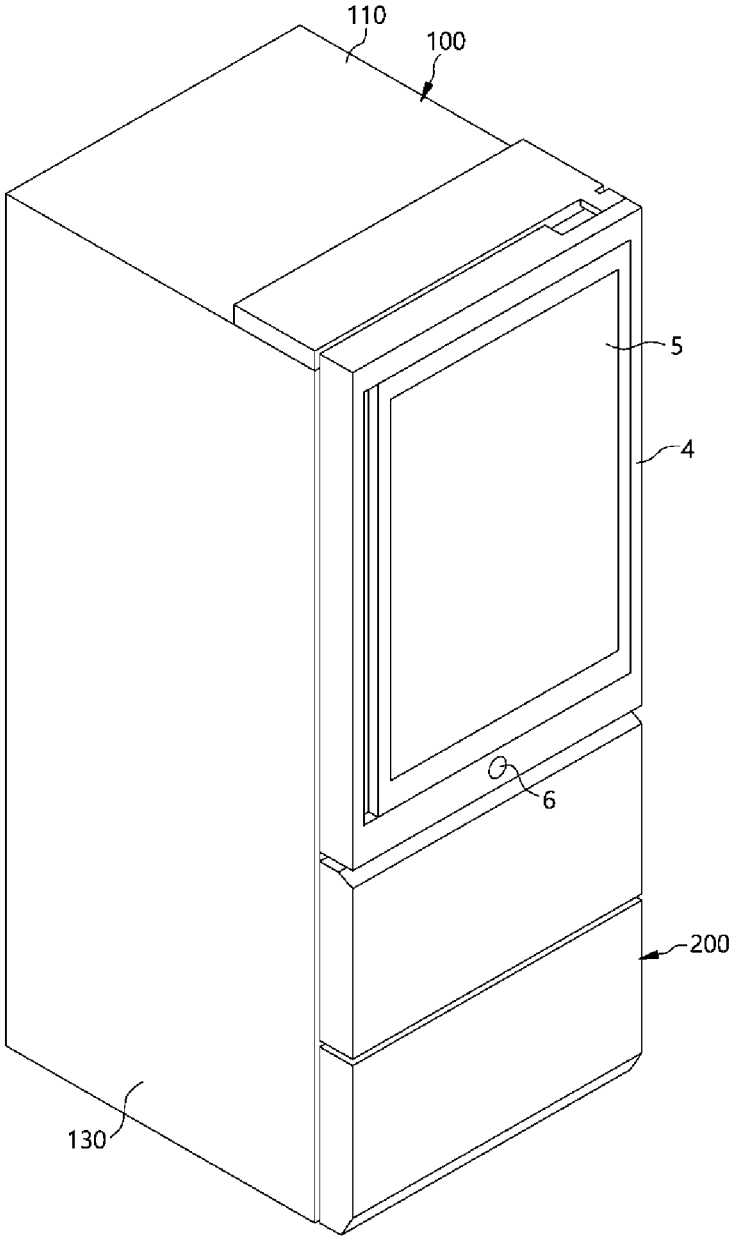
FIG. 1 is a perspective view illustrating a refrigerator having a drawer according to an embodiment of the present disclosure.
Figure 2:
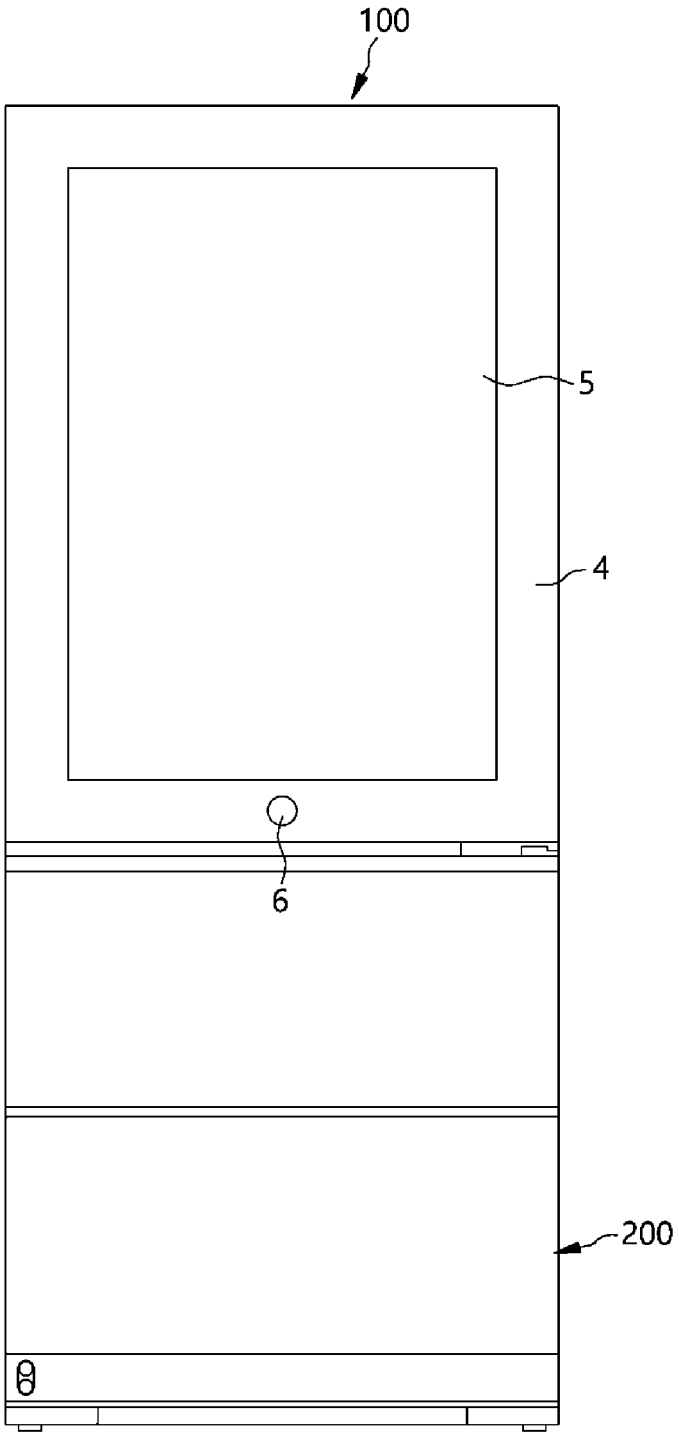
FIG. 2 is a front view illustrating the refrigerator having a drawer according to an embodiment of the present disclosure.
Figure 3:
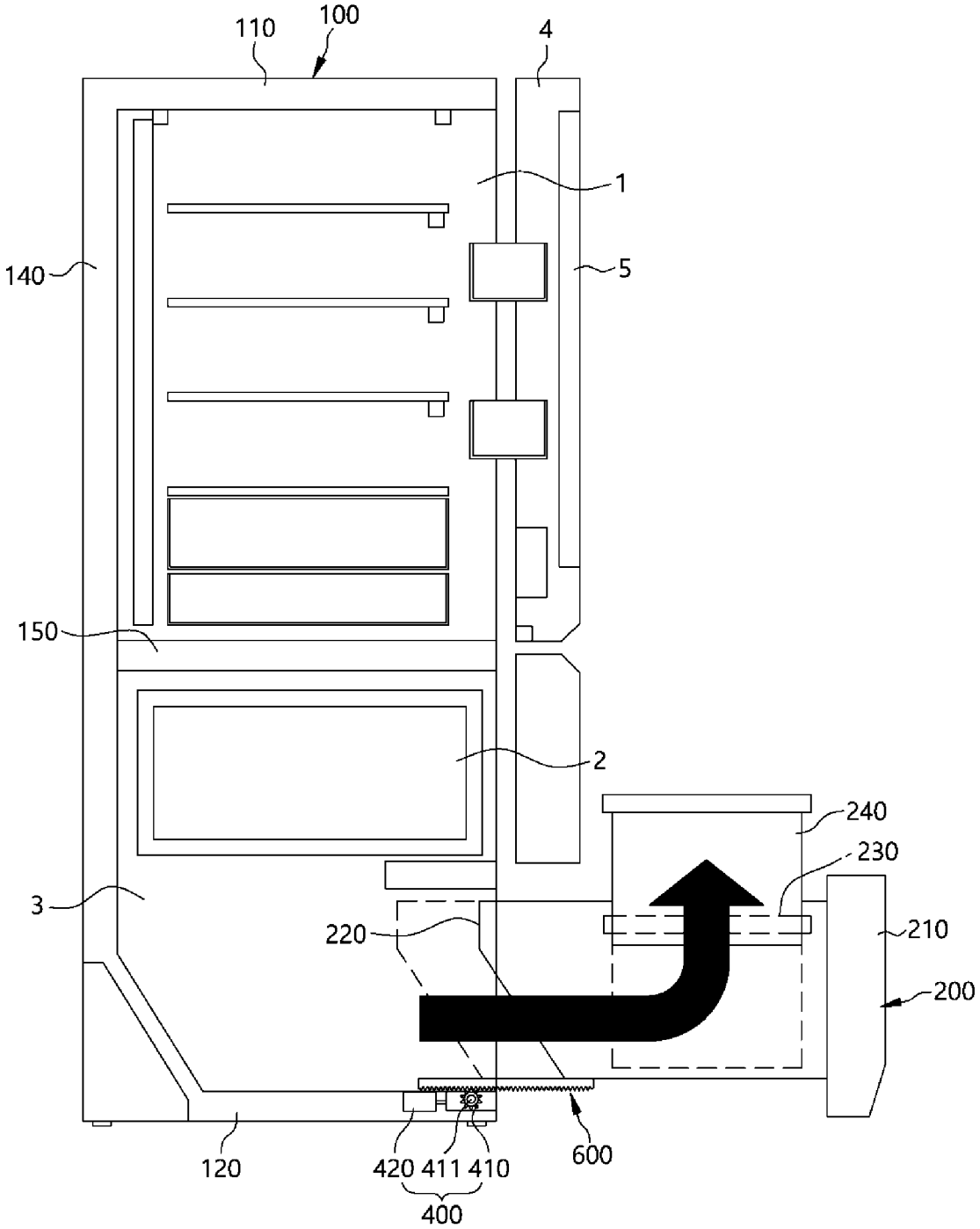
FIG. 3 is a side view illustrating the refrigerator having a drawer according to an embodiment of the present disclosure.

FIG. 1 is a perspective view illustrating the refrigerator having a drawer according to an embodiment of the present disclosure. FIG. 2 is a front view illustrating the refrigerator having a drawer according to an embodiment of the present disclosure. FIG. 3 is a side view illustrating the refrigerator having a drawer according to an embodiment of the present disclosure.

As shown in the drawings, a refrigerator (having a drawer) according to an embodiment of the present disclosure may include a cabinet 100, a drawer 200, a driving part 400 (or driving device), and rack gear assemblies 601 and 602. At least one rack gear assembly of the rack gear assemblies 601 and 602 includes an idle gear 630 (See FIG. 12), in which gear teeth of a pinion 410 constituting the driving part are engaged with and which allows the pinion 410 to run idly.

The cabinet 100 may constitute an outer appearance of the refrigerator.

The cabinet 100 may include a roof 110 constituting an upper wall, a bottom 120 constituting a lower wall, opposite side walls 130 constituting opposite side walls, and a rear wall 140 constituting a rear wall thereof, and the cabinet may be configured as a box body, which is open forward. An inner space of the cabinet 100 may be provided as a storage space of the refrigerator.

A plurality of partition walls 150 may be provided in the cabinet 100. The partition walls 150 may partition the storage space of an inner part of the cabinet 100 into a plurality of spaces. Accordingly, the storage space may include a plurality of storage chambers 1, 2, and 3, which are partitioned vertically.

The partition walls 150 may partition the storage space in the cabinet 100 from left to right.

According to the refrigerator according to an example embodiment, the storage space of the refrigerator may be vertically divided into three chambers, and an upper storage chamber 1 may be a refrigerating compartment, and a center storage chamber 2 and a lower storage chamber 3 may be the refrigerating compartment, a freezer compartment, or as an independent space.

Each storage chamber 1, 2, and 3 of the cabinet 100 is provided to be opened and closed by each door thereof. The upper storage chamber 1 is opened and closed by a swinging door 4, and the center storage chamber 2 and the lower storage chamber 3 are opened and closed by the drawer 200. The center storage chamber 2 may be configured to be opened and closed by the swinging door 4.

The swinging door 4 may be hingedly combined with the cabinet 100 to open or close the upper storage chamber 1.

A display part 5 (or display) may be provided on a front surface of the swinging door 4 to output information. The display part 5 may display various information such as an operation state of the refrigerator or temperature of each storage chamber 1, 2, and 3, and the like.

The display part 5 may include various components such as a liquid crystal display or an LED.

The drawer 200 may have a structure opening or closing by sliding. In the following embodiments, the drawer 200 may be provided in the lower storage chamber 3.

The drawer 200 may include a front panel 210 and a storage bin 220 (or storage room).

The front panel 210 is a part closing an open front of the lower storage chamber 3 and has an installation space therein.

The front panel 210 may have an upper surface, opposite side surfaces, a front surface, and a lower surface by bending a thin metal plate, and may include an inner frame of a resin material provided therein to reduce weight and improve productivity. The front panel 210 may be made of a material which may approximate the feel of metal.

The storage bin 220 is provided at a rear of the front panel 210 and is received in the lower storage chamber 3.

The storage bin 220 may be a box body, which is opened upwardly, and a front surface of the storage bin 220 is provided to be combined with and fixed to a rear surface of the front panel 210 while the front surface of the storage bin 220 is in close contact with the rear surface of the front panel 210. The storage bin 220 may be variously combined with the front panel 210 by hooking, bolting, screwing, engaging or fitting.

Guide rails 230 may be provided on each of opposite outer surfaces of the storage bin 220 and each of opposite wall surfaces of the inner part of the lower storage chamber 3 opposed thereto such that the guide rails 230 are engaged with each other and support stable forward and backward movements of the storage bin 220 (see FIG. 3).

Each of the guide rails 230 may be provided on each of a lower surface of the storage bin 220 and a bottom surface of the inner part of the lower storage chamber 3 opposed thereto such that the guide rails 230 are engaged with each other. The guide rail 230 may be configured to extend in multiple steps.

A container 240 may be provided in the storage bin 220. That is, although various kinds of food may be stored in the storage bin 220, the container 240 may be received into the storage bin 220 such that various kinds of food are stored in the container 240. The container 240 may be, for example, a kimchi container, or a container having an open upper part.

When the storage bin 220 is opened from the lower storage chamber 3, the container 240 may move upward in the storage bin 220.

That is, a sufficient gap is required for a user's finger to enter a gap between the storage bin 220 and the container 240 such that the user can lift the container 240 received in the storage bin 220. Accordingly, a size of the container 240 is bound to decrease by the gap. Accordingly, to maximize the size of the container 240, the container 240 may be allowed to be automatically removed from the storage bin 220. When the container 240 is automatically removed from the storage bin 220, withdrawal of the container 240 by the user is not required.

The storage bin 220 may include a lift module 300 (see FIGS. 4 and 5) for automatically raising and lowering the container 240.

The lift module 300 may be implemented in various forms. For example, the lift module 300 may be configured to have a scissor-type link structure, wherein when the lift module 300 is folded, height thereof is minimized and when the lift module 300 is spread (or unfolded), the height thereof is maximized.

Electric components 310 (for example, a driving motor), which provide a driving force for lifting and lowering the lift module 300, may be provided in the installation space inside the front panel 210.

When the lift module 300 operates before the storage bin 220 of the drawer 200 is completely opened, the container 240 or the cabinet 100 may be damaged. Accordingly, a control program may be programmed to control operation of the lift module 300 so as operate only when the storage bin 220 is completely opened.

Figure 4:
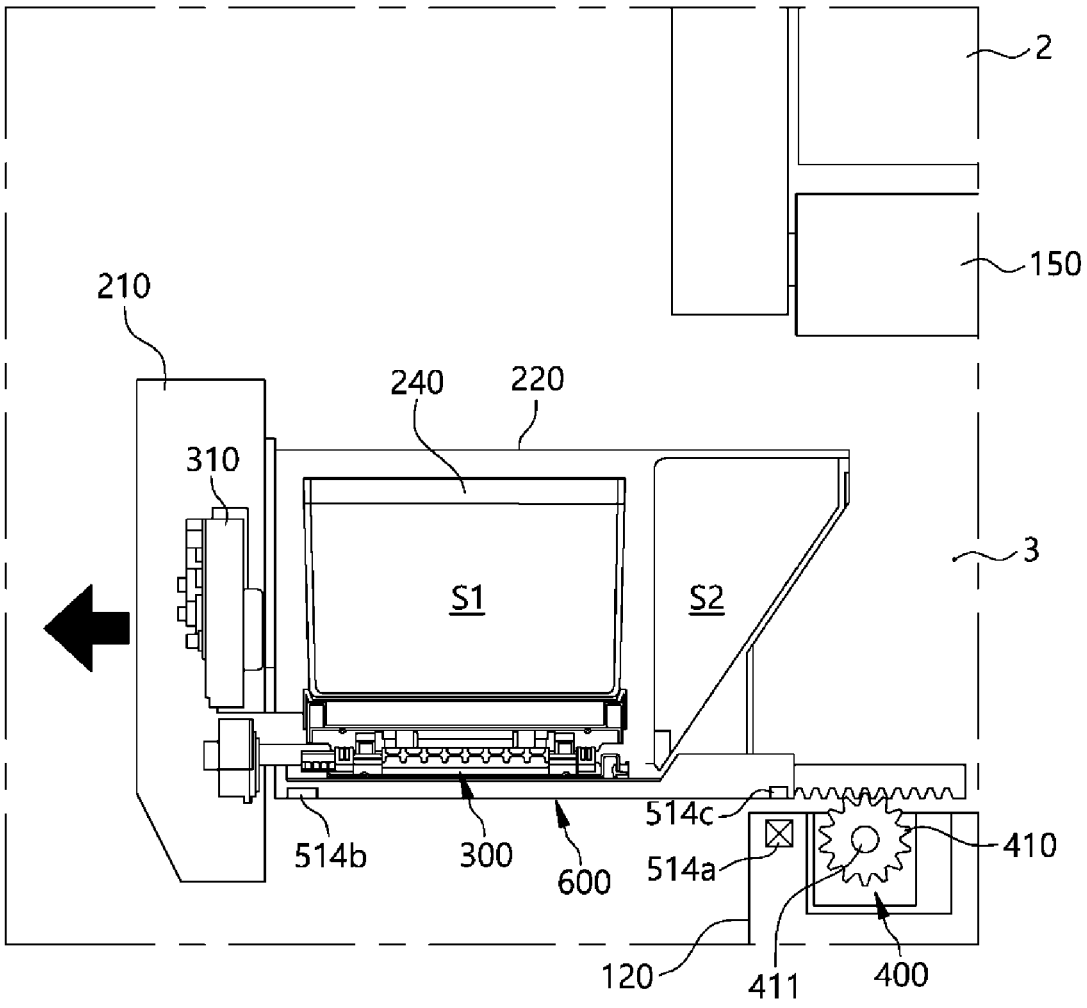
FIG. 4 is a state view of a part roughly illustrating an opened state of the drawer of the refrigerator according to an embodiment of the present disclosure.
Figure 5:
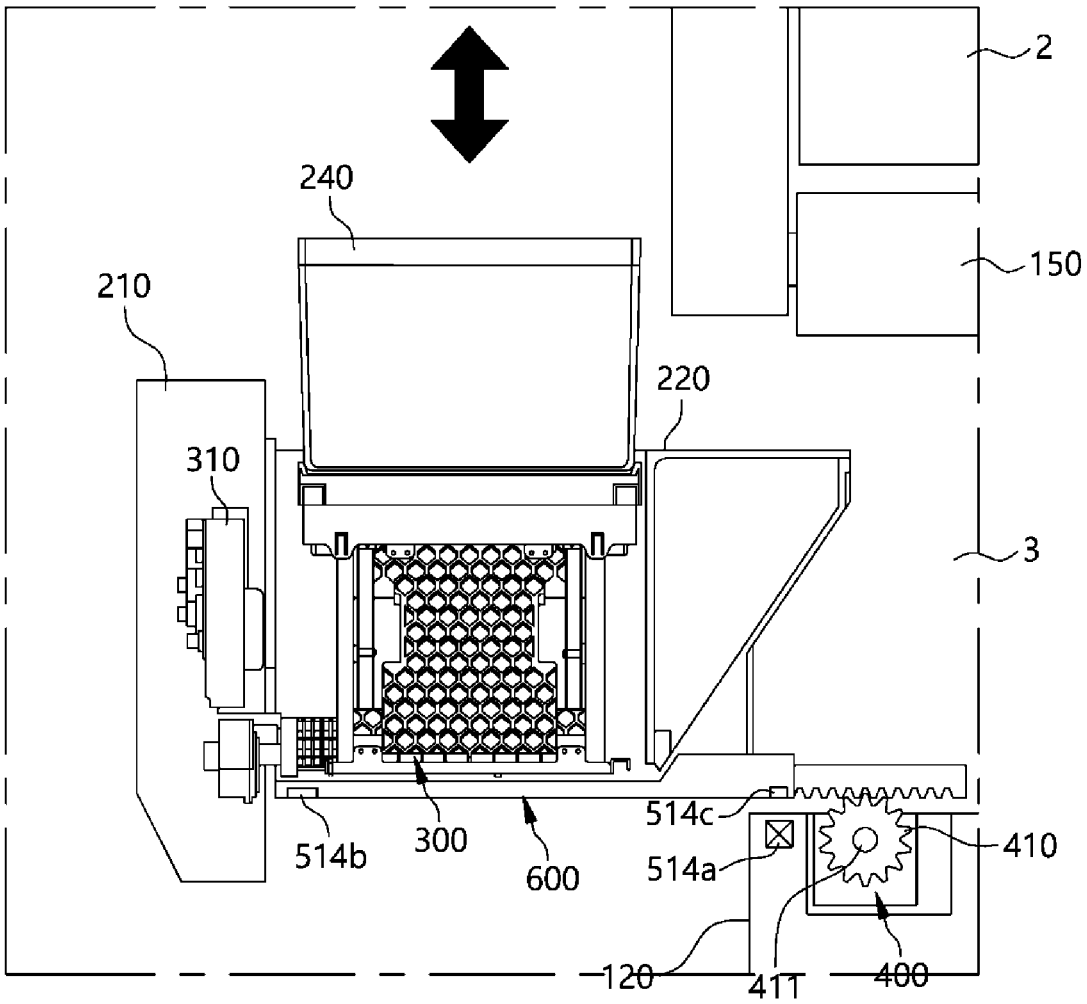
FIG. 5 is a state view of a part roughly illustrating a state of a container moving upward in the opened state of the drawer of the refrigerator according to an embodiment of the present disclosure.

The driving part 400 according to the embodiment of the present disclosure may be described (see FIGS. 3 to 5).

The driving part 400 may provide the driving force to allow the drawer 200 to automatically move forward and backward.

The driving part 400 is provided at the bottom 120 of the cabinet 100 and may include the pinion 410 and the driving motor 420.

A portion of the pinion 410 may be exposed to the inner part of the lower storage chamber 3 by being upward formed through a bottom surface (an upper surface of the bottom) of the lower storage chamber 3 (see FIG. 9), and the driving motor 420 is fixed to the bottom 120 of the cabinet 100 so as to transmit power to the pinion 410.

In an embodiment of the present disclosure, the pinion 410 may be positioned on each of opposite sides of the bottom surface of the inner part of the lower storage chamber 3. Each of the opposite pinions may be configured to be connected to a power transmission shaft 411. The driving motor 420 may be connected to the power transmission shaft 411 by a belt, a chain, or a gear to transmit power thereto.

Each of the opposite pinions 410 may be simultaneously rotated at the same speed and in the same direction by driving of the driving motor 420.

A reduction gear may be provided at a connection portion of the power transmission shaft 411 with the driving motor 420.

Each of the opposite pinions 410 may be preferably positioned at a front side of a bottom surface of the lower storage chamber 3. This may allow the drawer 200 to be maximally opened.

The driving motor 420 may operate by detecting proximity of a user or by manipulation of a button 6 by the user.

The button 6 may be a touch-type button provided on the display part 5 of the swinging door 4. The button 6 may be a press button provided at a position separate from the display part 5.

Figure 6:
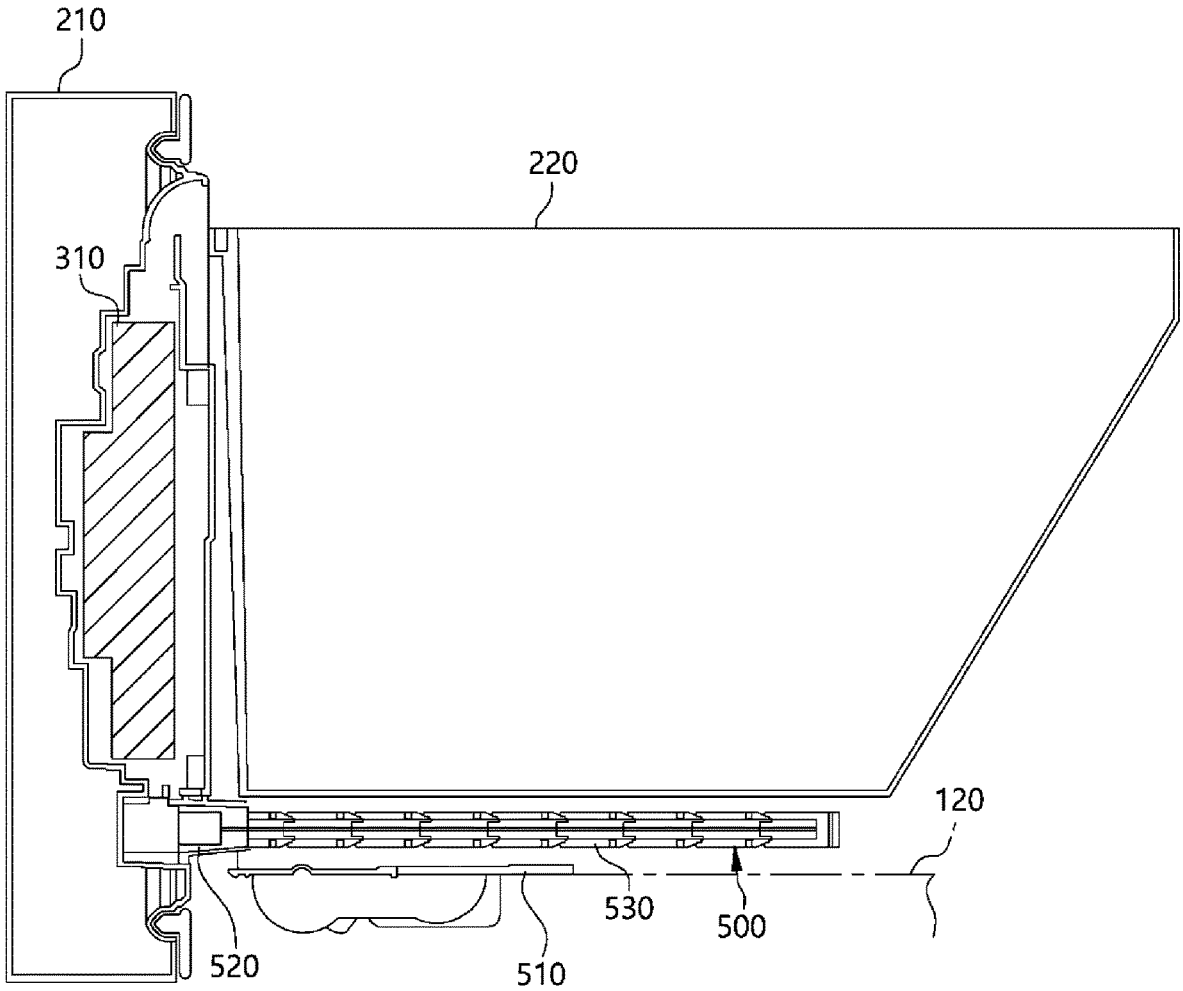
FIG. 6 is a side view illustrating a state of a cable guide module connected to the drawer of the refrigerator according to an embodiment of the present disclosure.

A cable guide module 500 may be connected to the bottom surface (the upper surface of the bottom) of the inner part of the lower storage chamber 3 and the front panel 210 (see FIG. 6).

The cable guide module 500 may be configured to protect power lines or cables (hereinafter referred to as cable) connected to electrical components in the front panel 210 among various kinds of power lines or cables connected along an inner part of the bottom 120.

The cable guide module 500 may be configured to prevent the cable from being damaged by being twisted or scratched during forward or backward movement of the drawer 200.

The cable guide module 500 may include a cover plate 510, a guiding head 520, multiple connecting members 530, a swinging connection member 540 (or swinging connection base) and a mounting plate 550. This may be shown in FIGS. 7 to 10.

The cable guide module 500 may be described in greater detail by each configuration thereof hereinbelow.

The cover plate 510 (of the cable guide module 500) may be combined with the upper surface of the bottom 120.

A front portion of the upper surface of the bottom 120 may be configured to be open, and the cover plate 510 is combined with the bottom 120 so as to cover the open portion of the bottom 120.

Figure 7:
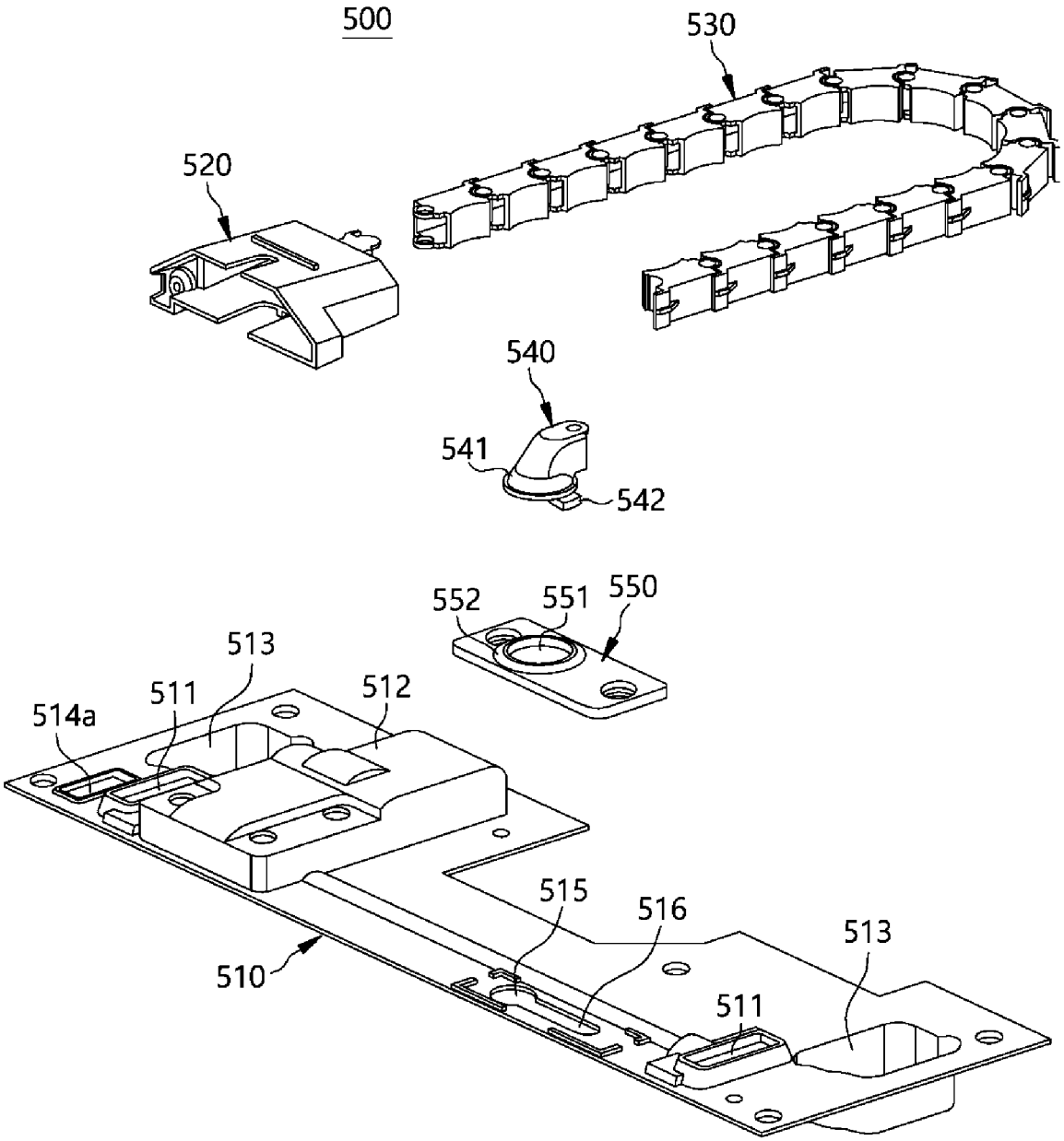
FIG. 7 is an exploded perspective view illustrating the cable guide module of the refrigerator having a drawer according to an embodiment of the present disclosure.
Figure 8:
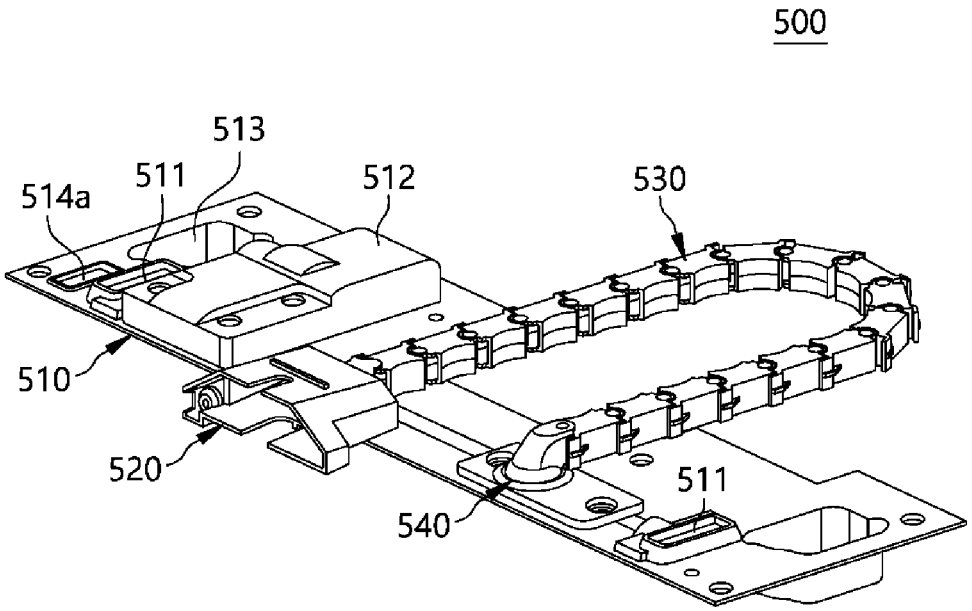
FIG. 8 is an assembled perspective view illustrating the cable guide module of the refrigerator having a drawer according to an embodiment of the present disclosure.
Figure 9:
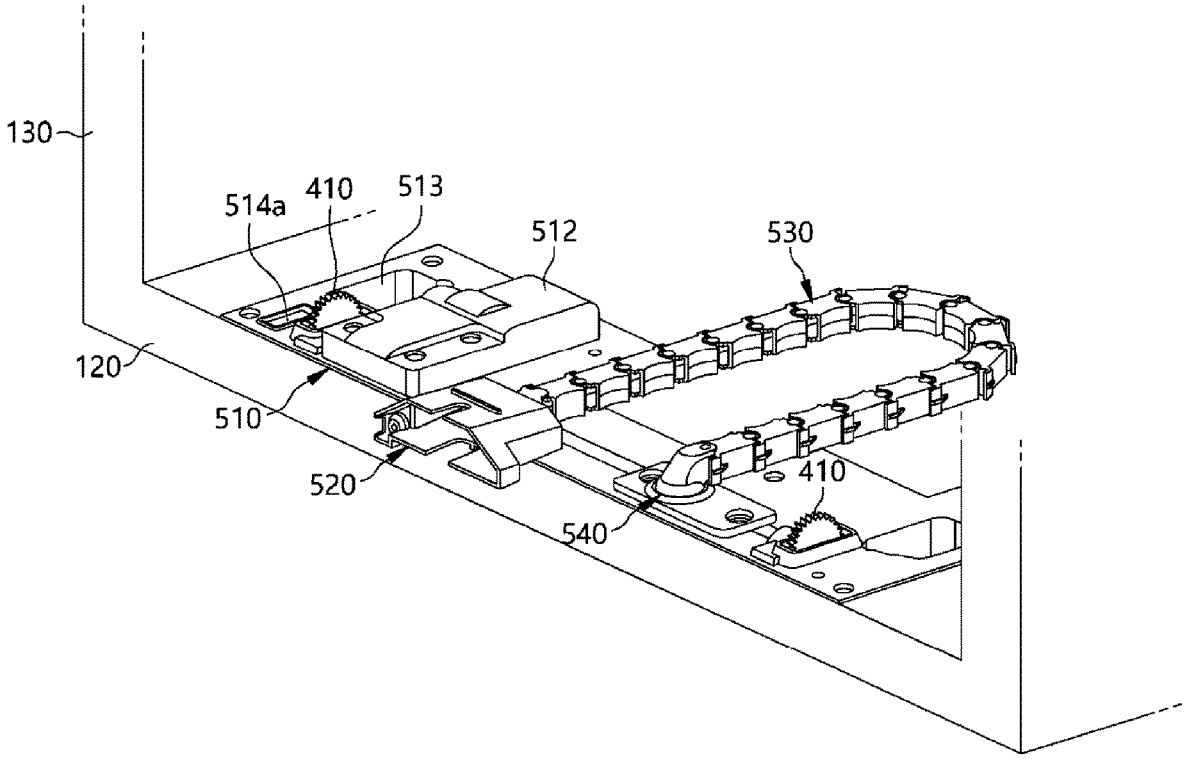
FIG. 9 is a perspective view illustrating a state in which the cable guide module of the refrigerator having a drawer according to an embodiment of the present disclosure is installed in a storage chamber of the refrigerator.
Figure 10:
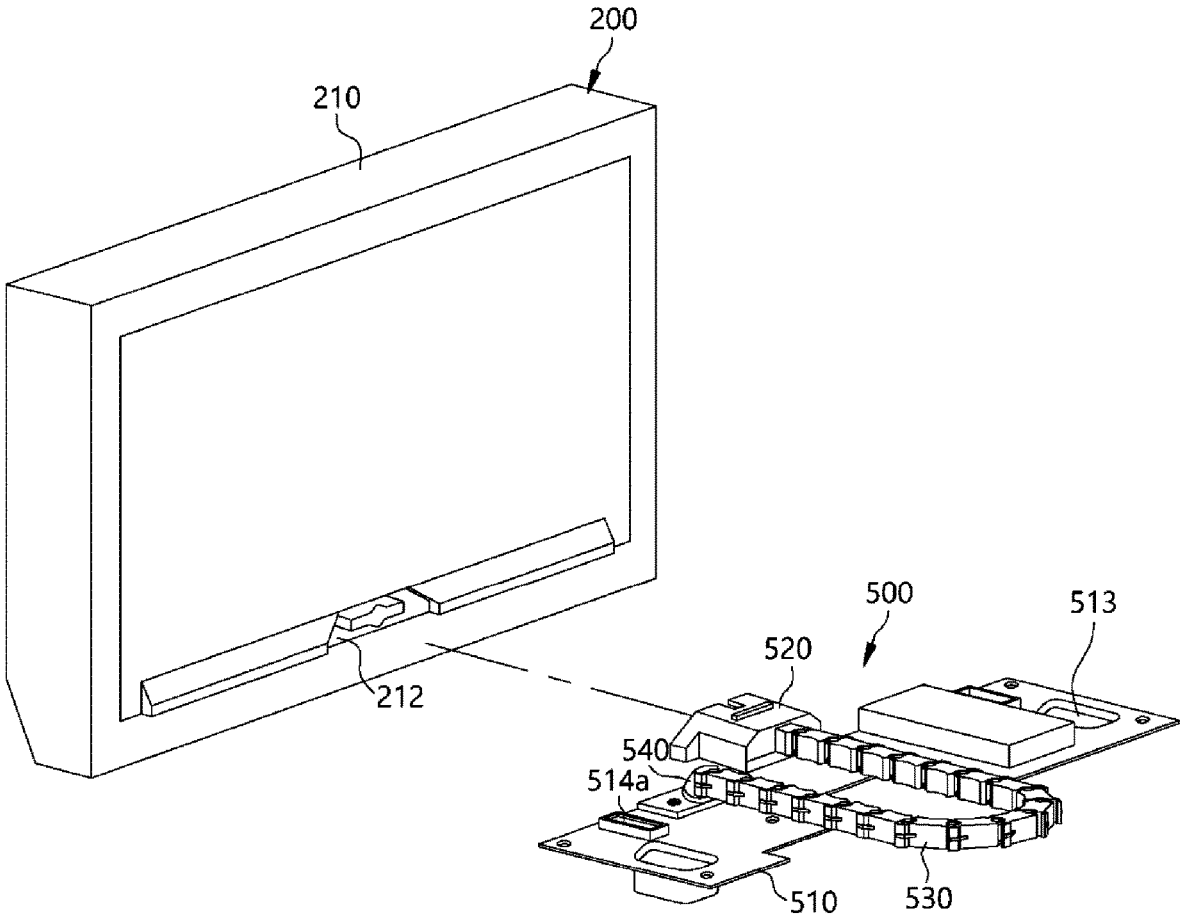
FIG. 10 is a perspective view, from a rear side of the drawer, illustrating a state in which the cable guide module of the refrigerator having a drawer according to an embodiment of the present disclosure is connected to the drawer.
Figure 11:
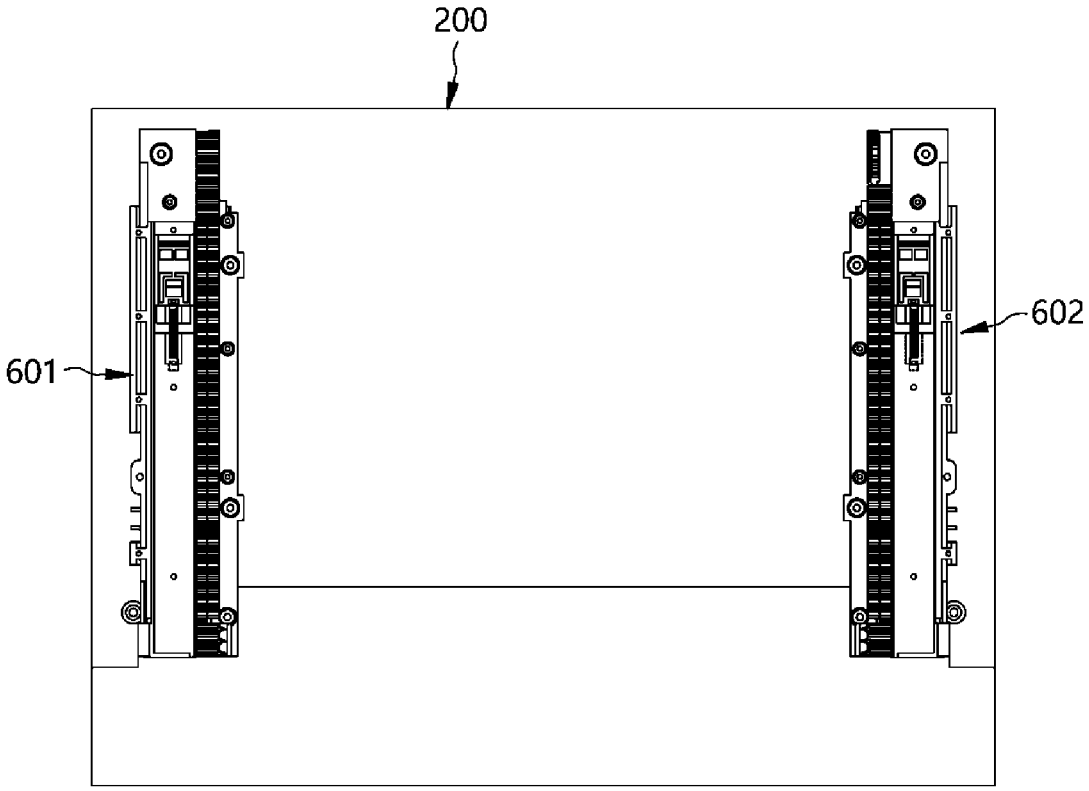
FIG. 11 is a bottom view illustrating installation states of rack gear assemblies of the refrigerator having a drawer according to an embodiment of the present disclosure.
Figure 12:
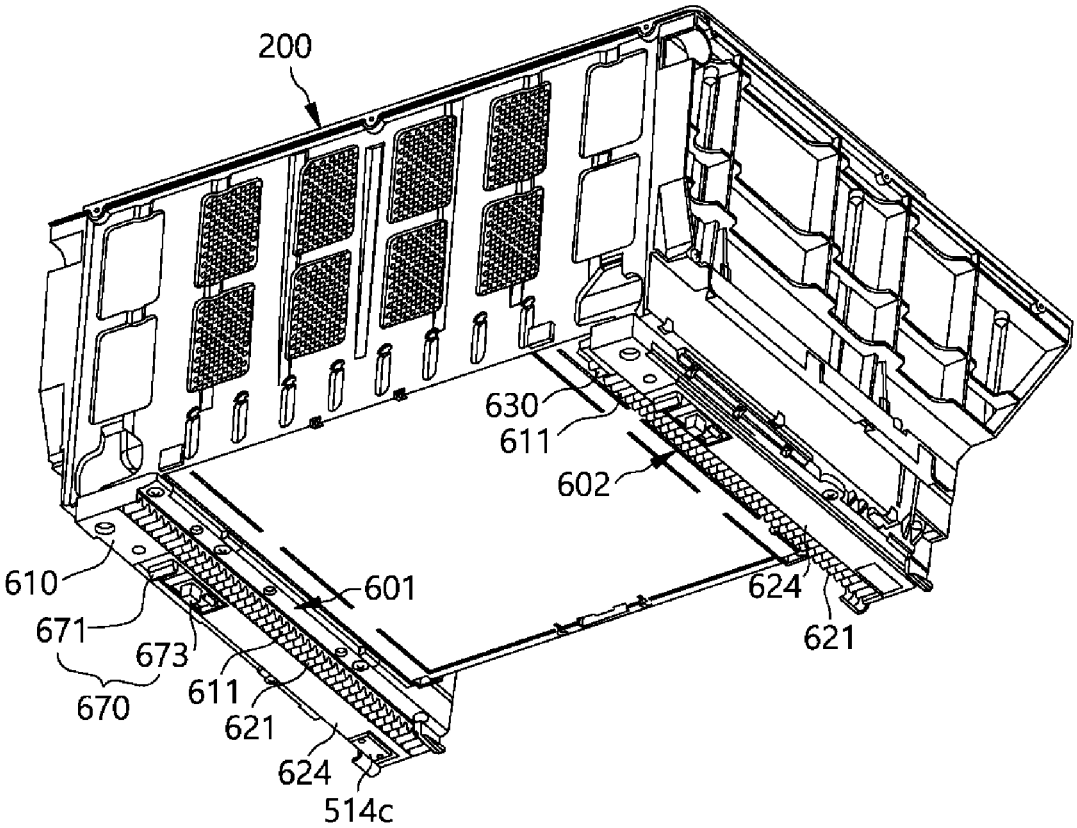
FIG. 12 is a perspective view illustrating the installation state of each of the rack gear assemblies of the refrigerator having a drawer according to an embodiment of the present disclosure from a lower portion thereof.
Figure 13:
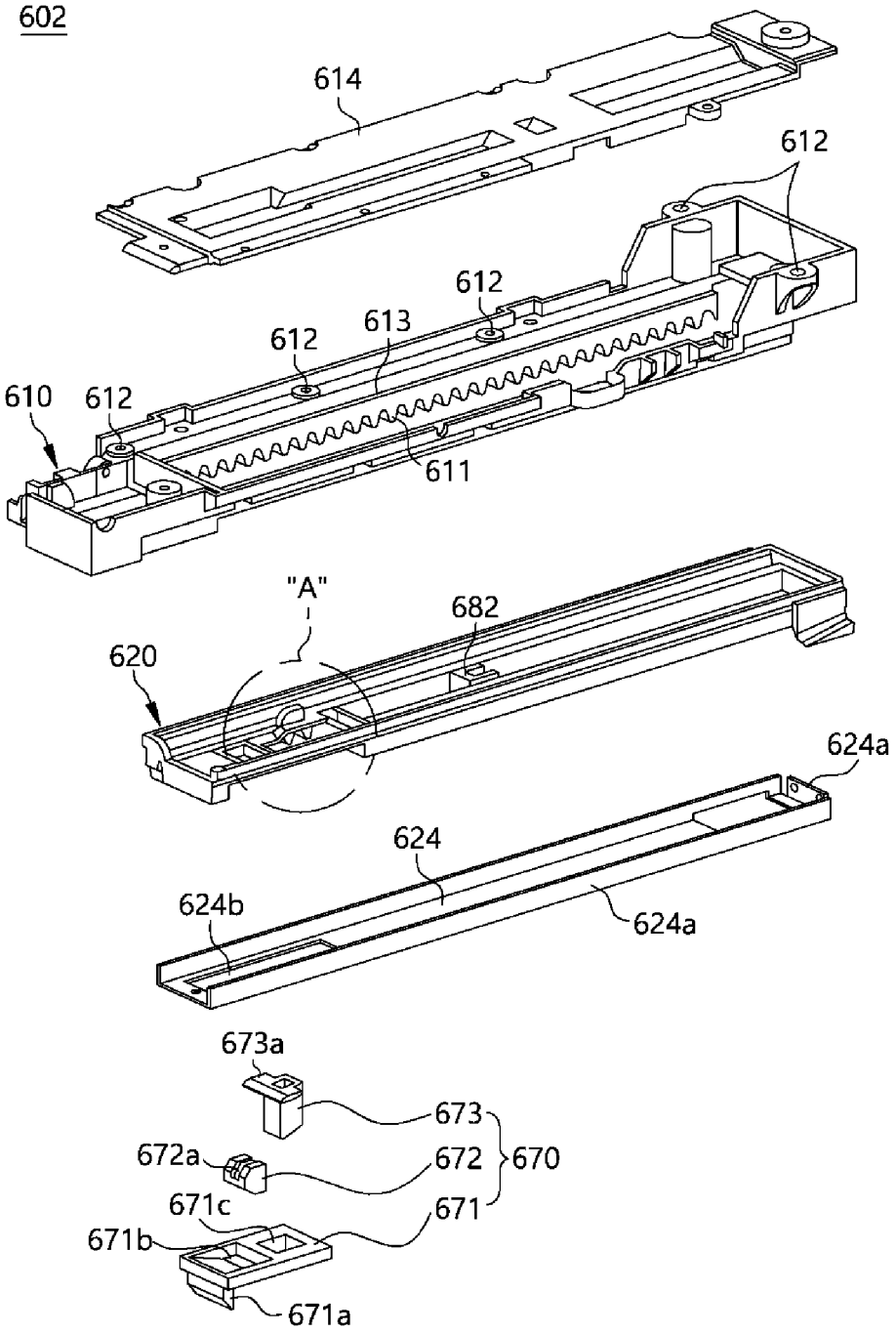
FIG. 13 is an exploded perspective view illustrating a state of a rack gear assembly of the refrigerator having a drawer according to an embodiment of the present disclosure from an upper portion thereof.
Figure 14:
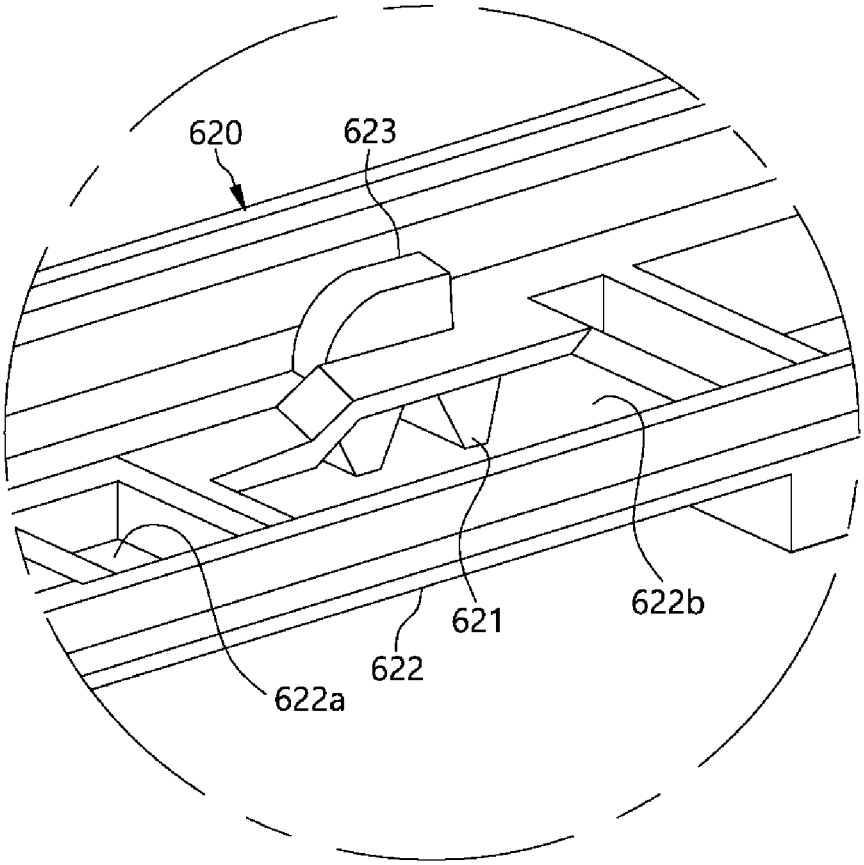
FIG. 14 is an enlarged view of an "A" portion of FIG. 13.
Figure 15:
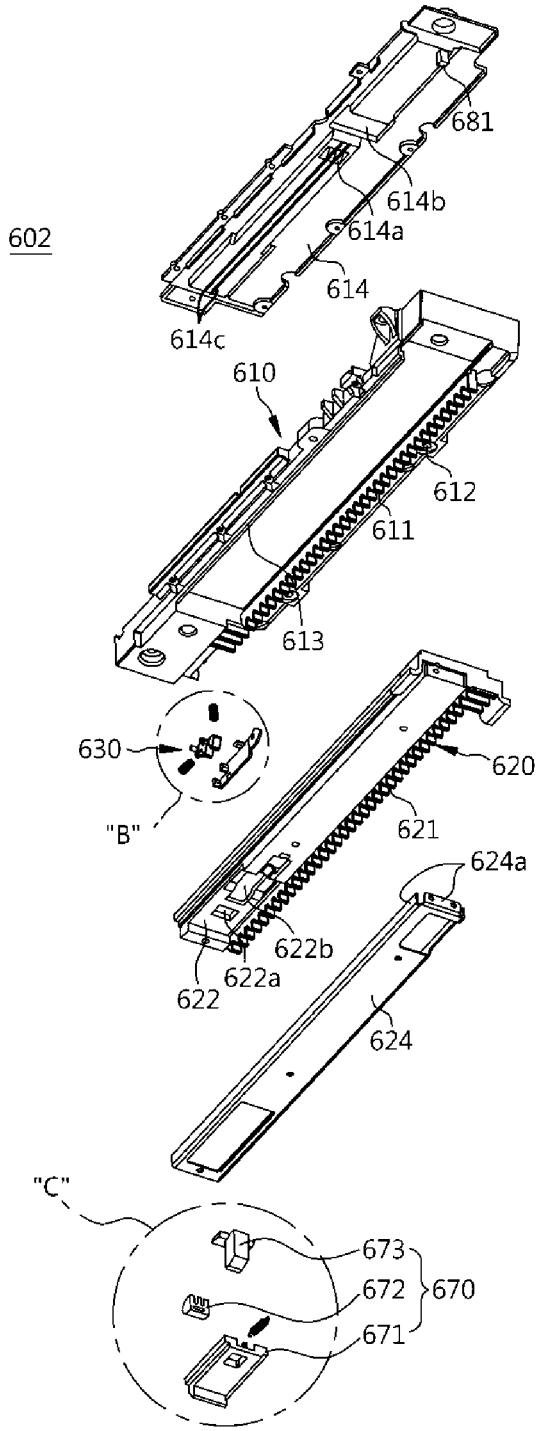
FIG. 15 is an exploded perspective view illustrating a state of the rack gear assembly of the refrigerator having a drawer according to an embodiment of the present disclosure from the lower portion thereof.
Figure 16:
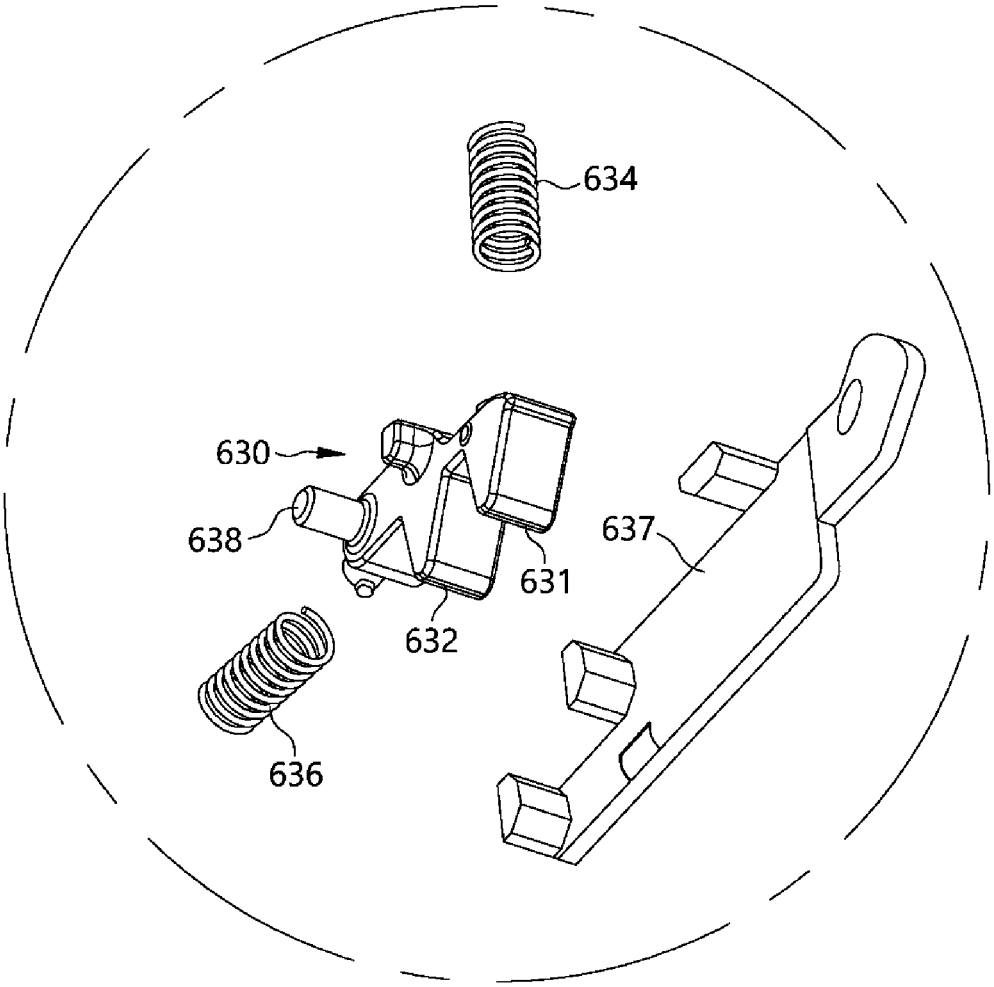
FIG. 16 is an enlarged view of a "B" portion of FIG. 15 illustrating an idle gear of the refrigerator having a drawer according to the embodiment of the present disclosure.
Figure 17:
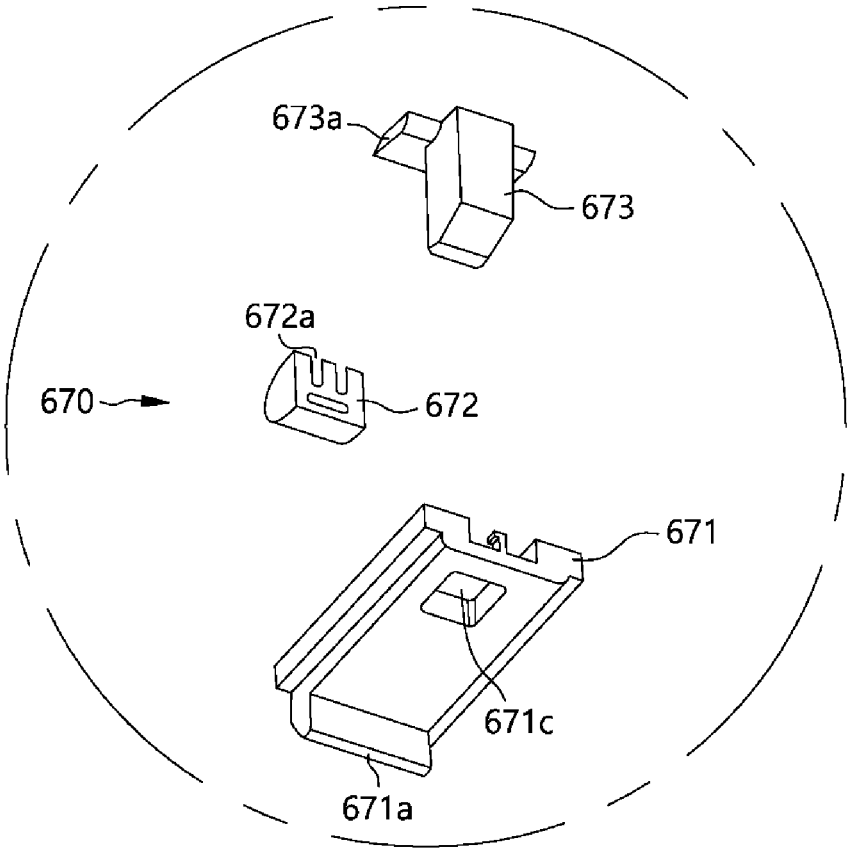
FIG. 17 is an enlarged view of a "C" portion of FIG. 15 illustrating a confining module of the refrigerator having a drawer according to an embodiment of the present disclosure.
Figure 18:
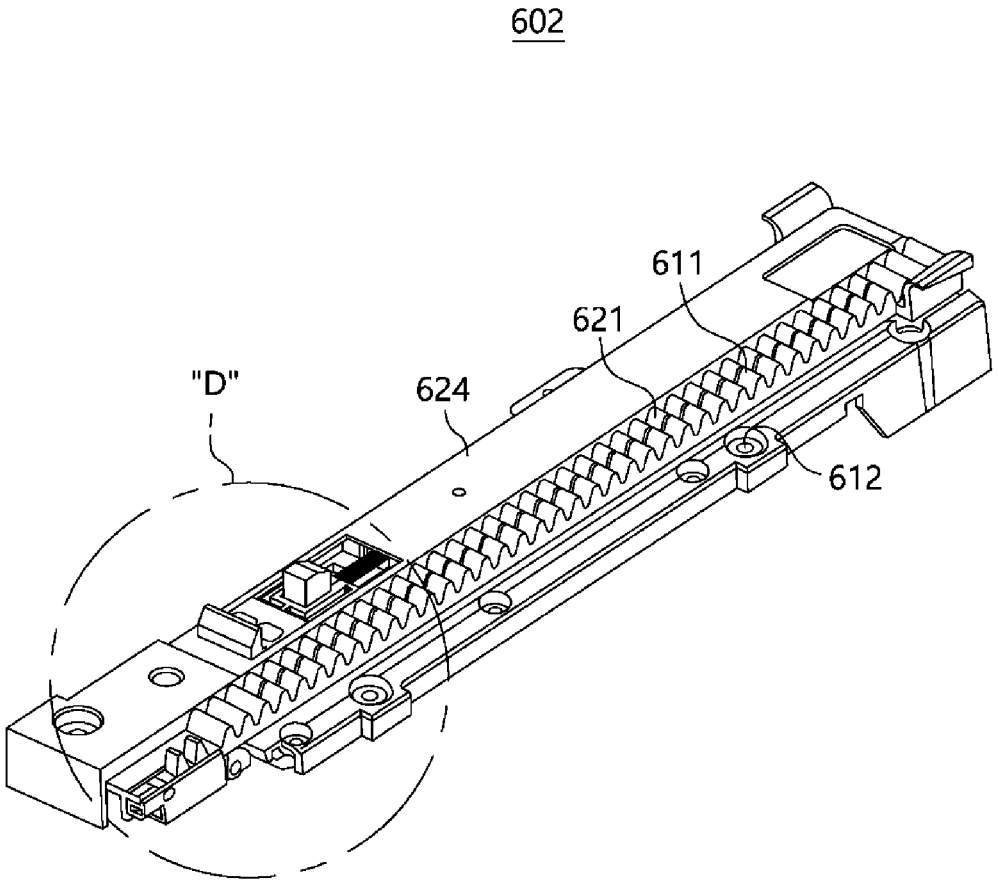
FIG. 18 is a perspective view illustrating an upside-down state of a lower surface structure of the rack gear assembly of the refrigerator having a drawer according to an embodiment of the present disclosure.
Figure 19:
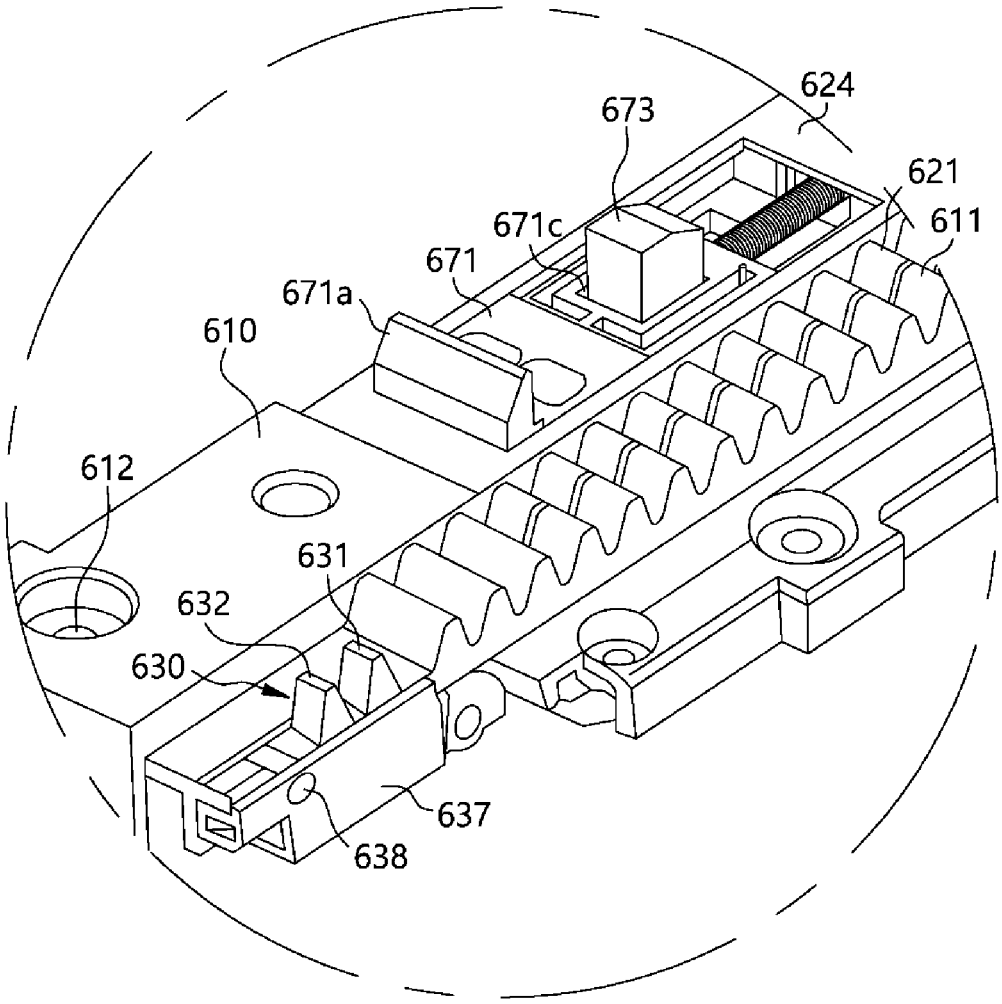
FIG. 19 is an enlarged view of a "D" portion of FIG. 18.
Figure 20:
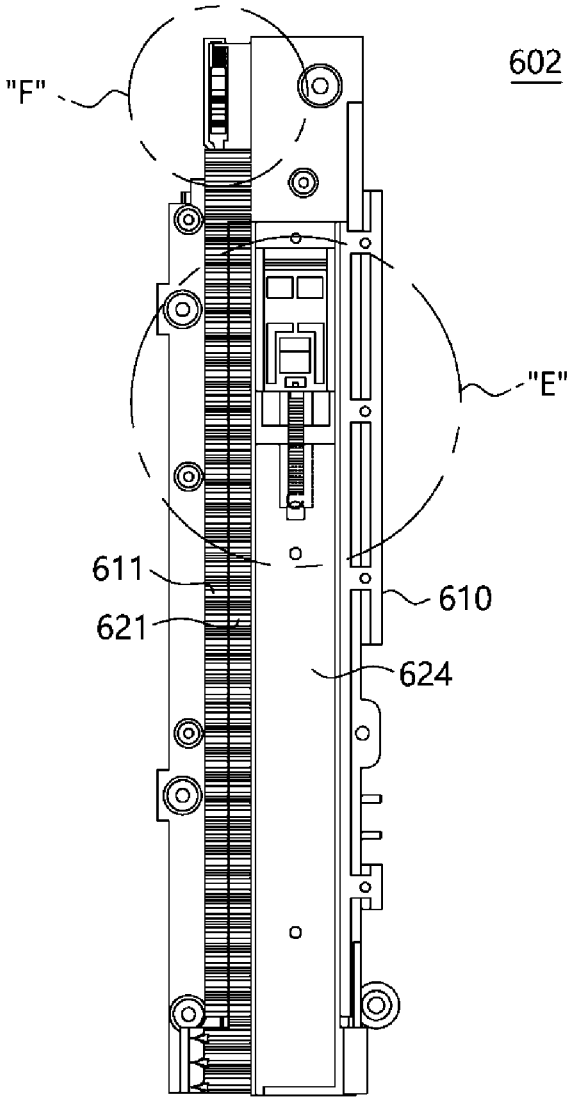
FIG. 20 is a bottom view illustrating the lower surface structure of the rack gear assembly of the refrigerator having a drawer according to an embodiment of the present disclosure.
Figure 21:
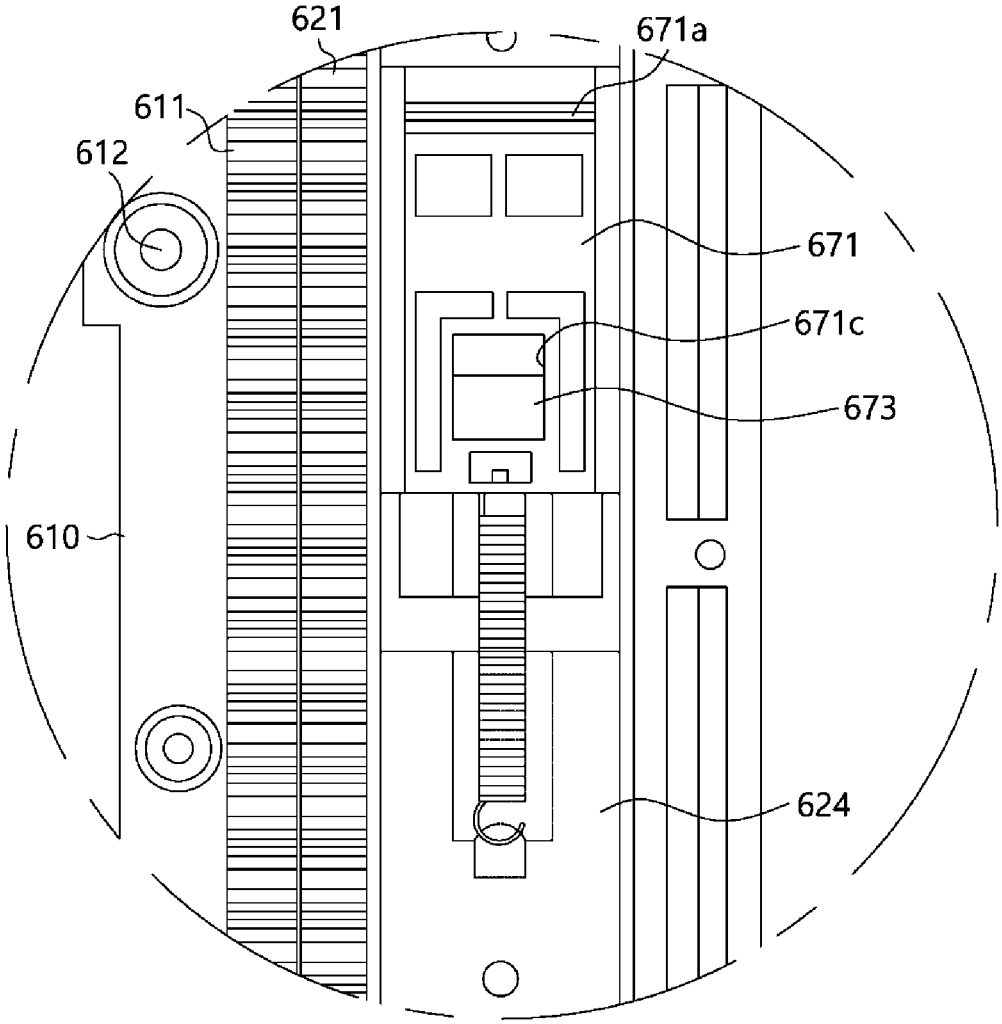
FIG. 21 is an enlarged view of an "E" portion of FIG. 20.
Figure 22:
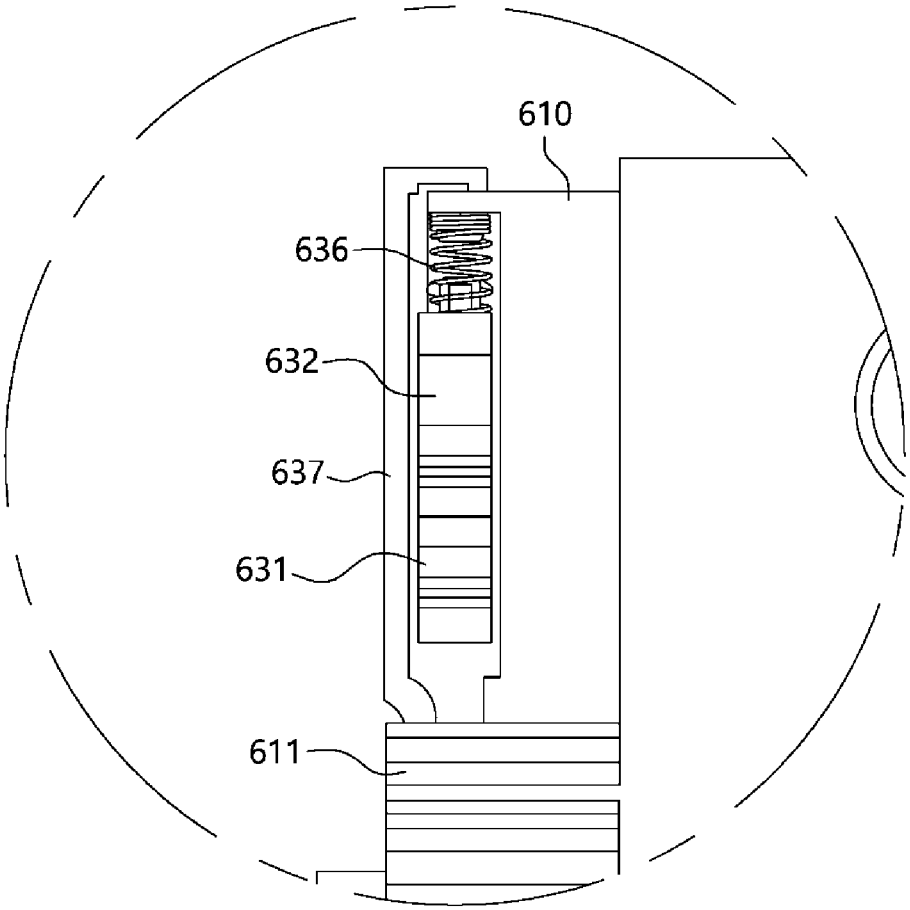
FIG. 22 is an enlarged view of an "F" portion of FIG. 20.
Figure 23:
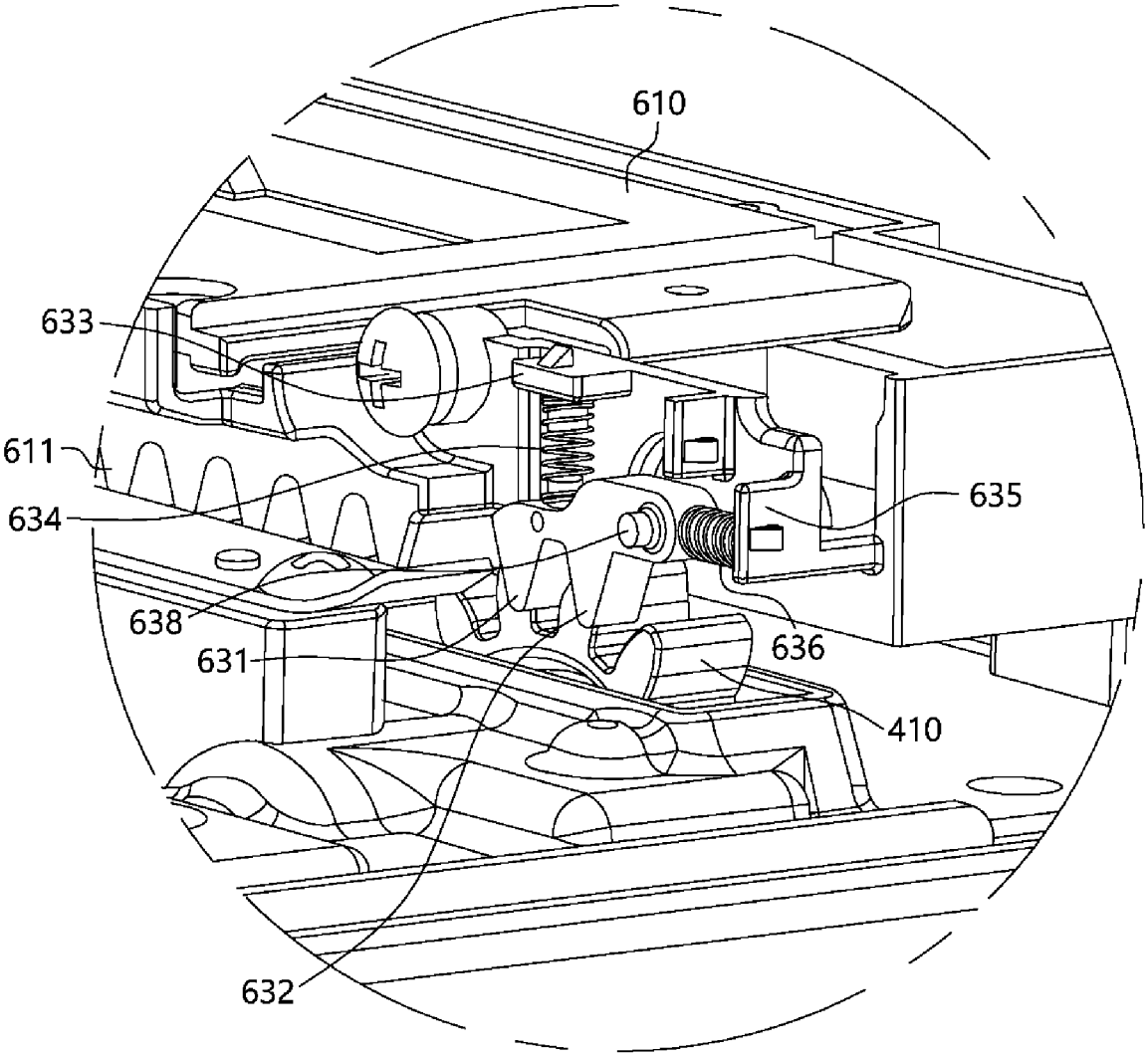
FIG. 23 is a perspective view of a part illustrating an installation state of the idle gear of the refrigerator having a drawer according to an embodiment of the present disclosure.
Figure 24:
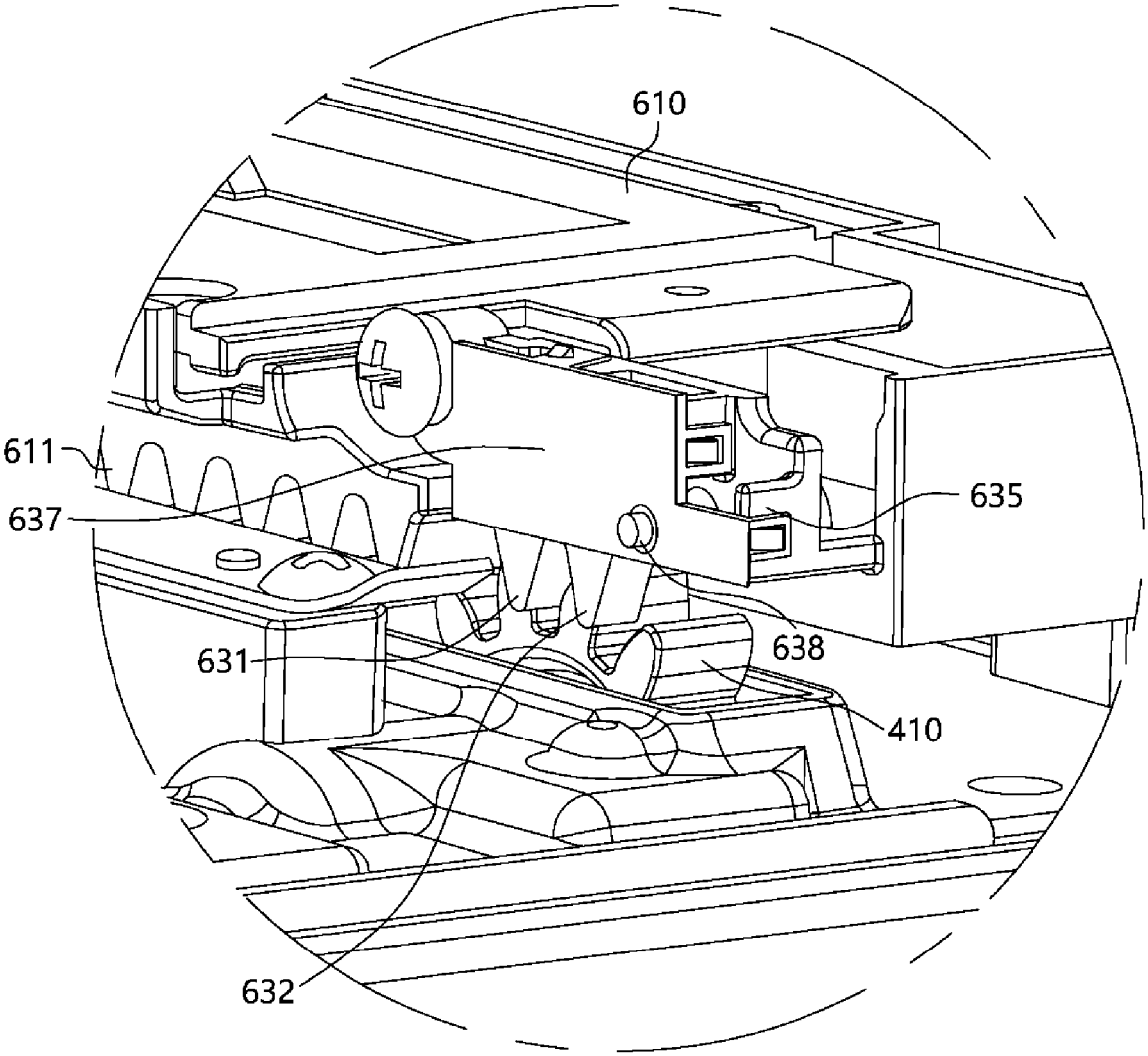
FIG. 24 is a perspective view of a part illustrating a state in which a cover body is combined with the idle gear of FIG. 23.
Figure 25:
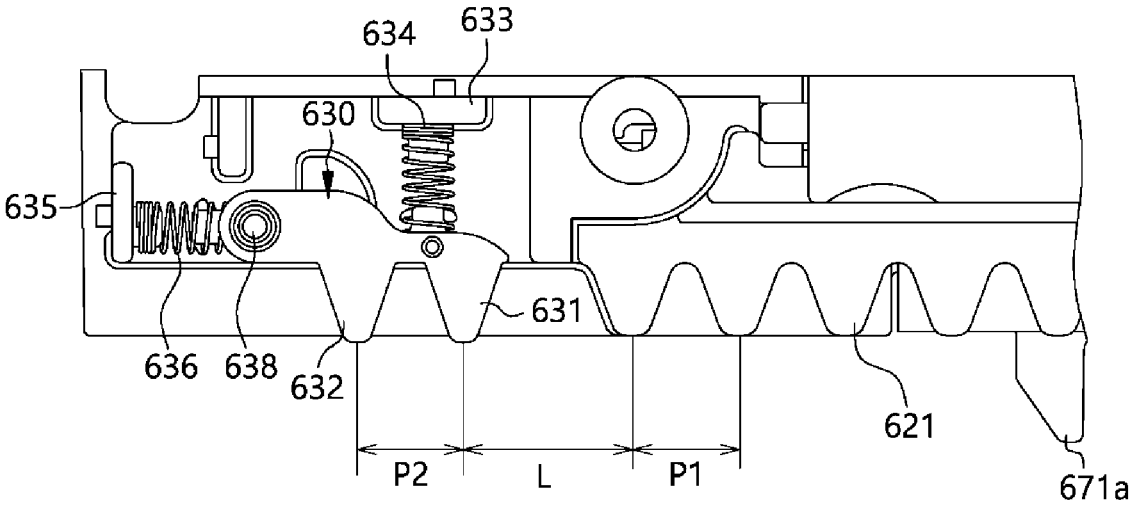
FIG. 25 is a side view of a part illustrating the installation state of the idle gear of the refrigerator having a drawer according to an embodiment of the present disclosure.
Figure 26:
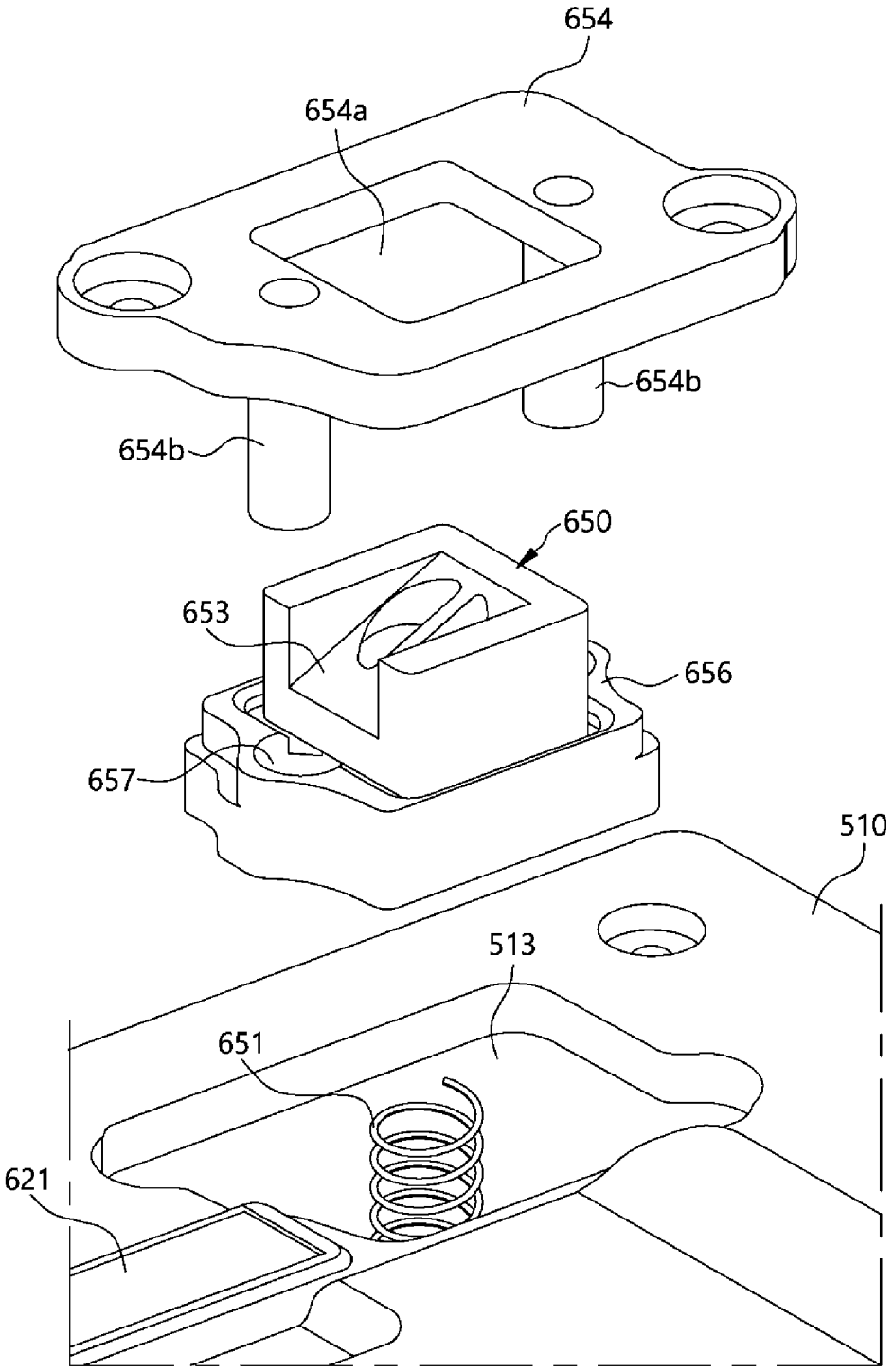
FIG. 26 is an exploded perspective view illustrating a confining protrusion part of the refrigerator having a drawer according to an embodiment of the present disclosure.
Figure 27:
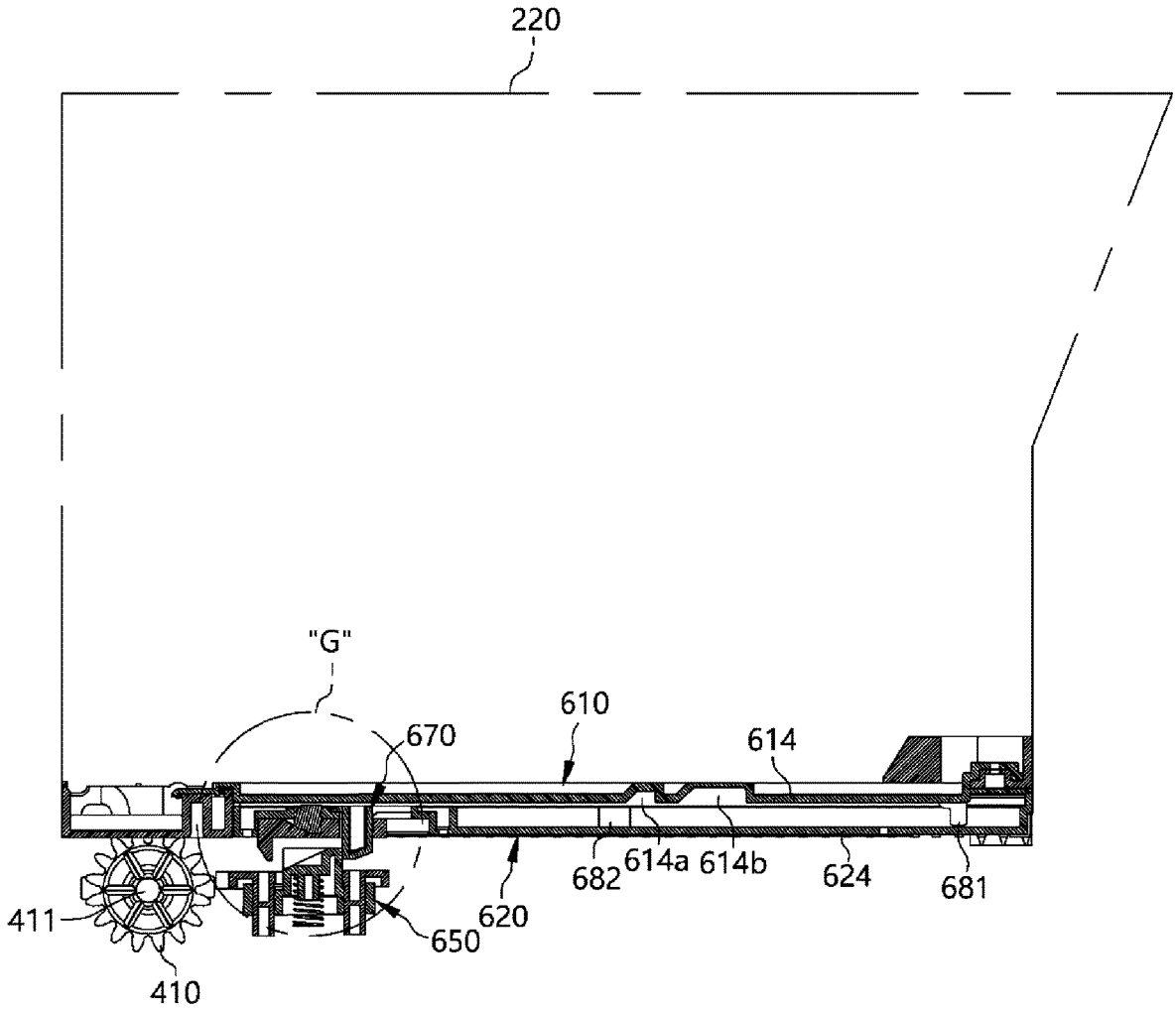
FIGS. 27, 29, 31, and 33 are operation state views illustrating operation states of the rack gear assembly in a process of opening a storage bin defined in the drawer of the refrigerator according to an embodiment of the present disclosure.
Figure 28:
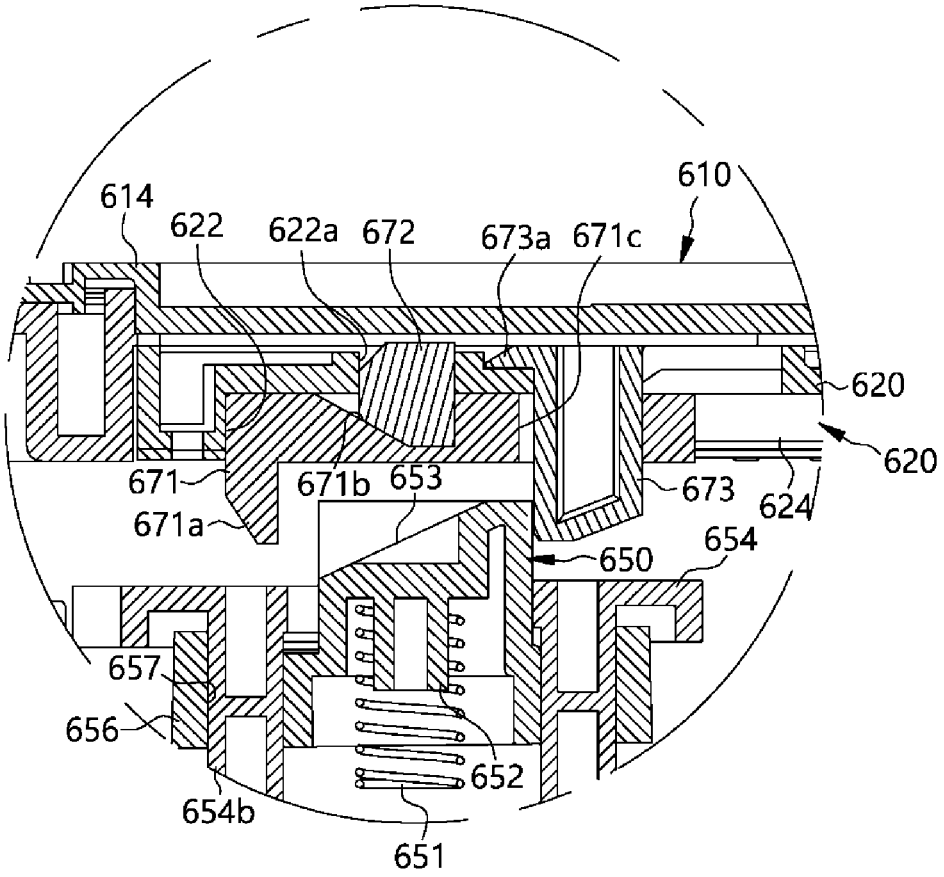
FIG. 28 is an enlarged view of a "G" portion of FIG. 27.
Figure 29:
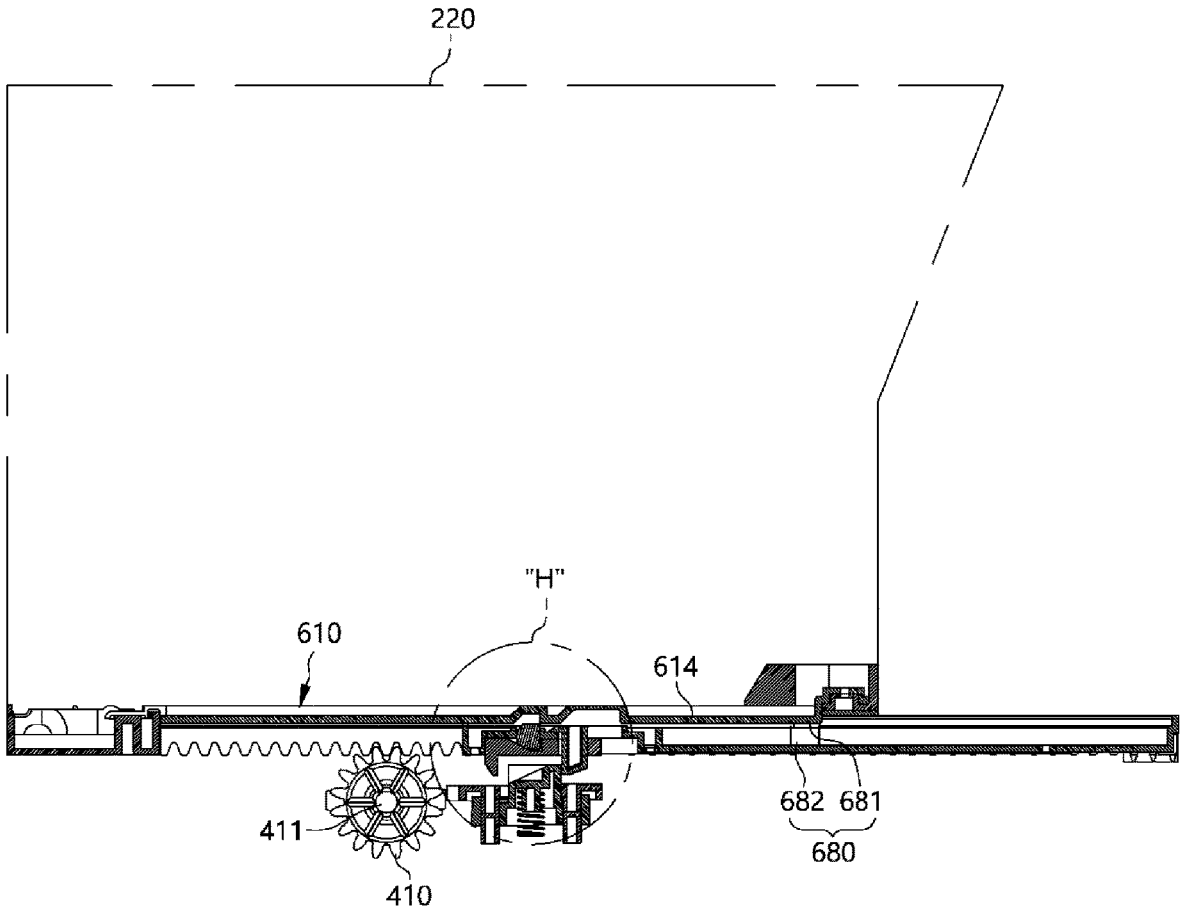
Figure 30:
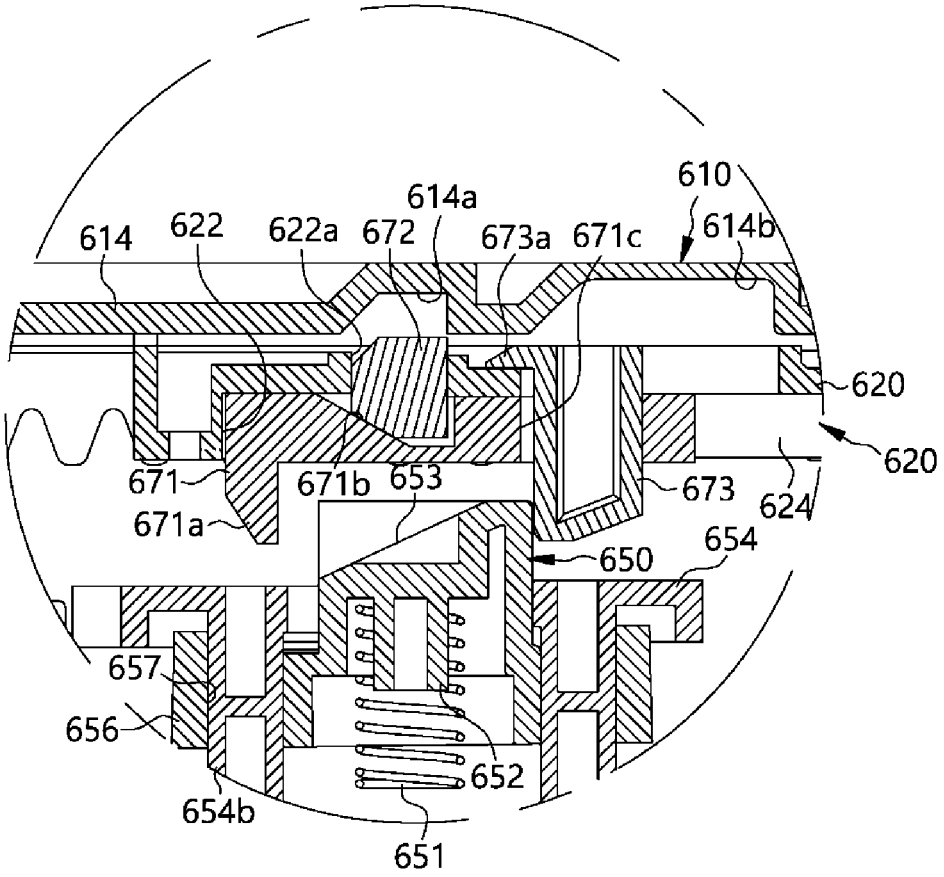
FIG. 30 is an enlarged view of an "H" portion of FIG. 27.
Figure 31:
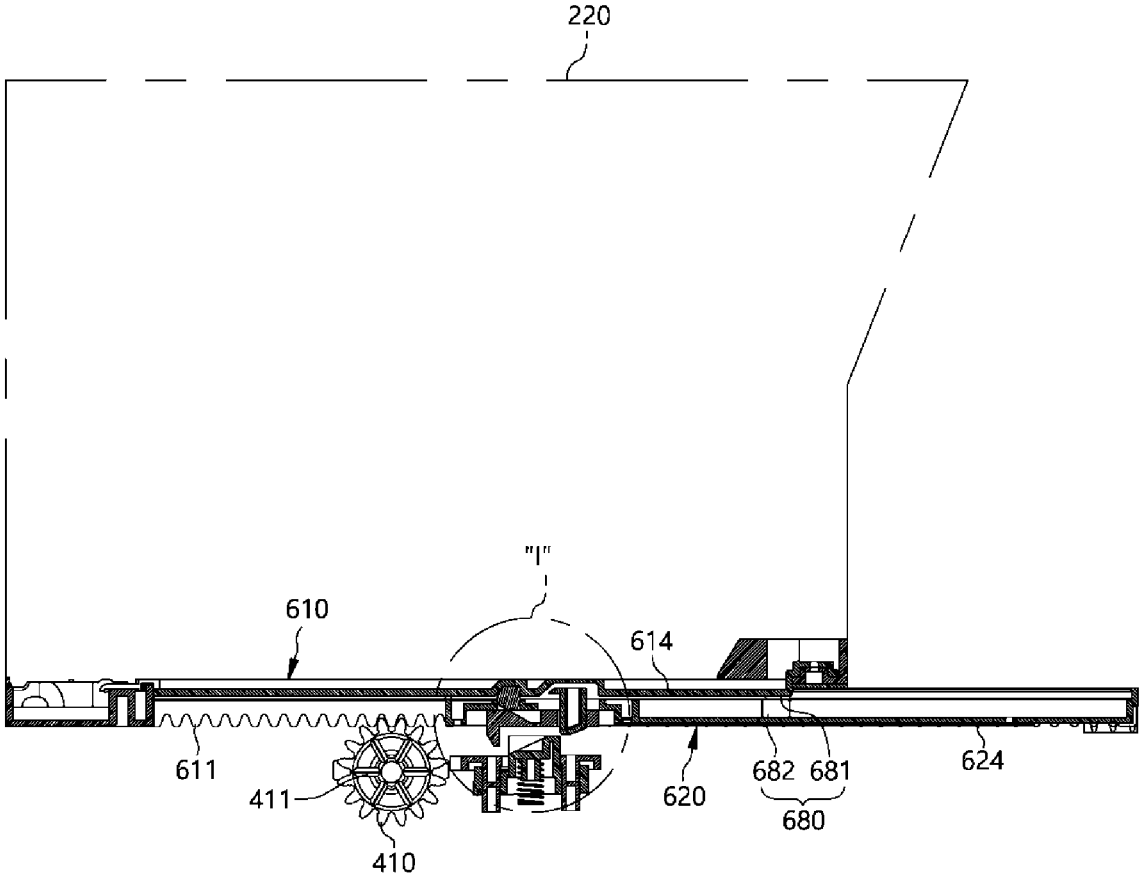
Figure 32:
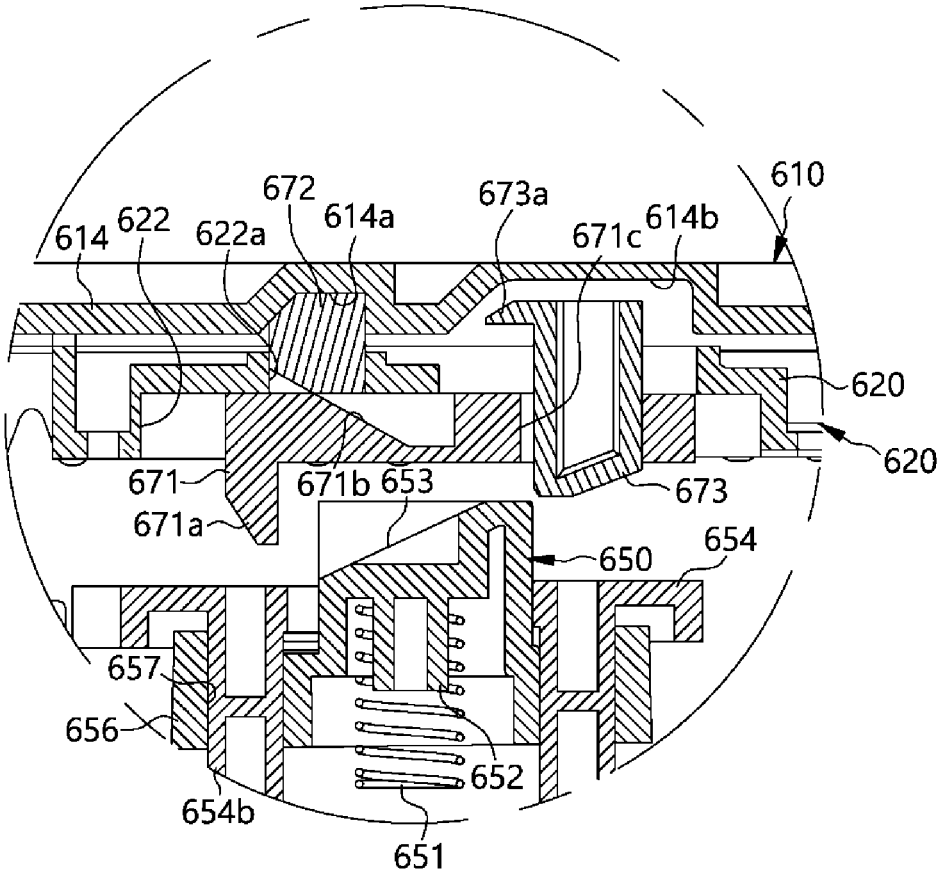
FIG. 32 is an enlarged view of an "I" portion of FIG. 27.
Figure 33:
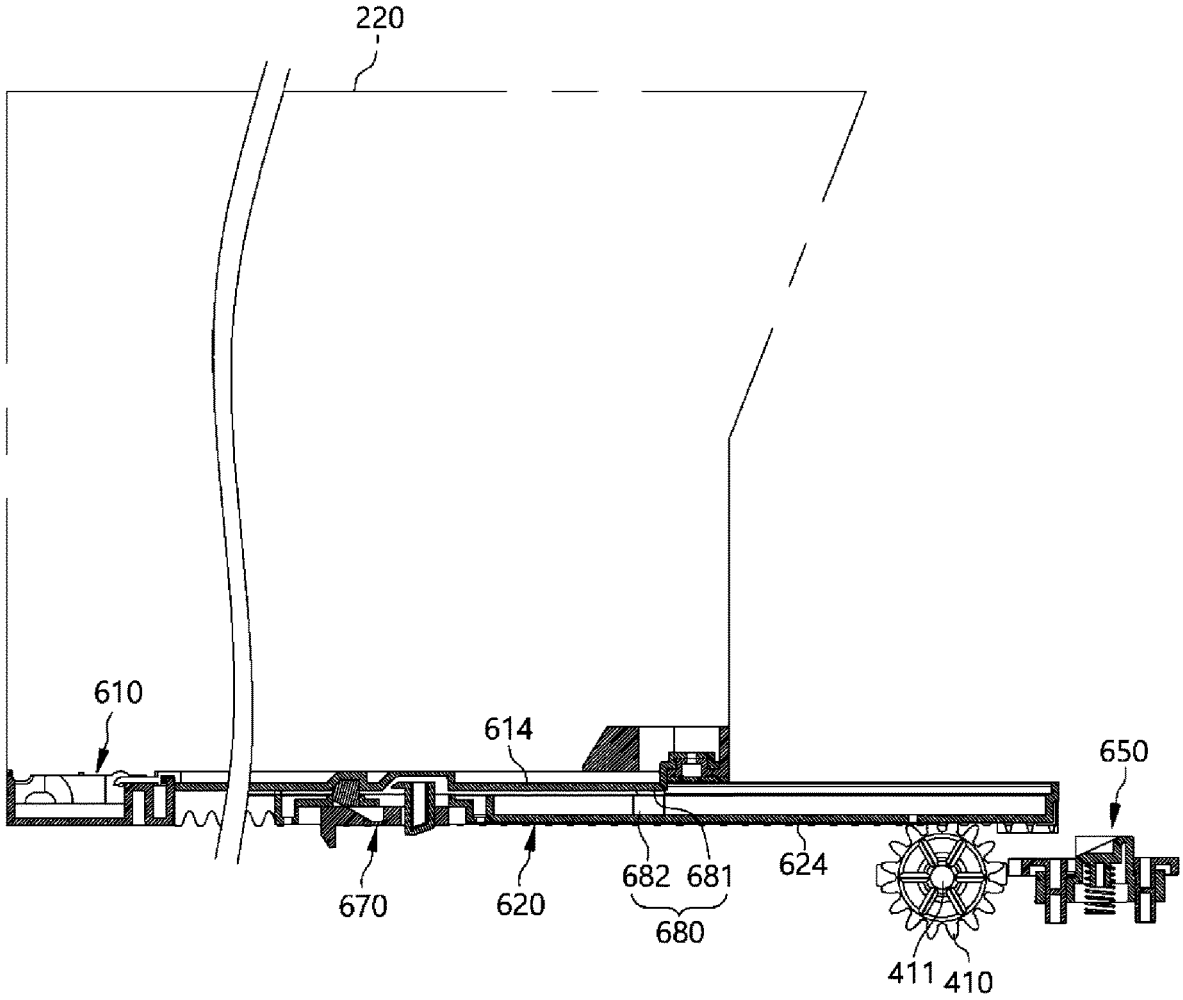
Figure 34:
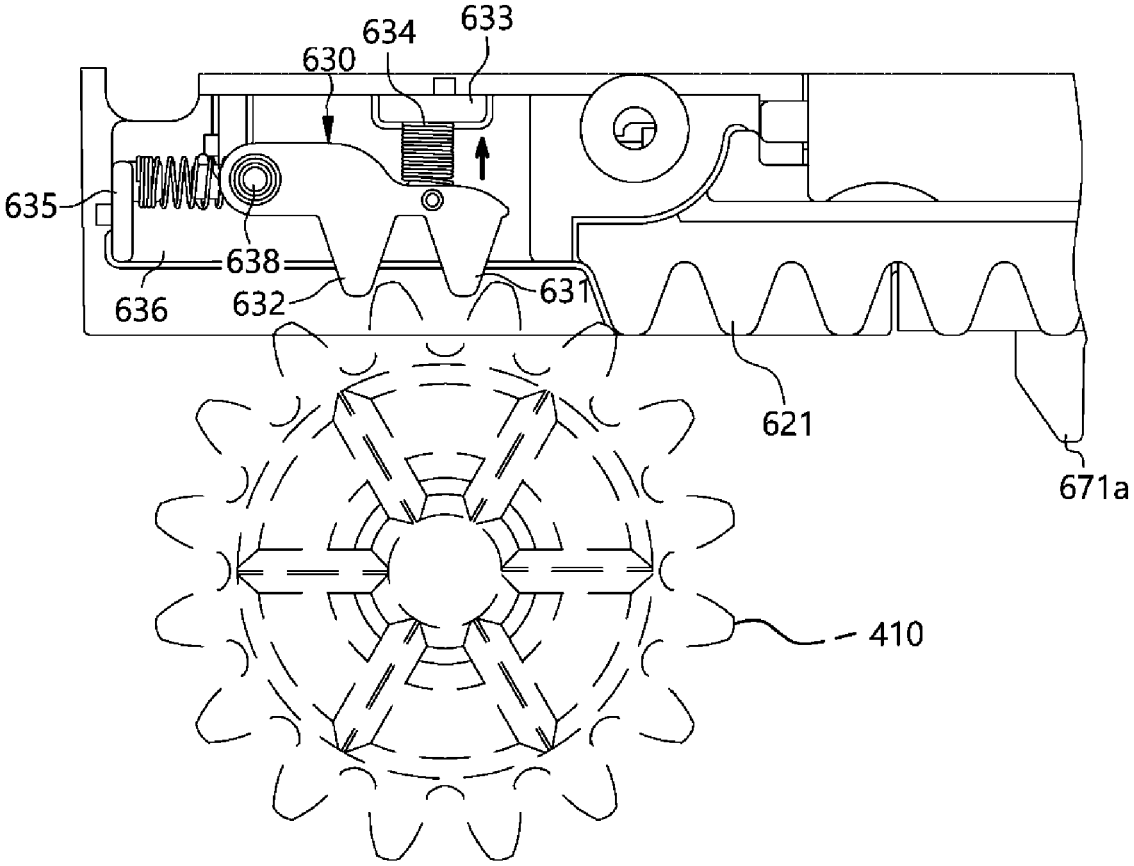
FIG. 34 is an outlined state view illustrating a state of position compensation by the idle gear during closing of the drawer of the refrigerator having a drawer according to the embodiment of the present disclosure.

A pinion exposure hole 511 may be provided on each of opposite sides of the cover plate 510 by being formed therethrough such that the pinion 410 (constituting the driving part 400) is exposed to the inner part of the lower storage chamber 3 (see FIGS. 7 and 8).

A motor receiving part 512 (See FIG. 7), into which the driving motor 420 (constituting the driving part 400) is received, is provided on the cover plate 510. The motor receiving part 512 may protrude upward from a portion of the cover plate 510 or may be provided by being combined with the cover plate 510 after being manufactured independently of the cover plate 510. The motor receiving part 512 may also be formed in other shapes or methods.

A protrusion passing hole 513 may be provided on a rear of each of opposite sides of the cover plate 510 by being formed therethrough so as to install a confining protrusion part 650 therein. The confining protrusion part 650 may be positioned so that an upper end thereof is exposed to the inner part of the lower storage chamber 3 while the confining protrusion part 650 is received in the protrusion passing hole 513. The confining protrusion part 650 may be described below in a later description of the rack gear assemblies 601 and 602.

An open/close sensing part 514 (or sensing device) may be provided on each of the bottom surface of the inner part of the storage chamber and a lower surface of the drawer opposite thereto so as to detect closing and opening of the drawer 200 (see FIGS. 4 and 5). That is, part of the open/close sensing part 514 may allow accurately detecting whether the drawer 200 is completely closed or partially opened.

The open/close sensing part 514 may include an open/close sensor 514*a* and an open/close sensing member 514*b*. The open/close sensor 514*a* may be a Hall sensor, and the open/close sensing member 514*b* may be a magnet that can be sensed by the Hall sensor. The open/close sensing part 514 may be composed of various structures such as optical sensors and switches.

The open/close sensor 514*a* (of the open/close sensing part 514) may be provided on the bottom surface of the inner part of the lower storage chamber 3, and the open/close sensing member 514*b* may be provided on the lower surface of the storage bin 220 (constituting the drawer 200). The open/close sensing member 514*b* may be provided on the bottom surface of the inner part of the lower storage chamber 3 and the open/close sensor 514*a* may be provided on the lower surface of the storage bin 220. The open/close sensor 514*a* may be provided on a wall surface of any one side in the lower storage chamber 3 and the open/close sensing member 514*b* may be provided on a wall surface facing the storage bin 220.

The open/close sensor 514*a* may be provided on the cover plate 510 positioned on the bottom surface of the inner part of the lower storage chamber 3. Accordingly, maintenance of the open/close sensor 514*a* can be performed by separation of the cover plate 510 therefrom.

An additional open/close sensing member 514*c* may be provided on a lower surface end of the rack gear assembly 600. Accordingly, when the rack gear assembly 600 is completely extended, the open/close sensing member 514*c* may be configured to detect complete extension of the rack gear assembly 600 and recognize a complete opening of the drawer 200

The open/close sensing part 514 may be configured to influence an operation control of the driving part 400 described above.

When the open/close sensing part 514 detects closing of the drawer 200, the driving motor 420 (constituting the driving part 400) is configured to operate for a predetermined time or by a predetermined number of rotations thereof from a detection time of the closing of the drawer, and then to release the operation thereof.

The driving motor 420 is programmed to operate by at least one pitch of a rack gear 611 provided in a first rack member 610 from the time at which the closing of the drawer 200 is detected by the open/close sensing part 514 and then to release the operation thereof.

This may be because when any one side of the drawer 200 reaches a closing position earlier than the remaining side thereof while a left side and a right side of the drawer 200 do not move exactly in parallel but move obliquely, the open/close sensor 514*a* of the open/close sensing part 514 may determine that the drawer 200 is closed although the remaining side is not closed.

That is, although any one side of the drawer 200 is closed earlier than the remaining side, the remaining side is allowed to additionally move by a distance of at least one pitch of the rack gear 611 from the point at which the one side is closed, so that opposite sides of the drawer 200 can be closed.

The pinion 410 may be allowed to additionally rotate only twice or less, and more preferably the pinion 410 may be allowed to rotate only once. This may prevent damage of the pinion 410 or the rack gear 611 which may occur when the pinion 410 rotates more than the number of rotations required thereof.

The pinion 410 or the rack gear 611 may be damaged even when the pinion 410 additionally rotates once or twice.

In consideration that a packing member may be provided on a contact surface of the drawer 200 with the cabinet 100, although the pinion 410 additionally rotates by a buffer distance of the packing member, the pinion 410 or the rack gear 611 is not damaged. While the operation release of the driving motor 420 driving the pinion 410 is performed, the pinion 410 is rotated reversely by the additional rotation thereof by a buffer capacity of the packing member and the opposite sides of the drawer 200 are accurately closed without having gears damaged since a moving force thereof is released by the additional rotation.

The guiding head 520 of the cable guide module 500 is a part that is combined with the front panel 210.

An installation hole 212 is provided at a center lower portion of a rear surface of the front panel 210 (see FIG. 10), and the guiding head 520 is configured to pass through a portion of the installation hole 212 and to be combined with the rear surface of the front panel 210.

A cable housing may include a plurality of connecting members. Each of the connecting members 530 of the cable guide module 500 is a part flexibly connecting the swinging connection member 540 with the guiding head 520.

Each of the connecting members 530 may be configured as a tube body having an empty inner part and be continuously connected to each other such that a cable sequentially passes through an inner part of each of the connecting members 530. The above-described connection structure may be a chain-type connection structure.

A connection portion between each of the connecting members 530 is configured to be rotatable in a horizontal direction, wherein the connecting member 530 of any one end of each of the connecting members 530 is rotatably connected to the swinging connection member 540 and the connecting member 530 of the remaining end is rotatably connected to the guiding head 520. When the drawer 200 moves forward or backward, the connecting members 530 move the cable together therewith by operating in cooperation with each other due to such a structure.

The swinging connection member 540 (of the cable guide module 500) is a part rotatably connected to the cover plate 510.

A cable through hole 515 may be provided at the cover plate 510 to allow the cable to pass therethrough, and the swinging connection member 540 may have a pipe structure, wherein an end of the swinging connection member 540 is configured to be in close contact with an upper surface of the cover plate 510. An extension end 541 of a dome structure is provided at an end portion of the swinging connection member 540, and the extension end may gradually extend toward the end thereof.

An extension hole 516 may be provided on any one circumference of the cable through hole 515 by extending therefrom, and a confining protrusion 542 may be provided on a circumference of the extension end 541 (constituting the swinging connection member 540) by protruding outward from the circumference of the extension end 541 to pass through the extension hole 516.

The extension hole 516 may have a width to only allow the confining protrusion 542 to pass therethrough. That is, after the confining protrusion 542 passes through the extension hole 516, the swinging connection member 540 is slightly rotated to maintain a state of being prevented from being removed from the cable through hole 515 of the cover plate 510.

The mounting plate 550 (of the cable guide module 500) is a part provided to prevent deviation of the swinging connection member 540 connected to the cover plate 510.

The mounting plate 550 may be combined with and fixed to the cover plate 510, and a communicating hole 551 is provided at a portion corresponding to the cable through hole 515, and a covering end 552 is provided on a circumference of the communicating hole 551 by protruding therefrom to cover the extension end 541 of the swinging connection member 540. An inner surface of the covering end 552 is configured to have the same curved surface (a spherical surface) as an outer surface of the extension end 541 so as to be in close contact therewith.

The rack gear assemblies 601 and 602 of the refrigerator may now be described.

Each of the rack gear assemblies 601 and 602 is a device operating to allow the drawer 200 to automatically move forward and backward by a driving force of the driving part 400 provided in the cabinet 100.

Each of the rack gear assemblies 601 and 602 is provided on opposite sides of the lower surface of the storage bin 220 constituting the drawer 200. The rack gear assemblies 601 and 602 have the rack gears 611 and 621 provided on lower surfaces thereof such that the pinion 410 exposed to the inner part of the lower storage chamber 3 is engaged with each of the rack gears 611 and 621.

The rack gears 611 and 621 (of the rack gear assemblies 601 and 602) are configured from a front side of the lower surface of the storage bin 220 to a rear side thereof. Accordingly, the drawer 200 provided with the rack gear assemblies 601 and 602 can be moved away from or moved close to the lower storage chamber 3 while the drawer 200 is moved forward and rearward by a rotating movement of the pinion 410.

The pinion 410 and the rack gear assemblies 601 and 602 may be provided so that at least three thereof are paired with each other.

As a distance of the drawer 200, which is automatically opened, increases, convenience of use may improve.

That is, as the storage bin 220 is maximally moved away from the lower storage chamber 3 by the drawer 200, it may become easy to house the container 240 in the storage bin 220 or to store items or food in the storage bin.

Further, since the container 240 may be automatically raised by the lift module 300 when the drawer 200 is opened, the storage bin 220 may maximally move away from the lower storage chamber 3.

Each of the opposite pinions 410 is preferably located at a front portion of the lower storage chamber 3, and each of the rack gears 611 and 621 is preferably configured to be maximally extended.

As each of the opposite pinions 410 is located close to a front end of the lower storage chamber 3 and the rack gears 611 and 621 extend, an opening distance of the storage bin 220 may increase.

However, in consideration that the bottom surface of the storage bin 220 is configured to be shorter in length from front to rear than an open upper surface of the storage bin 220, there may be a limitation in extending the rack gears 611 and 621.

Accordingly, according to an embodiment of the present disclosure, the rack gear assemblies 601 and 602 are configured to extend such that the opening distance of the storage bin 220 increases.

That is, although a length between the front and rear of the storage bin 220 is short, the rack gear assemblies 601 and 602 extend such that the storage bin 220 is opened farther.

In an embodiment of the present disclosure, there are provided the first rack member 610 and the second rack member 620, a first rack cover 614 and a second rack cover 624, the idle gear 630, the confining protrusion part 650, and the confining module 670 moved forward sequentially while the rack gear assemblies 601 and 602 move forward.

The rack gear assemblies 601 and 602 may be described below in detail by each configuration.

The first rack member 610 is configured to allow the storage bin 220 to be moved forward and backward by rotation of the pinion 410, wherein the first rack member 610 includes the rack gear 611.

The first rack member 610 is configured to be fixed to the storage bin 220 while an upper surface of the first rack member 610 is in close contact with a lower surface of the storage bin 220. A plurality of coupling holes 612 are provided in the first rack member 610 such that the first rack member 610 is screwed (or attached) to the storage bin 220.

The first rack member 610 may include a movement guiding groove 613 provided in the lower surface thereof by being recessed therefrom, the movement guiding groove supporting a sliding movement of the second rack member 620 while the second rack member 620 is received in the movement guiding groove 613.

The movement guiding groove 613 is configured to be recessed from a front end portion of the first rack member 610 and to be formed through a rear surface of the first rack member 610. The second rack member 620 received in the movement guiding groove 613 may be exposed to the rear of the movement guiding groove 613.

The rack gear 611 of the first rack member 610 is provided at any one side of the movement guiding groove 613 (an opposing direction side of each of the opposite rack gear assemblies) in a longitudinal direction of the first rack member 610.

The rack gear 611 is formed to a portion located at a further front side compared to the movement guiding groove 613.

The first rack member 610 is provided with the first rack cover 614.

An inner portion of the movement guiding groove 613 provided in the first rack member 610 is configured to be open upward and downward. Accordingly, the movement guiding groove 613 is configured to allow a holder 672 and a locking member 673 of the confining module 670 to pass therethrough. The first rack cover 614 may be combined with the first rack member 610 to cover the upper surface of the first rack member 610, wherein a lower surface of the first rack cover 614 is configured to cover the open portion of the movement guiding groove 613 provided in the first rack member 610 and to constitute an upper surface of the movement guiding groove 613.

The first rack cover 614 may be a metal plate so as to reinforce an insufficient rigidity of the first rack member 610.

A lower surface (an upper surface of an inner part of the movement guiding groove) of the first rack cover 614 may include receiving grooves 614*a* and 614*b* provided thereon, wherein the holder 672 and the locking member 673 of the confining module 670 are received into the receiving grooves 614*a* and 614*b*, respectively.

The receiving grooves 614*a* and 614*b* may include a first receiving groove 614*a* for receiving the holder 672 and a second receiving groove 614*b* for receiving the locking member 673. The two receiving grooves 614*a* and 614*b* are configured to be spaced apart from each other along a moving direction of the first rack member 610. A distance defined between a rear surface of the first receiving groove 614*a* and a rear surface of the second receiving groove 614*b* is still longer than a distance defined between a rear surface of the holder 672 and a rear surface of the locking member 673.

That is, after the holder 672 is received into the first receiving groove 614*a*, and the locking member 673 is received into the second receiving groove 614*b*.

Unlike the aforementioned embodiment, the first rack cover 614 and the first rack member 610 may be provided as a single body by injection molding.

When the first rack member 610 and the first rack cover 614 are formed as the single body, injection molding, which may be difficult to be performed, may be required. That is, since a recessed shape or direction of each portion of the first rack member 610 and the first rack cover 614 may be different, injection molding may be actually avoided.

Accordingly, the first rack member 610 and the first rack cover 614 may be manufactured independently of each other and then may be combined with each other.

The second rack member 620 is a part to move the storage bin 220 forward and backward in cooperation with the first rack member 610.

When the first rack member 610 moves forward by a predetermined distance while the second rack member 620 is positioned to be received into the movement guiding groove 613 of the first rack member 610, the second rack member 620 is moved forward by being pulled by the first rack member 610 and receives a rotational force of the pinion 410. Subsequently, the second rack member 620 is moved forward by the rotational force of the pinion 410. Accordingly, although the rack gear 611 of the first rack member 610 moves away from the pinion 410, the first rack member 610 is further extended.

The first rack member 610 is configured to pull and move the second rack member 620 in cooperation with a linkage part 680.

The linkage part 680 may include a linkage protrusion 681 provided on a lower surface (the upper surface of the inner part of the movement guiding groove) of the first rack cover 614 and a linkage step 682 provided on an upper surface of the second rack member 620. When the first rack member 610 moves forward by a predetermined distance, the linkage protrusion 681 and the linkage step 682 may collide with each other and move the second rack member 620 forward.

The linkage protrusion 681 may be provided in the first rack member 610. Additionally, the linkage protrusion 681 may be provided on the upper surface of the second rack member 620, and the linkage step 682 may be provided on a lower surface of the first rack member 610.

Furthermore, while the second rack member 620 is completely received into the movement guiding groove 613 of the first rack member 610, a distance defined between the linkage step 682 and the linkage protrusion 681 is a distance set such that the first rack member 610 moves forward without influencing the second rack member 620, and the set distance is preferably determined in consideration of a size of the storage bin 220 or the entire opening distance of the storage bin 220.

The rack gear 621 is provided in the second rack member 620. The rack gear 621 is provided to be positioned in parallel with the rack gear 611 of the first rack member 610 at a side portion thereof, wherein a front end of the rack gear 621 is provided to be positioned at a rear side compared to a front end of the rack gear 611 of the first rack member 610, and a rear end of the rack gear 621 is configured to extend to a further rear side compared to a rear end of the rack gear 611 of the first rack member 610.

The rack gears 611 and 621 of the first rack member 610 and the second rack member 620 are configured to efficiently receive the driving force generated by the pinion 410. That is, the pinion 410 is configured to have a width of a size of the rack gear 611 of the first rack member 610 and the rack gear 621 of the second rack member 620 overlapped together such that each of the rack gears 611 and 621 accurately receives the driving force caused by the pinion 410.

A motion groove 622 may be recessed in a lower surface of a front end of the second rack member 620. The motion groove 622 may provide a moving space allowing a stopper member 671 of the confining module 670 to move forward and backward while the stopper member 671 is mounted in the motion groove 622 by being received thereinto.

A plurality of through holes 622*a* and 622*b* may be provided in the motion groove 622 by being formed through an upper part thereof. The through holes 622*a* and 622*b* may include a first through hole 622*a* through which the holder 672 of the confining module 670 passes and a second through hole 622*b*, through which the locking member 673 passes.

The second through hole 622*b* may be a longitudinal hole in forward and backward directions such that the locking member 673 moves forward and backward.

The second rack cover 624 is provided on a lower surface of the second rack member 620. That is, the second rack cover 624 may cover the lower surface of the second rack member 620.

The second rack cover 624 may prevent the stopper member 671 mounted to the motion groove 622 of the second rack member 620 from deviating to the outside.

The second rack cover 624 may be made of a metal plate and is provided to cover the lower surface of the second rack member 620. Accordingly, the second rack member 620 can be prevented from being deformed (e.g. twisting or bending). A partial open portion may exist in the second rack cover 624 to reduce weight thereof.

A folded end 624*a* is configured to be folded on each of opposite side surfaces and a rear surface of the second rack cover 624 so as to cover a portion of each of the opposite side surfaces and the rear surface of the second rack member 620, thereby preventing twisting deformation of the second rack member 620.

A stopper exposure hole 624*b* may be provided at a front end portion of the second rack cover 624, and may be configured to allow a portion of the stopper member 671 to be exposed therethrough.

Although the drawer 200 is slantingly inserted, the idle gear 630 is configured to support the drawer 200 such that the opposite sides of the drawer 200 are completely closed.

The idle gear 630 is configured to be engaged with gear teeth of the pinion 410 and to allow the pinion 410 to run idly, and the idle gear 630 is provided in at least any one rack gear assembly of the opposite rack gear assemblies 601 and 602.

In an embodiment of the present disclosure, the idle gear 630 is provided only in the rack gear assembly 602 (hereinafter referred to as a release type rack gear assembly) positioned at a right side when the drawer 200 is shown from a lower surface thereof.

The idle gear 630 may also be provided in the rack gear assembly 601 (hereinafter referred to as a normal rack gear assembly) positioned at a left side when the drawer 200 is shown from the lower surface thereof.

When the driving motor 420 (constituting the driving part 400) detects the closing of the drawer 200, the drawer 200 can additionally move by a predetermined distance. Accordingly, although the idle gear 630 is provided at any one side of the drawer 200, the opposite sides of the drawer 200 are finally closed in parallel.

The rack gear 611 of the first rack member 610 is provided on the normal rack gear assembly, of the opposite rack gear assemblies 601 and 602, provided at a positioning portion of the open/close sensing part 514 to be continuously formed to the front end of the first rack member 610. The rack gear 611 of the first rack member 610 constituting the release type rack gear assembly positioned at a side opposite to the normal rack gear assembly is not formed to the front end and is formed to be shorter than the rack gear 611 of the normal rack gear assembly, and includes the idle gear 630 at a front thereof. This may be shown in FIG. 12.

That is, while the drawer 200 is closed, the idle gear 630 is provided at a position at which the idle gear 630 is engaged with the pinion 410.

The idle gear 630 is configured to have at least one gear tooth 631 or 632, which is engaged with the gear teeth of the pinion 410 (see FIGS. 16, and 22-25).

The idle gear 630 may include two gear teeth 631 and 632, wherein a pitch between the two gear teeth 631 and 632 is configured to have the same pitch P2 as a pitch P1 of the rack gear 611. That is, the idle gear 630 is configured to have the same structure as a structure of the rack gear 611 of the first rack member 610 so as to be engaged with the pinion 410.

A distance L defined between a rear gear tooth 631 of the two gear teeth 631 and 632 of the idle gear 630 which is positioned to be relatively close to the rack gear 611 and the rack gear 611 is configured to be longer than a pitch between each gear tooth (the pitch between each gear tooth of the idle gear or the pitch between each gear tooth of the rack gear).

In such a structure, although the release type rack gear assembly (i.e., the second rack gear assembly 602) at which the idle gear 630 is positioned advances less (by normally one pitch) than the normal rack gear assembly (i.e., the first rack gear assembly 601) positioned at the opposite side thereof, the gear teeth 631 and 632 of the idle gear 630 are engaged with the pinion 410 such that the release type rack gear assembly is pulled by the distance difference. Accordingly, advancing movement of the release type rack gear assembly is forcibly performed and positioned to be in parallel with the normal rack gear assembly.

When the distance L defined between the gear teeth 631 of the idle gear 630 and the rack gear 611 is excessively long, the pinion 410 may not be engaged with the gear teeth 631 and 632 of the idle gear 630. Accordingly, the distance L defined between the gear tooth 631 of the idle gear 630 and the rack gear 611 is at least one pitch (1*P1 or 1*P2) and is most preferably configured to be shorter than a distance of three gear teeth of the rack gear 611 (two pitches) (2*P1) (see FIG. 25). That is, at the time at which the rack gear 611 of the first rack member 610 passes the pinion 410, the pinion 410 may be preferably engaged with the idle gear 630.

The idle gear 630 may elastically move vertically. Accordingly, when the pinion 410 rotates although the release type rack gear assembly does not move backward any longer, the idle gear 630 elastically moves upward and downward such that a rotational force of the pinion 410 is released. That is, the pinion 410 only runs idly and does not transmit power.

For upward and downward movements of the idle gear 630, a first seating step 633 is provided at an upper side of the idle gear 630 of the rack member, and an elastic member 634 (for up and down movement) is provided on opposing surfaces of the first seating step 633 and the idle gear 630 therebetween. This may be shown in FIG. 23.

The elastic member 634 for up and down movement may be positioned at a portion existing between the two gear teeth 631 and 632 of an upper surface of the idle gear 630 or an upper side of the rear gear tooth 631 thereof. That is, the elastic member 634 for up and down movement may be pressed at the position, so that during rotation of the pinion 410, the idle gear 630 is prevented from flipping back and forth.

The idle gear 630 may flexibly move forward and backward. Accordingly, although the idle gear 630 is not located at a position spaced apart from the rack gear 611 by the same pitch interval as the rack gear 611 of the first rack member 610, the idle gear 630 may be accurately engaged with the pinion 410 and damage that may be caused by a forcible engagement of the gear teeth 631 and 632 of the idle gear 630 with the pinion 410 may be prevented.

For forward and backward movements of the idle gear 630, a second seating step 635 is provided in the first rack member 610 to block a front of the idle gear 630, and an elastic member 636 for back and forth movement is provided on opposing surfaces of the second seating step 635 and the idle gear 630 therebetween.

The first rack member 610 may be provided with a cover body 637 covering an outer part of the idle gear 630. Various foreign materials may be prevented from entering the idle gear 630 by the cover body 637. Accordingly, malfunction of the idle gear 630, which may be caused by foreign materials, can be prevented.

The idle gear 630 can be prevented from deviating to a side part by the cover body 637.

A support protrusion 638 may be provided on a side wall of the idle gear 630, and the support protrusion 638 may be configured to be supported by the cover body 637 by passing therethrough. This may be shown in FIG. 24.

A lower end of each of two gear teeth 631 and 632 constituting the idle gear 630 is preferably configured to be positioned at a side lower than a lower end of the rack gear 611.

Since the idle gear 630 is installed to flexibly move upward and downward, the idle gear 630 may be located at a position lower than a position of the rack gear 611, whereby an initial engagement of the idle gear 630 with the pinion 410 can be accurately and stably performed.

The confining protrusion part 650 is a part provided so as to confine the second rack member 620.

The confining protrusion part 650, an upper surface of which is closed and a lower surface of which is open, is provided at a front of the upper surface (the bottom surface of the inner part of the storage chamber) of the bottom 120 (constituting the cabinet 100).

More particularly, the confining protrusion part 650 is installed in the protrusion passing hole 513 formed through the cover plate 510. When the cover plate 510 does not exist, the protrusion passing hole 513 is provided by being depressed in the upper surface (the bottom surface of the inner part of the storage chamber) of the bottom 120 of the cabinet 100 such that the confining protrusion part 650 is installed therein.

An inner width of the protrusion passing hole 513 is larger than an outer width of the confining protrusion part 650, and an external exposure of a gap generated due to a width difference between the protrusion passing hole 513 and the confining protrusion part 650 is blocked by a confining holder 654. This may be shown in FIG. 26.

The confining holder 654 may be combined with the upper surface of the cover plate 510 (or the upper surface of the bottom). A protrusion passage hole 654*a*, through which the confining protrusion part 650 passes, is provided at a center portion of the confining holder 654, and the confining holder 654 may be combined with the cover plate 510 while an outer surface portion of the confining holder blocks gaps between the protrusion passing hole 513 and the confining protrusion part 650.

A combination end 656 is provided on an outer surface of the confining protrusion part 650 by protruding outward therefrom, and lifting/lowering guides 654*b* are provided on a lower surface of the confining holder 654 by protruding therefrom so as to pass through the combination end 656 upward and downward. The combination end 656 is provided on each of opposite sides of the confining protrusion part 650 by protruding therefrom, and each of the lifting/lowering guides 654*b* is provided on each of opposite sides of the confining holder 654 so as to pass through the combination end 656.

The lifting/lowering guide 654*b* may support upward and downward movements of the confining protrusion part 650.

The confining protrusion part 650 may be installed to be elastically raised in the protrusion passing hole 513 by an elastic member 651.

When the confining protrusion part 650 is pressed, the confining protrusion part 650 moves downward into the protrusion passing hole 513, but when the confining protrusion part 650 is not pressed, the confining protrusion part 650 moves upward in the protrusion passing hole 513 such that a portion of the confining protrusion part is exposed to and protrudes to the inner part of the lower storage chamber 3.

The elastic member 651 for raising may be made of a coil spring, and a spring engagement protrusion 652 may protrude downward in the confining protrusion part 650, wherein an upper end of the elastic member 651 for raising is combined with the spring engagement protrusion 652 in the confining protrusion part 650 by passing through a lower surface of the confining protrusion part 650.

The confining protrusion part 650 is positioned behind the pinion 410, but is positioned to be maximally adjacent to the pinion 410.

A slope 653 is provided at a middle of an upper surface of the confining protrusion part 650, wherein the slope 653 is gradually inclined upward toward a rear of the confining protrusion part 650 from a front thereof. As the locking member 673 (of the confining module 670) moves backward on the slope 653, the confining protrusion part 650 is configured to move downward.

The confining module 670 is a portion provided to confine the second rack member 620 until the first rack member 610 is completely extended.

The confining module 670 is configured to include the stopper member 671, the holder 672, and the locking member 673.

The stopper member 671 is provided in the motion groove 622 of the second rack member 620 and functions to restrict a backward movement of the second rack member 620. A length of the stopper member 671 from a front of the stopper member 671 to a rear thereof is configured to be shorter than a length of the motion groove 622 from a front of the motion groove 622 to a rear thereof. Accordingly, the stopper member 671 is installed to move in forward and backward directions in the motion groove 622.

A confining hook 671*a* is provided on a lower surface of the front end of the stopper member 671 by protruding downward therefrom. When the drawer 200 is moved backward by a predetermined distance, the confining hook 671*a* hits the front surface of the confining protrusion part 650 such that the stopper member 671 and the first rack member 610 are not moved backward any longer.

A holder groove 671*b* is provided on an upper surface of the front of the stopper member 671, and a locking member through hole 671*c* is provided on a rear portion of the stopper member 671 by being vertically formed therethrough.

The holder groove 671*b* may gradually incline downward toward a rear thereof. Accordingly, when the holder 672 received into the holder groove 671*b* moves forward, the holder 672 can efficiently move away from the holder groove 671*b*.

The holder 672 is a part to restrict forward and backward movements of the stopper member 671.

A lower end of the holder 672 is received into the holder groove 671*b* of the stopper member 671, and an upper end of the holder 672 is provided to pass through the first through hole 622*a* of the second rack member. When the first rack member 610 moves forward by a predetermined distance and pulls the second rack member 620, the holder 672 is configured to escape from the holder groove 671*b* while moving forward together with the second rack member 620 and to be received into the first receiving groove 614*a* of the first rack cover 614.

Each of a front upper edge of the holder 672 and a front lower edge thereof is configured to be inclined. The inclination of the front lower edge of the holder 672 is configured to be the same as inclination of the holder groove 671*b*. Accordingly, the holder 672 can efficiently escape from the holder groove 671*b*.

Further, the holder 672 may include a cut groove 672*a* provided in an upper surface thereof by being cut in forward and backward directions, and an insert protrusion 614*c* received into the cut groove 672*a* is provided on a lower surface of the first rack cover 614 facing the upper surface of the holder 672, wherein the insert protrusion is provided from a front end of the first rack cover 614 to an inner part of the first receiving groove 614*a*. That is, due to a structure of each of the cut groove 672*a* and the insert protrusion 614*c*, while the first rack member 610 moves, leftward and rightward movements of the holder 672 are prevented such that the insert protrusion is accurately received into the first receiving groove 614*a*. The cut groove 672*a* and the insert protrusion 614*c* may be provided in plural.

The locking member 673 is positioned at a rear of the confining protrusion part 650 and held thereby until the first rack member 610 is moved forward by a predetermined distance, and accordingly may prevent forward movement of the second rack member 620.

While the second rack member 620 and the second rack cover 624 move together with the first rack member 610 and the first rack cover 614 due to the forward movement of the first rack member 610 and the first rack cover 614 by the predetermined distance, the locking member 673 moves upward and is received in the second receiving groove 614*b* of the first rack cover 614 positioned to correspond to the upper part thereof. Accordingly, the locking member 673 confined by the confining protrusion part 650 may be released.

An extending step 673*a* is provided at an upper end of the locking member 673 by extending to opposite sides thereof, and a lifting guide step 623 formed to be round (or inclined) is provided at each of opposite sides of the second through hole 622*b* of an upper surface of the front end of the second rack member 620 such that the extending step 673*a* is lifted while the first rack member 610 and the first rack cover 614 are moved forward by a predetermined distance and moved together with the second rack member 620 and the second rack cover 624.

When the first rack member 610 and the first rack cover 614 are moved forward by a predetermined distance and moved together with the second rack member 620 and the second rack cover 624, the lifting guide step 623 provided in the second rack member 620 allows the extending step 673*a* of the locking member 673 to be lifted. Accordingly, the locking member 673 moves upward to a height at which the locking member 673 does not hit the confining protrusion part 650.

The lifting guide step 623 may be gradually inclined or round upward toward a rear thereof. The lifting guide step 623 is preferably configured to gradually incline upward toward a rear of the second through hole 622*b* from a middle portion of each of opposite sides thereof. When the locking member 673 is positioned at the front of the second through hole 622*b*, the locking member 673 is not influenced by the lifting guide step 623. However, as the locking member 673 is moved to the rear of the second through hole 622*b* by a forward movement of the second rack member 620, the locking member 673 is influenced by the lifting guide step 623 and is gradually moved upward.

The extending step 673*a* of the locking member 673 may be configured to be round or inclined as the lifting guide step 623.

A lower surface of the locking member 673 is configured to gradually incline upward toward a rear thereof. Inclination of the lower surface of the locking member 673 is configured to be the same as inclination of the slope 653 provided at the middle of the upper surface of the confining protrusion part 650.

Operation of the refrigerator having a drawer according to an embodiment of the present disclosure may be described referring to FIGS. 27 to 34.

When the drawer 200 is not additionally manipulated, the drawer 200 maintains a closed state thereof. This may be shown in FIGS. 27 and 28.

In the closed state, when an opening manipulation of the drawer 200 is performed due to needs of a user, power is supplied to the driving part 400 and the driving motor 420 may operate.

The opening manipulation of the drawer 200 is performed by manipulation of a button 6 (a touching or pressing type) or by a control program detecting proximity of a user.

When the driving motor 420 is operated by the manipulation, the opposite pinions 410 are simultaneously rotated. Accordingly, while the rack gears 611 and 621 of the opposite rack gear assemblies 601 and 602 engaged with the opposite pinions 410 are operated, the drawer 200 may be moved forward.

More particularly, after the first rack member 610 and the first rack cover 614 are moved forward while operating simultaneously, the second rack member 620 and the second rack cover 624 may be moved forward.

While the first rack member 610 and the first rack cover 614 are moved forward while operating simultaneously, the locking member 673 maintains a state confined by the confining protrusion part 650. Accordingly, the second rack member 620 and the second rack cover 624 maintain initial positions thereof.

Further, when the first rack member 610 and the first rack cover 614 are moved forward by a preset first distance and the linkage protrusion 681 comes into contact with the linkage step 682, the second rack member 620 and the second rack cover 624 also move forward together with the first rack member 610 from the contact time at which the linkage protrusion 681 comes into contact with the linkage step 682. This may be shown in FIGS. 29 and 30.

However, in this example, since the locking member 673 is in the state confined by the confining protrusion part 650, the stopper member 671 through which the locking member 673 passes maintains an initial position thereof, but the second rack member 620 moves forward. In this process, as the extending step 673*a* of the locking member 673 gradually climbs on the lifting guide step 623 provided in the second rack member 620, the locking member 673 moves upward and moves away from the confining protrusion part 650. This may be shown in FIGS. 31 and 32.

While the stopper member 671 moves forward together with the second rack member 620 with the stopper member 671 being in collision with an inner rear surface of the motion groove 622, the stopper member 671 passes the confining protrusion part 650.

Subsequently, while the second rack member 620 and the second rack cover 624 move following the first rack member 610 and the first rack cover 620, the rack gear 621 of the second rack member 620 is engaged with the pinion 410 immediately before the rack gear 611 of the first rack member 610 moves away from the pinion 410, and at the same time when the rack gear 611 of the first rack member 610 moves away from the pinion 410 due to rotation of the pinion 410, only the rack gear 621 of the second rack member 620 moves by being engaged with the pinion 410 so as to further move the drawer 200 forward. This may be shown in FIG. 33.

When movement of the second rack member 620 is completed, the storage bin 220 of the drawer 200 is at a maximum open state. When such a maximum open state of the storage bin 220 is detected (for example, detection by the open/close sensing part), the lift module 300 operates and moves upward the container 240 in the storage bin 220.

Accordingly, a user can efficiently perform taking out the container 240 or items stored in the container 240, or storing items in the container 240.

When a closing manipulation of the drawer 200 starts after the use of the drawer 200 by a user is completed, the driving motor 420 (constituting the driving part 400) operates and the pinion 410 rotates counterclockwise. Accordingly, the rack gear 621 of the second rack member 620 engaged with the pinion 410 operates and moves the second rack member 620 backward.

Since the first rack member 610 is pulled by the second rack member 620 due to the linkage part 680, the first rack member 610 moves backward together with the second rack member 620.

When the front end of the rack gear 621 of the second rack member 620 is positioned to be engaged with the pinion 410, the rear end of the rack gear 611 of the first rack member 610 is also positioned to be engaged with the pinion 410. Subsequently, the rack gear 621 of the second rack member 620 moves away from the pinion 410, and only the first rack member 610 is moved backward by the rack gear 611 thereof.

As described above, immediately before the second rack member 620 completely moves backward, the confining hook 671*a* of the stopper member 671 is blocked by the confining protrusion part 650 and does not move backward any longer. In spite of the stopper member 671, which is blocked, as the second rack member 620 additionally moves by a distance by which the stopper member 671 is provided to move in the motion groove 622, the extending step 673*a* of the locking member 673 is removed from the lifting guide step 623 and the locking member 673 moves downward.

The second rack member 620 is also prevented from moving further backward by the stopper member 671, and the confining protrusion part 650 is positioned between the confining hook 671*a* of the stopper member 671 and the locking member 673 and confines the second rack member 620.

Accordingly, while only the first rack member 610 is additionally moved backward, the first rack member 610 is restored to an initial position thereof (a position at which the storage bin is completely received). When completion of such a restoring movement is detected, operation of the driving motor stops and the closing movement of the drawer stops.

When the closing movement of the drawer 200 is performed, the opposite sides of the drawer 200 may be closed obliquely while the left and right thereof is not in parallel but any one side thereof is located at a more forward position than the remaining side thereof.

That is, although a rack gear of any one rack gear assembly of the opposite rack gear assemblies 601 and 602 is engaged with the pinion 410 by one pitch later than a rack gear of the remaining rack gear assembly due to carelessness of a user, the drawer 200 advances into the lower storage chamber 3 with the left and right of the drawer being not in parallel when the opposite pinions 410 are simultaneously rotated by operation of the driving motor 420.

In this process, when any one side of the drawer 200 (for example, a side at which the open/close sensing part is positioned) is closed earlier than the remaining side, the open/close sensing part 514 detects this, and then an additional operation of the driving motor 420 is controlled to be performed.

Since the driving motor 420 is controlled to operate for a predetermined time or by a predetermined number of rotation from the time at which the closing of the drawer 200 is detected, the release type rack gear assembly of the relatively less closed side of the opposite rack gear assemblies 601 and 602 engaged with the opposite pinions 410 is also engaged with the pinion 410 to a portion at which the idle gear 630 is positioned.

The idle gear 630 receives a pulling force by the pinion 410 by a distance (at least one pitch but less than two pitches) from the rack gear 611. Accordingly, the release type rack gear assembly can be more efficiently moved.

Engagement between the pinion 410 and the idle gear 630 can be stably and accurately performed by each of the elastic members 634 and 636.

When a side of the drawer 200 (for example, a side opposite to a side at which the open/close sensing part is positioned) is closed earlier than the remaining side thereof, the opposite pinions 410 continuously rotate until the open/close sensing part 514 detects that the remaining side is closed.

Since the idle gear 630 installed in the release type rack gear assembly at the side closed earlier is engaged with the pinion 410, the idle gear 630 receives a horizontal movement force caused by the rotational force of the pinion 411 and additionally moves the release type rack gear assembly backward.

Since there is a packing member at a contact surface between the front panel 210 of the drawer 200 and the cabinet 100, the side at which the release type rack gear assembly of the drawer 200 is installed can be additionally moved backward by a compressive force of the packing member.

However, when the drawer 200 moves until the packing member reaches a maximum compressed state, the idle gear 630 engaged with the pinion 410 is moved upward (see FIG.

34), the engagement of the idle gear 630 with the pinion 410 is temporarily released, and accordingly, the pinion 410 runs idle.

Since the pinion 410 continuously moves the normal rack gear assembly backward while the pinion 410 at the opposite side thereof is engaged with the rack gear 611 of the normal rack gear assembly, the unclosed side of the drawer is closed later.

When the closing of the drawer is detected, the driving motor 420 is controlled to additionally operate for a predetermined time or by a predetermined number of rotations from the detected time, and then stops.

Although any one side of the drawer 200 is closed earlier, the opposite sides of the drawer 200 are completely closed by the additional operation of the driving motor 420 and the idle gear 630.

The refrigerator having a drawer of the present disclosure is not limited only to the above-described structure.

That is, the rack gear assemblies 601 and 602 may be configured to have only the first rack member 610. Even in this example, the idle gear 630 is provided on a front of the rack gear 611 of the first rack member 610, and the structure of the installed idle gear 630 may perform the forward/backward and upward/downward flexible movements as described above.

The rack gear assemblies 601 and 602 may be provided to include at least three rack members. In this example, the idle gear 630 is installed on a front of the rack gear 611 of the rack member 610 positioned at a foremost side of each of the rack members relative to an opening direction of the drawer 200, and the structure of the installed idle gear 630 may move the same forward/backward and upward/downward flexible movements as described above.

The idle gear 630 may be implemented in various forms.

As described above, the refrigerator may provide the rack gear assembly 601 having the idle gear 630 which the gear teeth of the pinion 410 are engaged with and allows the pinion 410 to run idly. Accordingly, although the drawer 200 advances without the opposite sides thereof being in parallel, and the drawer 200 can be completely closed.

According to the refrigerator of the present disclosure, after the driving motor 420 of the driving part 400 additionally operates from the time at which the closed state of the drawer 200 is detected, the driving motor 420 stops the operation thereof. Accordingly, although the drawer 200 advances without the opposite sides thereof being in parallel, the drawer 200 can be completely closed.

Further, since the open/close sensing part 514, which detects the opening and closing of the drawer 200, is further provided on each of the opposing surfaces of the drawer 200 and the cabinet 100, operation control of the driving motor 420 can be accurately performed.

The open/close sensing part 514 may include the open/close sensor 514*a* and the open/close sensing member 514*b*, wherein the open/close sensor 514*a* and the open/close sensing member 514*b* are installed at opposing portions of the inner part of the storage chamber 3 and the drawer 200 therebetween. Accordingly, the opening and closing of the drawer 200 can be accurately detected.

According to the refrigerator of the present disclosure, since the open/close sensor 514*a* is provided at the bottom surface of the inner part of the storage chamber 3 and the open/close sensing member 514*b* is provided on the lower surface of the storage bin 220 (constituting the drawer 200), the installation and maintenance thereof may become easy.

According to the refrigerator of the present disclosure, since the open/close sensor 514*a* is provided as the Hall sensor and the open/close sensing member 514*b* is provided as the magnet, the opening and closing of the drawer 200 can be accurately detected.

According to the refrigerator of the present disclosure, since the rack gear 611 operates to additionally move by at least one pitch from the time at which the closing of the drawer 200 is detected, the drawer 200 can be accurately closed.

According to the refrigerator of the present disclosure, since the pinion 410 is provided to rotate only twice or less from the time at which the closing of the drawer 200 is detected, the pinion 410 or the rack gear 611 can be prevented from being damaged.

According to the refrigerator of the present disclosure, the idle gear 630 is provided at least one rack gear assembly of each of the rack gear assemblies 601 and 602. Accordingly, although the side at which the rack gear assembly 602 of the drawer 200 is positioned is closed earlier, the rack gear 611 and the pinion 410 of the side closed earlier can be prevented from being damaged.

According to the refrigerator of the present disclosure, since the idle gear 630 is positioned in front of the rack gear 611 provided on the first rack member 610, the idle gear 630 is engaged with the pinion 410 only when the drawer 200 is closed.

According to the refrigerator of the present disclosure, since the idle gear 630 is provided to have at least one gear tooth 631 or 632, the idle gear 630 can be engaged with the pinion 410.

According to the refrigerator of the present disclosure, when the idle gear 630 is configured to have the two gear teeth 631 and 632 and the same pitch as the pitch of the rack gear 611, the engagement of the idle gear 630 with the pinion 410 can be accurately performed.

According to the refrigerator of the present disclosure, although the distance L defined between the idle gear 630 and the rack gear 611 is longer than the pitch P1 of the rack gear 611, the idle gear 630 can receive the pulling force by the pinion 410. Accordingly, a further efficient forcible movement can be performed.

According to the refrigerator of the present disclosure, since the distance L defined between the idle gear 630 and the rack gear 611 is configured to be shorter than a distance of the three gear teeth of the rack gear 611, the engagement of the idle gear 630 with the pinion 410 can be accurately performed.

According to the refrigerator of the present disclosure, a lower end of each of the two gear teeth 631 and 632 of the idle gear 630 is configured to be positioned lower than the lower end of the rack gear 611, the engagement of the idle gear 630 with the pinion 410 can be accurately performed.

In the refrigerator of the present disclosure, since the idle gear 630 is provided to flexibly move upward and downward, the engagement of the idle gear 630 with the pinion 410 can be released while the drawer 200 is closed. Accordingly, the opposite sides of the drawer 200 can be completely closed in parallel.

In the refrigerator of the present disclosure, since the idle gear 630 is provided to flexibly move forward and backward, the engagement of the idle gear 630 with the pinion 410 can be further stably performed and receive further efficiently the pulling force by the pinion 410.

In the refrigerator of the present disclosure, since the idle gear 630 is provided to be flexibly moved upward and downward by the elastic member 634 for up and down movement, the engagement of the idle gear 630 with the pinion 410 can be efficiently released or can be efficiently performed.

In the refrigerator of the present disclosure, since the elastic member 634 for up and down movement is positioned at a position existing between the two gear teeth 631 and 632 of the upper surface of the idle gear 630 or at the upper side of the gear tooth relatively close to the rack gear 611, operation malfunction such as flipping of the idle gear 630 can be prevented.

In the refrigerator of the present disclosure, since the idle gear 630 is provided to be flexibly moved forward and backward by the elastic member 636 for back and forth movement, the forward and backward movements of the idle gear 630 can be further efficiently performed.

According to the refrigerator of the present disclosure, since the first rack member 610 is further provided with the cover body 637 covering an outer part of the idle gear 630, malfunction of the idle gear due to damage of the idle gear or introduction of foreign materials thereinto can be prevented.

Figure 35:
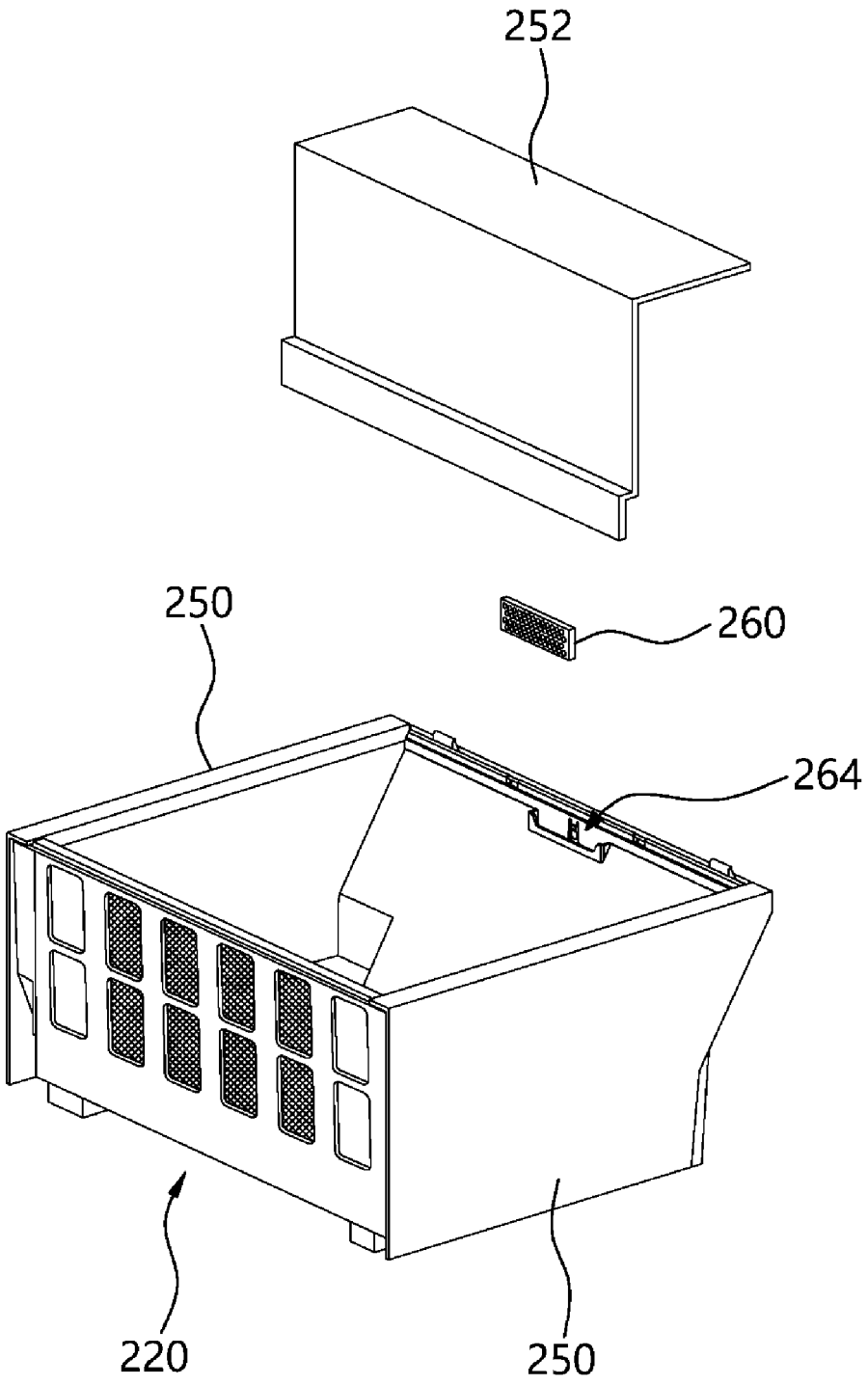
FIG. 35 is a front exploded perspective view of a storage bin according to an example embodiment of the present disclosure.
Figure 36:
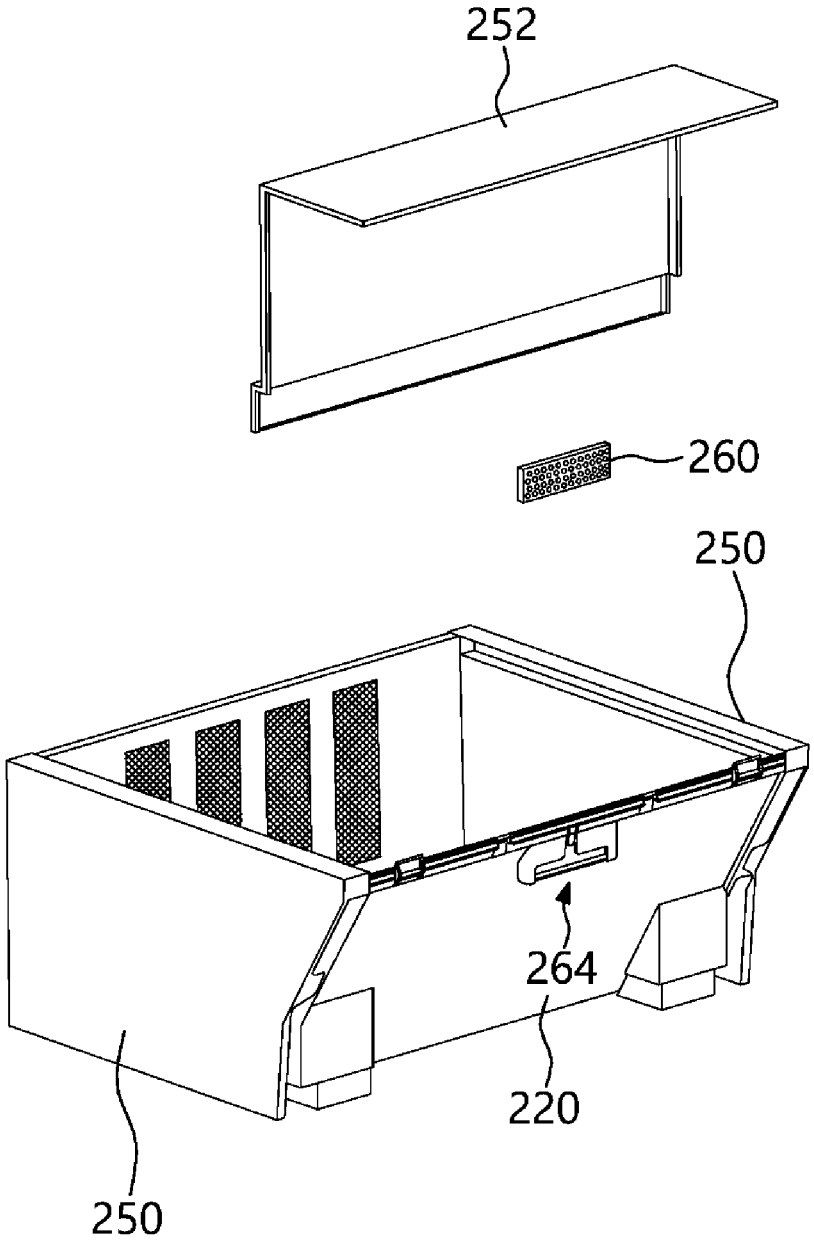
FIG. 36 is a rear exploded perspective view illustrating configuration of a storage bin according to an example embodiment of the present disclosure.
Figure 37:
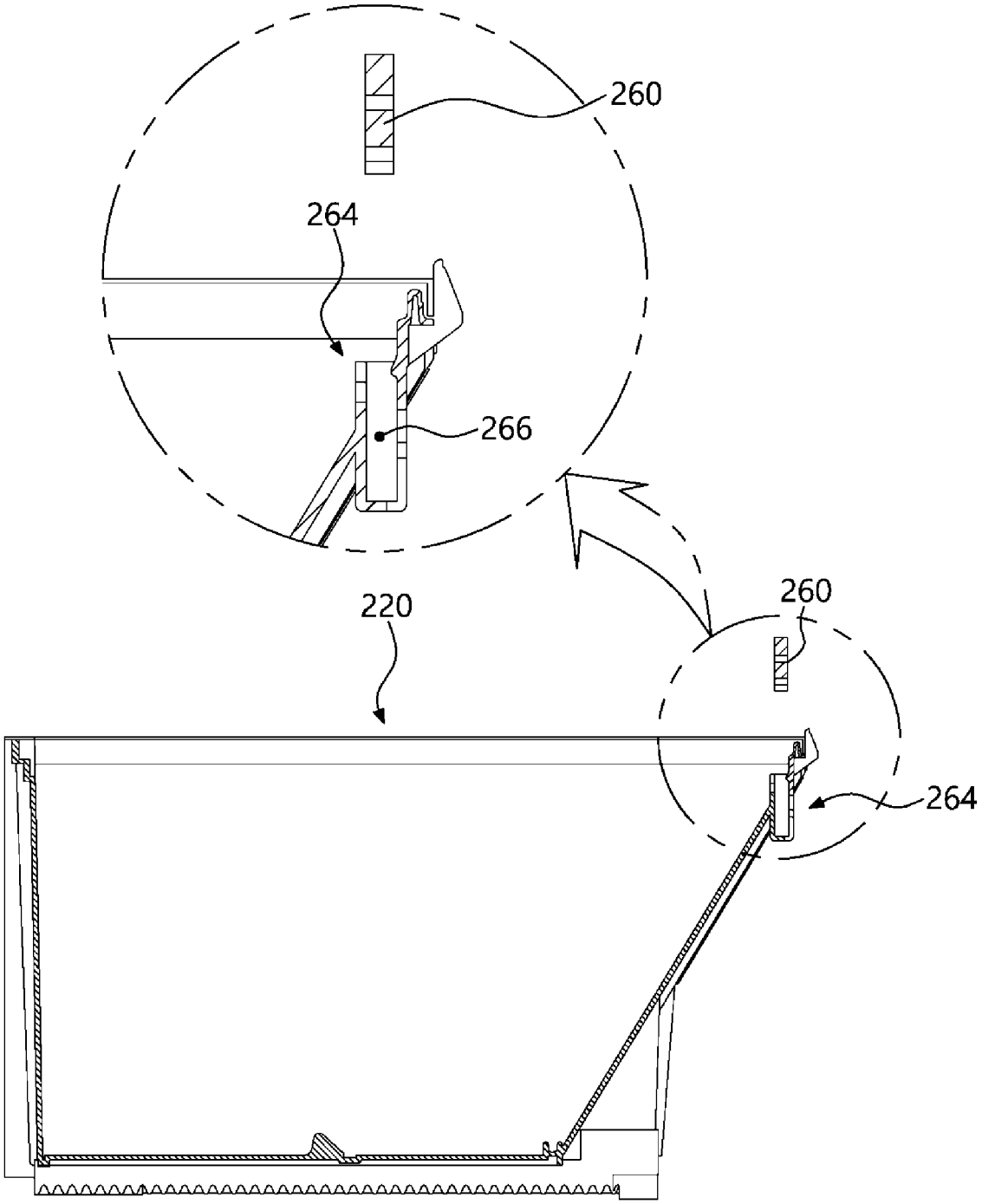
FIG. 37 is a sectional view illustrating configuration of a storage bin according to an example embodiment of the present disclosure.

FIG. 35 is a front exploded perspective view of a storage bin according to an example embodiment of the present disclosure. FIG. 36 is a rear exploded perspective view illustrating configuration of a storage bin according to an example embodiment of the present disclosure. FIG. 37 is a sectional view illustrating configuration of a storage bin according to an example embodiment of the present disclosure.

The storage bin 220 is configured to have a shape of a box having an open upper side, and is attached to the rear of the front panel 210. The storage bin 220 is fixed to the front panel 210 and includes a space into which food or the container 240 is received.

A cover 250 is provided at each of opposite sides of the storage bin 220. The side cover 250 may be made of a metal material such as stainless steel, may be provided at each of the opposite sides of the storage bin 220, and may constitute an outer surface of the storage bin 220.

An inner part of the storage bin 220 may be divided into a front space S1 and a rear space S2. The lift module 300 and the container 240 may be received in an inner part of the front space, and while lifting and lowering in upward and downward directions, the lift module 300 allows food or the container 240 seated on the lift module 300 to lift and lower therewith.

The lift module 300 may be provided under the container 240, and when the container 240 is mounted on the lift module 300, the lift module 300 may be covered by the container 240. Accordingly, any configuration of the lift module 300 is not exposed to an outside.

The rear space S2 is provided with an additional drawer cover 252. The front space S1 and the rear space S2 are partitioned by the drawer cover 252. In an example in which the drawer cover 252 is mounted, a space in which a front surface and an upper surface of the rear space S2 are covered not to be used is not exposed to the outside.

Due to mounting of the drawer cover 252, the rear space S2 is covered when the front panel 210 is moved forward, and in the state in which the front panel 210 is moved forward, only the front space S1 is exposed to the outside, whereby a cleaner appearance can be provided.

A remaining space (except for a space to which the lift module 300 and the container 240 are mounted) is covered to prevent such problems as food dropping or items being stuck in gaps during lifting or lowering.

A deodorizing member 260 may be provided in the storage bin 220 (or at the storage bin). The deodorizing member 260 may be made of materials including odor absorbing substances (such as activated carbon or charcoal). The deodorizing member 260 may be made of various odor absorbing materials, other than the materials described above. In at least one example, a material such as activated carbon or charcoal is applied. The deodorizing member 260 may also be called a deodorizer.

The deodorizing member 260 may have a block shape, and may include a plurality of through holes 262 provided at a front surface thereof. The deodorizing member 260 is provided in the inner part and an outer part of the storage bin 220, and may function to remove or reduce odor from the storage bin and cool air circulating flow path by absorbing odor molecules remaining therein.

Figure 38:
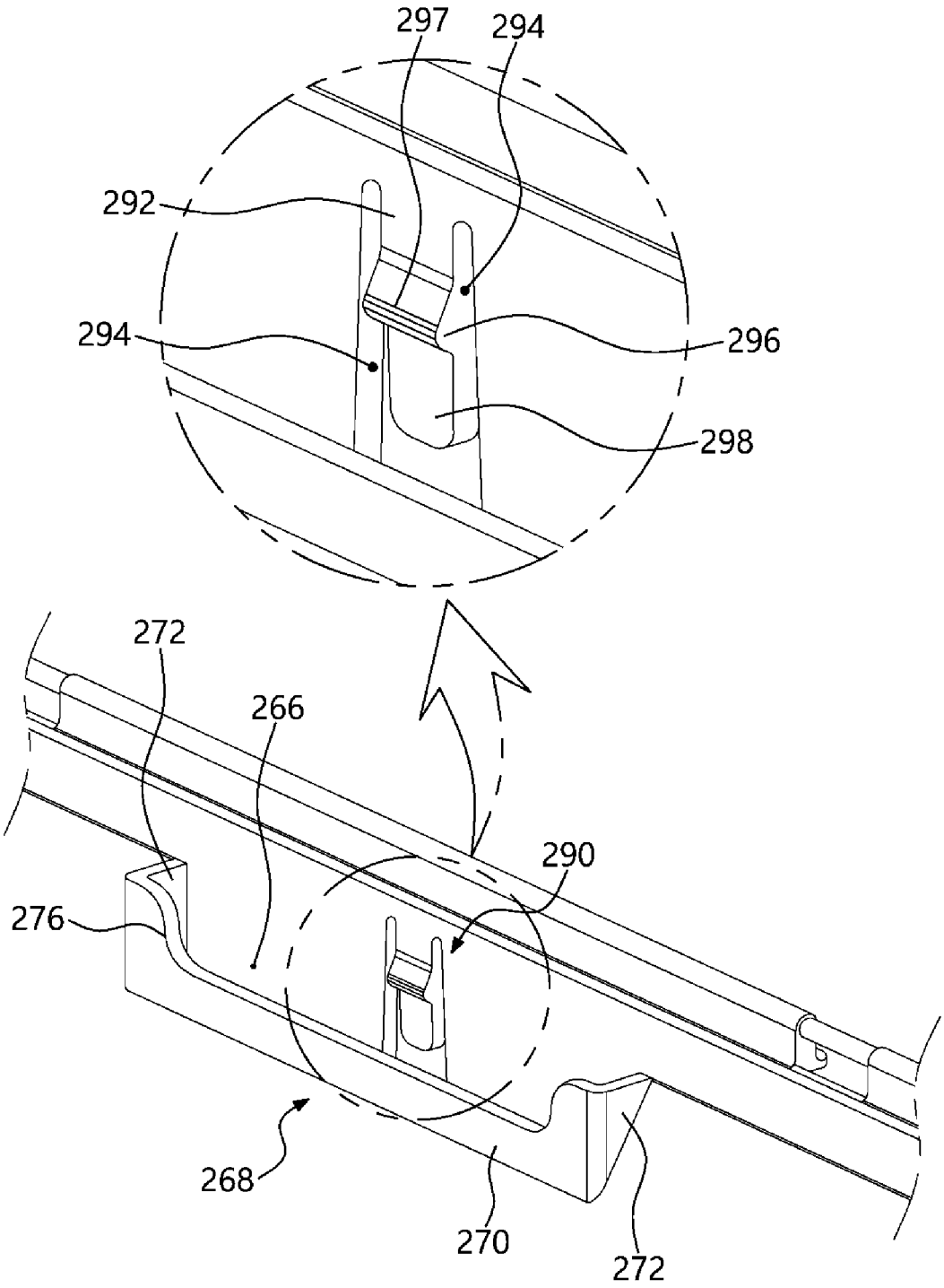
FIG. 38 is an enlarged perspective view illustrating an upper end part of a deodorizing case according to an example embodiment of the present disclosure.
Figure 39:
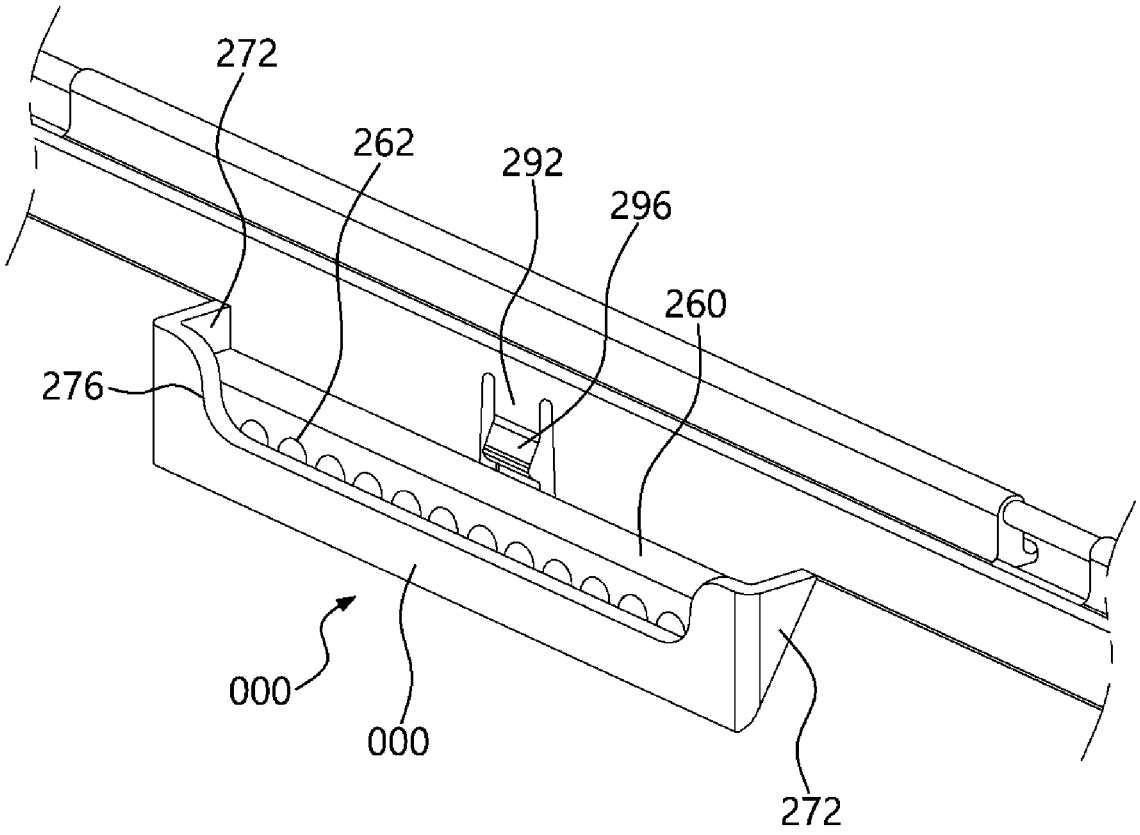
FIG. 39 is an enlarged perspective view illustrating a state of a deodorizing member mounted to the upper end part of the deodorizing case according to an example embodiment of the present disclosure.
Figure 40:
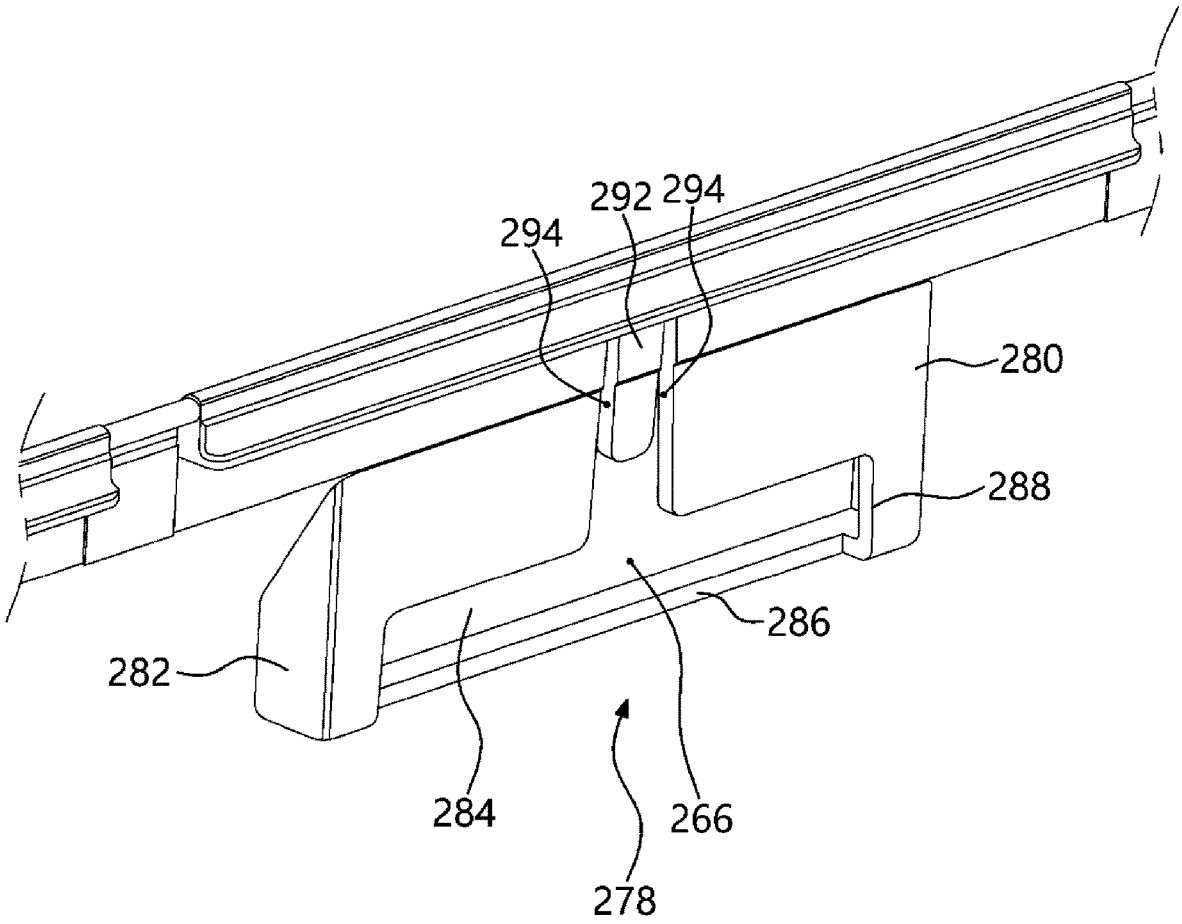
FIG. 40 is an enlarged perspective view illustrating a lower end part of the deodorizing case according to an example embodiment of the present disclosure.
Figure 41:
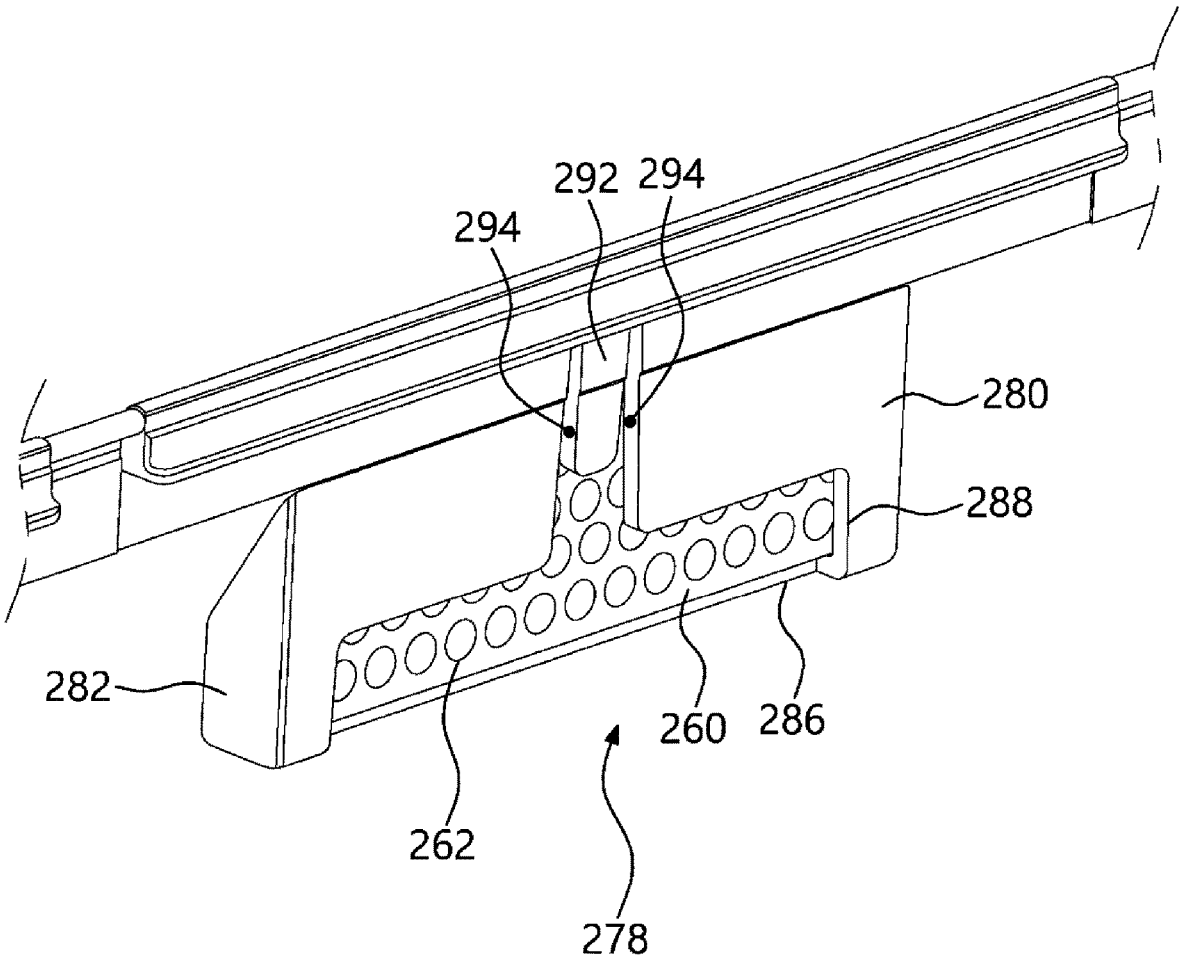
FIG. 41 is an enlarged perspective view illustrating a state in which the deodorizing member is mounted in an inner part of the lower end part of the deodorizing case according to an example embodiment of the present disclosure.
Figure 42:
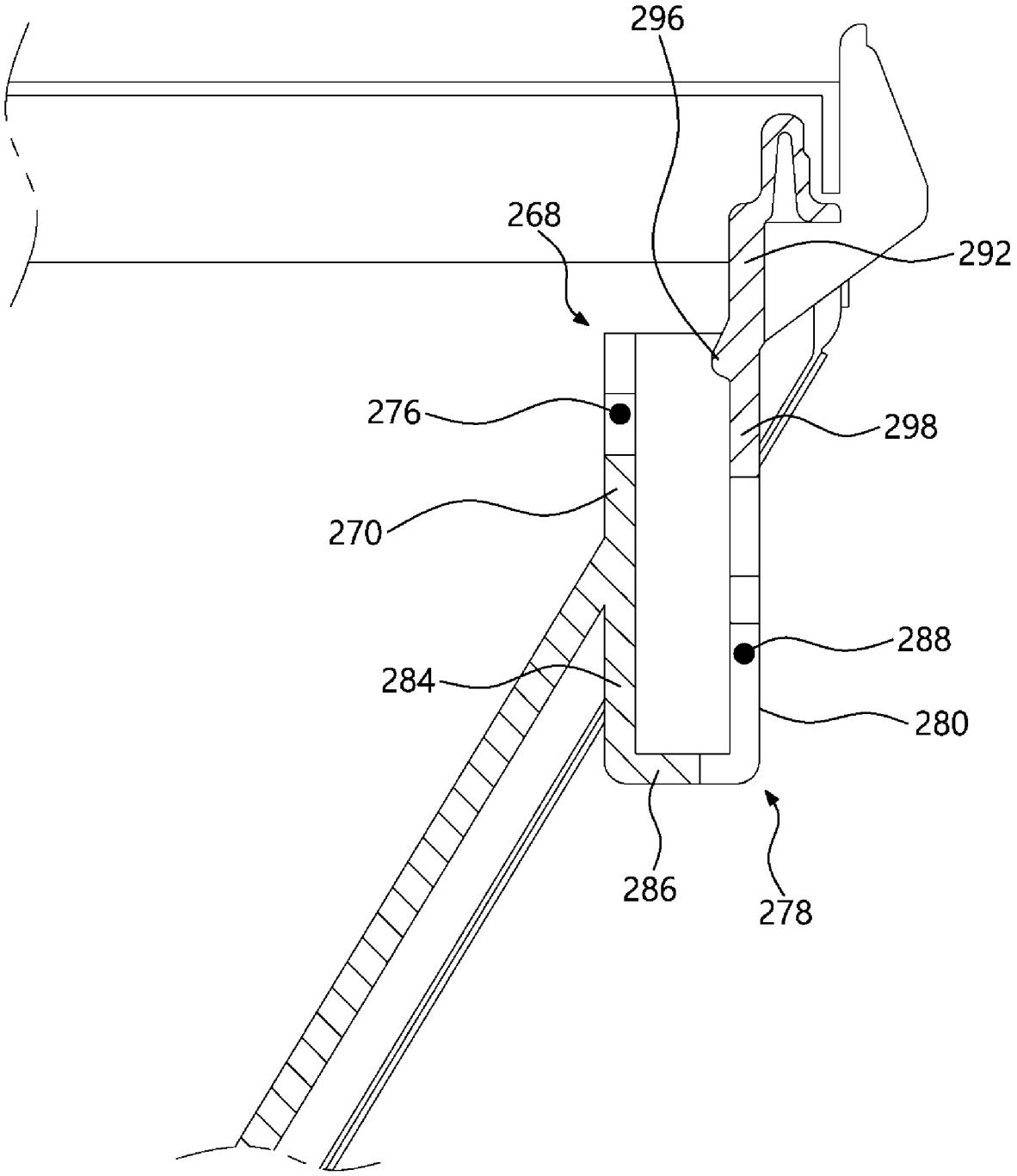
FIG. 42 is a sectional view illustrating configuration of the deodorizing case according to an example embodiment of the present disclosure.
Figure 43:
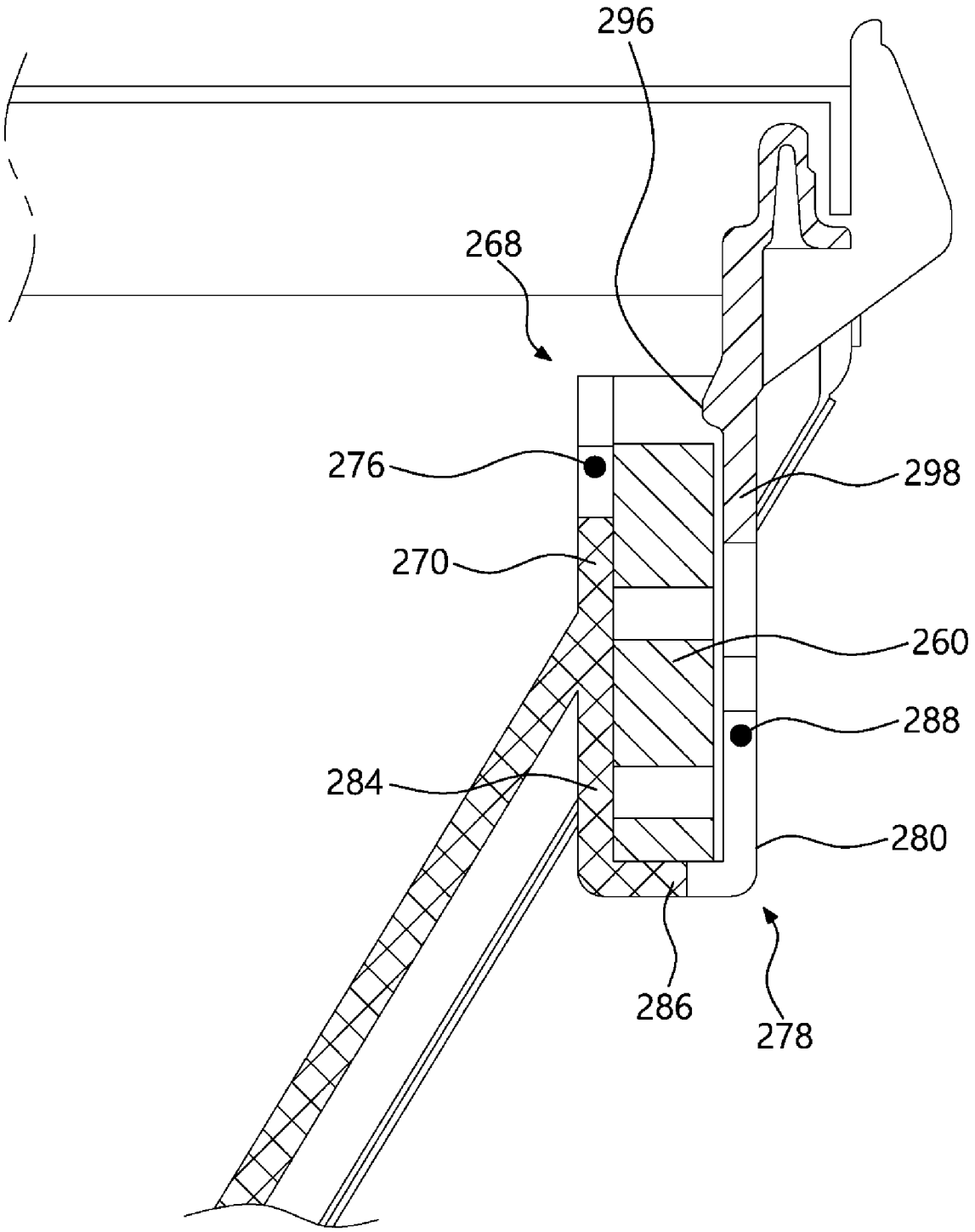
FIG. 43 is a sectional view of a state in which the deodorizing member is mounted in the deodorizing case according to an example embodiment of the present disclosure.
Figure 44:
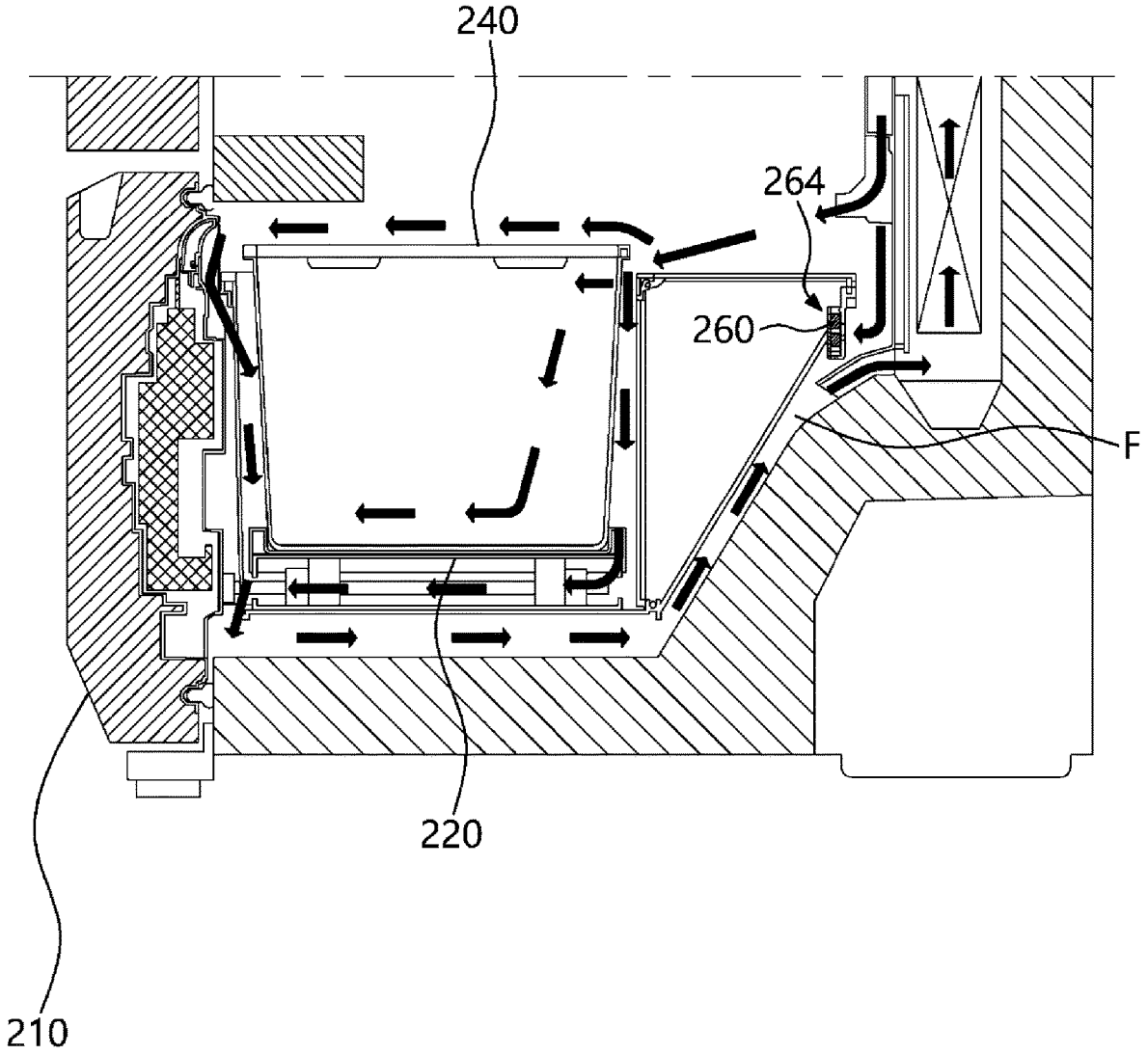
FIG. 44 is a sectional view illustrating cool air circulation course of cool air circulating flow path according to an example embodiment of the present disclosure.

FIG. 38 is an enlarged perspective view illustrating an upper end part of a deodorizing case according to an example embodiment of the present disclosure. FIG. 39 is an enlarged perspective view illustrating a state of a deodorizing member mounted to the upper end part of the deodorizing case according to an example embodiment of the present disclosure. FIG. 40 is an enlarged perspective view illustrating a lower end part of the deodorizing case according to an example embodiment of the present disclosure. FIG. 41 is an enlarged perspective view illustrating a state in which the deodorizing member is mounted in an inner part of the lower end part of the deodorizing case according to an example embodiment of the present disclosure. FIG. 42 is a sectional view illustrating configuration of the deodorizing case according to an example embodiment of the present disclosure. FIG. 43 is a sectional view of a state in which the deodorizing member is mounted in an inner part of the deodorizing case according to an example embodiment of the present disclosure. FIG. 44 is a sectional view illustrating cool air circulation course of the cool air circulating flow path according to an example embodiment of the present disclosure. Other embodiments and configurations may also be provided.

The deodorizing case 264 may be provided on a rear surface (relative to the inner surface) of the storage bin 220. Since the deodorizing case 264 is configured to have a shape of a box having an open upper side, a deodorizing member installation space 266 (or inner space) may be provided in the deodorizing case. The deodorizing member 260 may be inserted into the deodorizing member installation space 266, and may remove or reduce odors from the storage bin and the cool air circulating flow path. The deodorizing case 264 may also be called a holder or a deodorizing holder.

Although the deodorizing case 264 may be manufactured independently of the storage bin 220 and assembled therewith, the deodorizing case 264 and the storage bin 220 may be provided as a single body by injection molding. The deodorizing case (or holder) may be integrally provided with the storage bin.

Configuration of the deodorizing case 264 may be described in detail.

The deodorizing case 264 (or holder) may include the upper end part 268 (or upper end) of the deodorizing case, and the lower end part 278 (or lower end) of the deodorizing case. The upper end part 268 includes a front wall 270 having a shape of a plate with a predetermined thickness and provided by protruding a predetermined length or more from side to side along an inner surface of the storage bin 220, and an upper side surface wall 272 provided at each of opposite sides of the front wall 270 may protrude to the inner surface of the storage bin 220 so as to cover the opposite sides of the front wall 270.

As shown in FIG. 38, the front wall 270 is provided at an upper side of a rear surface of the storage bin 220 by vertically protruding therefrom (relative to an inner surface thereof). The front wall 270 may be long from left to right along the inner surface of the storage bin 220. Accordingly, functions to support an upper front surface of the deodorizing member 260 when the deodorizing member 260 is mounted.

The upper side surface wall 272 may be provided at each of opposite sides of the front wall 270. The upper side surface wall 272 may be a wall having a predetermined thickness and extends to the inner surface of the storage bin 220 from each of opposite ends of the front wall 270. Since the upper side surface wall 272 is provided at each of the opposite sides of the front wall 270, the upper side surface wall 272 may support the upper side surface of the deodorizing member 260 inserted into the deodorizing member installation space 266 (or the inner space).

A deodorizing member check part 276 (or opening part) may be provided at a front surface of the front wall 270. The deodorizing member check part 276 is configured to be depressed by a predetermined depth in a downward direction along an upper end part of the front wall 270. The deodorizing member check part 276 is configured to be formed through the front wall 270 from a front thereof to a rear thereof. Accordingly, when the deodorizing member is inserted into the deodorizing member installation space 262, a user can check whether the deodorizing member 260 is installed by naked eye.

As a portion of the front surface of the front wall 270 is open due to the deodorizing member check part 276 (or opening part), an upper portion of the deodorizing member 260 may be exposed to the inner surface of the storage bin 220.

A portion of the deodorizing member 260 may be exposed to the inner surface of the storage bin 220, whereby the deodorizing member 260 may directly contact with cool air of the storage bin. Accordingly, odor removal performance of the storage bin may be improved.

The lower end part 278 (or lower end) of the deodorizing case 264 (or holder) may be provided on an outer rear surface of the storage bin 220.

The lower end part 278 may be provided on the outer rear surface (relative to an outer surface of the draw part) of the storage bin 220 by protruding therefrom. The lower end part 278 may extend from a lower part of the upper end part 268 and define the deodorizing member installation space 266 (or inner space) in cooperation with the upper end part 268.

The lower end part 278 may have a shape of a plate having a predetermined thickness and includes: the rear wall 280 provided by protruding a predetermined length or more from left to right along the outer surface of the storage bin 220; first and second lower side surface walls 282 provided at opposite sides of the rear wall 280 by protruding to the outer surface of the storage bin 220 so as to cover the opposite sides of the rear wall 280; an extended wall 284 provided at a front of the rear wall 280 to be long from left to right along the outer surface of the storage bin 220 by protruding therefrom so as to cover the front of the rear wall 280; and a bottom wall 286 provided at a lower end part of each of the rear wall 280 and the lower side surface walls 282 so as to support a lower surface of the deodorizing member 260.

As shown in FIG. 40, the rear wall 280 may be vertically provided at a rear upper side (relative to an outer surface thereof) of the storage bin 220 by protruding therefrom. The rear wall 280 may be long from left and right along the outer surface of the storage bin 220 and may support a rear surface of the deodorizing member 260.

The lower side surface wall 282 may be provided at each of the opposite sides of the rear wall 280. The lower side surface wall 282 is configured to be a wall having a predetermined thickness and extends from each of opposite ends of the front wall 270 toward the outer surface of the storage bin 220. The lower side surface wall 282 is provided at each of the opposite sides of the rear wall 280 to support the lower surface of the deodorizing member 260 inserted into the deodorizing member installation space 266 (or inner space).

The extended wall 284 may be provided on a front surface of each of the lower side surface walls 282. The extended wall 284 may be a wall and may be long from left to right, wherein each of opposite ends of the extended wall 284 is fixed to the front surface of each of the lower side surface walls 282, which are separate from each other.

The extended wall 284 may be positioned on the front surface of the lower side surface walls 282. Accordingly, when the deodorizing member 260 is inserted into the deodorizing member installation space 266 (or inner space), the extended wall 284 supports a lower front surface of the deodorizing member 260.

The bottom wall 286 may be provided at lower ends of the rear wall 280 and the lower side surface walls 282. The bottom wall 286 may be a plate having a predetermined thickness and may be long from left to right, and thus cover a lower end part of the deodorizing member installation space 266.

The upper surface of the bottom wall 286 is a portion on which the deodorizing member 260 sits to be supported.

A cool air circulation part 288 (or cool air circulation opening) is provided on a rear surface of the rear wall 280. The cool air circulation part 288 may be recessed by a predetermined depth in an upward direction along a lower end part of the rear wall 280. The cool air circulation part 288 is formed through the rear wall 280 in forward and backward directions thereof and thus function to allow a portion of the deodorizing member 260 mounted to the deodorizing case 264 (or holder) to communicate with the cool air circulating flow path F.

Accordingly, a portion of the lower end part 278 (or lower end) positioned at a side of the cool air circulating flow path F is configured to be open. Accordingly, cool air of the cool air circulating flow path F and the deodorizing member 260 may directly contact each other, and thus odor removal performance of the deodorizing member 260 may be improved.

The cool air circulation part 288 (or cool air circulation opening) may be provided on a rear surface of the deodorizing case 264 (or holder), and thus the inner surface of the storage bin 220 and the cool air circulating flow path F communicate with each other. Accordingly, odor molecules may be removed by passing through the deodorizing member 260, so that the odor removal performance of the deodorizing member 260 is improved.

An anti-deviation member 290 (or anti-movement device) may be provided at an upper side of the deodorizing case 264. The anti-deviation member 290 may move rearward by being elastically deformed when the deodorizing member 260 is installed in the inner part of the deodorizing case 264. When installation of the deodorizing member 260 is completed in the inner part of the deodorizing case 264, the anti-deviation member 290 may move forward and the deodorizing member 260 may be prevented from moving upward.

Configuration of the anti-deviation member 290 may be described in detail.

The anti-deviation member 290 may be vertically provided at an upper part of the rear wall 280 by protruding therefrom, and may include an elastic piece 292 installed behind the deodorizing member 260 and an anti-deviation protrusion 296 (or anti-movement protrusion) provided on a front surface of the elastic piece 292 by protruding therefrom to prevent deviation (or movement) of the deodorizing member 260.

The elastic piece 292 may be provided at an upper side of the rear wall 280. The elastic piece 292 may have a plate shape and may be vertically long at the upper side of the rear wall 280.

A cut part 294 may be provided at each of opposite sides of the elastic piece 292. The cut part 294 may be provided at each of the opposite sides of the elastic piece 292 by being formed therethrough to have a longitudinal hole shape. The cut part 294 may function to separate the rear wall 280 from the elastic piece 292 such that the elastic piece 292 is elastically deformed in forward and backward directions.

The anti-deviation protrusion 296 may be provided on the front surface of the elastic piece 292. The anti-deviation protrusion 296 may have a circular arc shape in section, and may be long from left to right on the front surface of the elastic piece 292. The anti-deviation protrusion 296 may be provided at the upper side of the deodorizing case 264 (or holder) by protruding forward therefrom, thereby preventing the deodorizing member 260 from moving upward.

Frictional protrusions 297 may be provided on a front surface of the anti-deviation protrusion 296. Each of the frictional protrusions 297 is provided on the front surface of the anti-deviation protrusion 296 by protruding therefrom to be long from left and to right. Since the frictional protrusion 297 includes a plurality of frictional protrusions provided on the front surface of the anti-deviation protrusion 296 by protruding therefrom, the frictional protrusions 297 contact with the rear surface of the deodorizing member 260 when the deodorizing member 260 deviates (or moves) upward.

Since the frictional protrusions 297 are in contact with the rear surface of the deodorizing member 260, the frictional protrusions 297 function to additionally prevent the deodorizing member 260 from deviating (or moving) upward.

A deodorizing member support piece 298 (or support part) may be provided at a lower part of the anti-deviation protrusion 296. The deodorizing member support piece 298 may protrude from the anti-deviation protrusion 296 in a downward direction thereof, and may support the rear surface of the deodorizing member 260.

A movement in which the deodorizing member 260 is inserted into or withdrawn from the deodorizing case 264 according to the example embodiment may be described in detail.

In the process in which the deodorizing member 260 is inserted into the deodorizing case 264, while a user grasps the deodorizing member 260, the user inserts the deodorizing member 260 into the deodorizing member installation space 266 through an upper open part of the deodorizing case 264.

In the process in which the deodorizing member 260 is inserted into the deodorizing member installation space 266, the anti-deviation member 290 positioned at the upper side of the deodorizing case 264 may be elastically deformed backward by a pressing force of the deodorizing member 260.

When the deodorizing member 260 is completely inserted into the deodorizing case 264, the deodorizing member 260 is mounted to the inner surface of the storage bin 220 while a portion of the deodorizing member 260 is exposed to the upper end part of the deodorizing case 264 as shown in FIG. 39.

When the mounting of the deodorizing member 260 to the deodorizing case 264 is completed, the anti-deviation member 290 may be restored to an initial position thereof, and the anti-deviation protrusion 296 of the anti-deviation member 290 may be positioned at the upper side of the deodorizing case 264.

Accordingly, as the anti-deviation member 290 protrudes at the upper side of the deodorizing case 264, the deodorizing member 260 may be prevented from deviating (or moving) to the outside of the deodorizing case 264.

To wash and replace the deodorizing member 260, the deodorizing member 260 may be required to be withdrawn from the deodorizing case 264.

A process of withdrawing of the deodorizing member 260 may be performed contrarily to the process of inserting of the deodorizing member 260. Accordingly, a detailed description may be omitted.

Accordingly, as the box-shaped deodorizing case 264 (or holder) having an open upper side is provided at the upper side of the inner surface of the storage bin 220, the inserting and withdrawing of the deodorizing member 260 may be performed by manipulation of a user.

The deodorizing case 264 may be divided into the upper end part 268 and the lower end part, wherein the upper end part 268 is provided at an inner side of the storage bin 220, and the lower end part 278 is provided at the side of the cool air circulating flow path F. Accordingly, the deodorizing member installation space 266 may be minimized and thus the storage bin utilization may be improved.

Accordingly, example embodiments may have been made keeping in mind the problems occurring in related art, and the present disclosure is intended to provide a refrigerator having a drawer, wherein an upper end part of a deodorizing case in which a deodorizing member is installed is provided on an inner surface of a storage bin of the drawer, and a lower end part of the deodorizing case is provided in cool air circulating flow path. Accordingly, a deodorizing member installation space occupying the storage bin of the drawer may be minimized, and the deodorizing member may be positioned in the cool air circulating flow path, whereby deodorizing performance is improved.

Example embodiments may provide a refrigerator having a drawer, wherein the deodorizing member is configured to be easily inserted into and withdrawn from an upper open part of the deodorizing case. Accordingly, the deodorizing member is easily exchanged with a new one.

Example embodiments may provide a refrigerator having a drawer, wherein an anti-deviation member is provided on the upper side of the deodorizing case. Accordingly, the deodorizing member mounted in the deodorizing case may be prevented from deviating to outside by such a simple structure.

The present disclosure may provide a refrigerator having a drawer, wherein a deodorizing member check part and a cool air circulation part are provided at an upper end part and a lower end part of the deodorizing member, respectively, so that the cool air inside the storage bin and the cool air inside the cool air circulating flow path directly contact with the deodorizing member.

In a refrigerator having a drawer of the present disclosure, an upper end part of a deodorizing case (or holder), in which a deodorizing member is installed, and a lower end part of the deodorizing case are provided on an inner surface of a storage bin of the drawer and in a cool air circulating flow path, respectively. Accordingly, a deodorizing member installation space occupying the storage bin may be minimized.

In the refrigerator having a drawer of the present disclosure, the lower end part of the deodorizing case may be provided in the cool air circulating flow path. Accordingly, in a process of circulating cool air, odor removal may be performed.

The refrigerator having a drawer of the present disclosure may include a portion of the deodorizing member positioned at the upper end part of the deodorizing case may be exposed to an inner part of the storage bin. Accordingly, cool air of the storage bin may be in direct contact with the deodorizing member.

According to the refrigerator having a drawer of the present disclosure, there may be provided the box-shaped deodorizing case having an open upper side. Accordingly, such a structure may allow the deodorizing member to be inserted and pulled out.

In the refrigerator having a drawer of the present disclosure, the upper end part may include a front wall and upper side surface walls such that the upper side of the deodorizing member is firmly supported.

According to the refrigerator having a drawer of the present disclosure, a deodorizing member check part (or opening part) may be provided in the front wall. Accordingly, an upper end of the deodorizing member may be exposed to the inner part of the storage bin.

In the refrigerator having a drawer of the present disclosure, the lower end part may include a rear wall, lower side surface walls, an extended wall, and a bottom wall such that a lower side of the deodorizing member is firmly supported.

According to the refrigerator having a drawer of the present disclosure, cool air circulation part may be provided at the rear wall. Accordingly, a lower end of the deodorizing member may be exposed to the cool air circulating flow path.

According to the refrigerator having a drawer of the present disclosure, an anti-deviation member (or anti-movement member) may be provided at an upper side of the deodorizing case. Accordingly, the deodorizing member held in the deodorizing case (or holder) may be prevented from being detached upward.

According to the refrigerator having a drawer of the present disclosure, the anti-deviation member may include an elastic piece and an anti-deviation protrusion. (or anti-movement protrusion) Accordingly, the deodorizing member may be prevented from being removed due to such a configuration.

According to the refrigerator having a drawer of the present disclosure, the elastic piece may be provided on the rear wall to be elastically deformed. Accordingly, when the deodorizing member is inserted into the deodorizing case, the anti-deviation protrusion may move backward.

According to the refrigerator having a drawer of the present disclosure, a cut part may be provided at each of opposite sides of the elastic piece, and the elastic piece may be provided between the opposite cut parts by protruding downward so as to be elastically deformed in forward and backward directions.

As described above, according to the refrigerator having a drawer of the present disclosure, the deodorizing member installation space (or inner space) is divided into an inner surface of the storage bin and the cool air circulating flow path. Accordingly, the deodorizing member installation space is minimized and a space utilization of the storage bin is improved.

Since the lower end part of the deodorizing case is positioned in the cool air circulating flow path, odor can be additionally removed in the process of circulating cool air. Accordingly, deodorizing performance of the refrigerator is improved.

Further, since the deodorizing member check part is provided on the upper end part of the deodorizing case, a user can easily check whether the deodorizing member is mounted by naked eye. Further, since the upper side of the deodorizing member is provided to be open, deodorizing time of the storage bin decreases.

The present disclosure is intended to cover not only the exemplary embodiment, but also various alternatives, modifications, equivalents and other embodiments that may be included within the spirit and scope of the present disclosure as defined by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,647 filed Sep. 25, 2019, U.S. application Ser. No. 16/582,518 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,810 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A refrigerator comprising:

a cabinet having an opening to access a storage chamber provided within the cabinet;

a drawer including a front panel and a storage bin coupled to a rear of the front panel, the drawer being coupled to the cabinet such that the drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber;

a holder at the storage bin, the holder having an upper end at an inner surface of the storage bin, and having a lower end at an outer surface of the storage bin; and a deodorizer having a block shape and to be provided in an inner space of the holder, and the deodorizer is configured to reduce an odor from the storage chamber, and wherein an upper portion of the deodorizer is to be provided on the inner surface of the storage bin, and a lower portion of the deodorizer is to be provided on the outer surface of the storage bin.

2. The refrigerator of claim 1, wherein the lower end of the holder is provided in a cool air circulating flow path.

3. The refrigerator of claim 2, wherein a portion of the deodorizer is exposed through the lower end of the holder to the cool air circulating flow path.

4. The refrigerator of claim 1, wherein a portion of the deodorizer is exposed through the upper end of the holder to an inner part of the storage bin.

5. The refrigerator of claim 1, wherein the holder is integrally provided with the storage bin.

6. The refrigerator of claim 1, wherein the holder is to have at least an open upper side and an inner space, and the deodorizer is to be inserted through the open upper side of the holder and into the inner space of the holder.

7. The refrigerator of claim 1, wherein the upper end of the holder includes:

a front wall to protrude from the inner surface of the storage bin; and first and second upper side walls provided at opposite sides of the front wall by protruding therefrom to the inner surface of the storage bin.

8. The refrigerator of claim 7, further comprising:

an opening part provided at the front wall by a portion of the front wall to be open to the inner surface of the storage bin.

9. The refrigerator of claim 1, wherein the lower end of the holder includes:

a rear wall provided along the outer surface of the storage bin;

first and second lower side walls provided at opposite sides of the rear wall by protruding from the outer surface of the storage bin;

an extended wall provided at the rear wall; and a bottom wall provided at a lower end of the rear wall and lower ends of the lower side walls to support the deodorizer.

10. The refrigerator of claim 9, further comprising:

a cool air circulation opening provided on the rear surface of the rear wall to allow a portion of the rear wall to be open to a cool air circulating flow path.

11. The refrigerator of claim 10, wherein the cool air circulation opening is to communicate with an inner part of the storage bin.

12. The refrigerator of claim 9, further comprising:

a protrusion device having a plate shaped elastic piece and a protrusion to protrude from the plate shaped elastic piece, the protrusion device provided at an upper side of the holder, wherein when the deodorizer is provided in the holder, the protrusion device is to protrude from the plate shaped elastic piece to the deodorizer and is configured to prevent the deodorizer from moving upward.

13. The refrigerator of claim 12, wherein the protrusion device is integrally provided with the rear wall.

14. The refrigerator of claim 12, wherein the protrusion device includes:

the plate shaped elastic piece to protrude from the rear wall and to be provided behind the deodorizer;

the protrusion configured to protrude from the plate shaped elastic piece to prevent movement of the deodorizer.

15. The refrigerator of claim 14, wherein the plate shaped elastic piece is provided on the rear wall to be elastically deformed.

16. The refrigerator of claim 14, further comprising:

first and second cut parts provided at opposite sides of the plate shaped elastic piece-.

17. The refrigerator of claim 14, further comprising:

a support part to protrude in a downward direction from a lower part of the protrusion to support a rear surface of the deodorizer when the deodorizer is provided in the holder.

18. The refrigerator of claim 14, further comprising:

a plurality of frictional protrusions provided on the protrusion by protruding a predetermined length or more therefrom from left to right.

19. The refrigerator of claim 1, wherein the deodorizer is configured to reduce the odor from the storage chamber by absorbing odor molecules.

20. The refrigerator of claim 1, wherein the deodorizer includes a plurality of through holes provided on a front surface of the deodorizer.

* * * * *